US012751505B2

(12) United States Patent
Haynes

(10) Patent No.: US 12,751,505 B2
(45) Date of Patent: Oct. 6, 2026

(54) DUAL STRAPPED UTILITY GARMENT

(71) Applicant: Whypak Solutions LLC, San Lorenzo, CA (US)

(72) Inventor: Larry Haynes, San Lorenzo, CA (US)

(73) Assignee: Whypak Solutions LLC, San Lorenzo, CA (US)

( * ) Notice: Subject to any disclaimer, the term of this patent is extended or adjusted under 35 U.S.C. 154(b) by 0 days.

(21) Appl. No.: 19/396,155

(22) Filed: Nov. 20, 2025

(65) Prior Publication Data

US 2026/0144309 A1 May 28, 2026

Related U.S. Application Data

(60) Provisional application No. 63/724,184, filed on Nov. 22, 2024.

(51) Int. Cl.

| | |
|---|---|
| ***A41D 1/04*** | (2006.01) |
| ***A41D 3/00*** | (2006.01) |
| ***A41D 27/20*** | (2006.01) |
| ***A41D 31/02*** | (2019.01) |

(52) U.S. Cl.

CPC ..... *A41D 1/04* (2013.01); *A41D 3/00* (2013.01); *A41D 27/201* (2013.01); *A41D 27/205* (2013.01); *A41D 31/02* (2013.01); *A41D 2200/10* (2013.01); *A41D 2300/32* (2013.01); *A41D 2300/322* (2013.01); *A41D 2300/324* (2013.01); *A41D 2400/48* (2013.01); *A41D 2600/20* (2013.01)

(58) Field of Classification Search

CPC ..... A41D 1/04; A41D 13/0007; A41D 13/01; A41D 13/0518

See application file for complete search history.

(56) References Cited

U.S. PATENT DOCUMENTS

| | | | | |
|---|---|---|---|---|
| 1,290,827 | A | 1/1919 | Yergason | |
| 1,797,359 | A | 3/1931 | Meyers | |
| 3,167,786 | A | 2/1965 | Johnson | |
| 3,261,042 | A | 7/1966 | Baker | |
| 3,529,307 | A | 9/1970 | Belson et al. | |
| 4,106,121 | A | 8/1978 | Belson | |
| 4,261,494 | A | 4/1981 | Thomas | |
| 4,369,526 | A | 1/1983 | Clutts | |
| 4,634,031 | A | 1/1987 | Frankhouse | |
| 5,024,360 | A | 6/1991 | Rodriguez | |
| 5,211,321 | A | 5/1993 | Rodriguez | |
| 5,247,707 | A | 9/1993 | Parker et al. | |
| 5,799,329 | A | 9/1998 | Hauschild | |
| 5,816,460 | A | 10/1998 | Cook | |
| 5,881,487 | A * | 3/1999 | Chalker | F41C 23/02 42/85 |
| 5,893,370 | A | 4/1999 | Perez | |
| 5,893,502 | A | 4/1999 | Redzisz | |
| 5,961,014 | A | 10/1999 | Knerr | |
| 6,196,436 | B1 | 3/2001 | Williams | |

(Continued)

*Primary Examiner* — Brian D Nash

(74) *Attorney, Agent, or Firm* — Morrison & Foerster LLP

(57) ABSTRACT

Provided are dual-strapped utility garments ("strapvests") that includes a first main strap and a second main strap having one or more of a variety of compartments for storing objects and tools for convenient access to a wearer, and optionally includes a rotatable portion on one or both of the first main strap and the second main strap.

18 Claims, 13 Drawing Sheets

(56) References Cited

U.S. PATENT DOCUMENTS 6,199,731 B1 * 3/2001 Lehoux ..... A45F 3/14 224/259
6,260,202 B1 7/2001 Villalobos et al.
6,311,336 B1 11/2001 Gootrad
6,345,751 B1 2/2002 Elliot
7,163,132 B2 * 1/2007 Rundberg ..... A45F 3/14 224/907
D640,417 S 6/2011 Haynes
8,015,621 B2 * 9/2011 Udelhofen ..... A63B 71/12 2/102
8,490,216 B2 7/2013 Haynes
8,523,028 B1 * 9/2013 Young ..... A61F 5/3738 224/159
10,231,493 B1 * 3/2019 Sarantos ..... A41D 1/04
10,746,393 B1 * 8/2020 White ..... G08B 5/36
10,939,709 B2 3/2021 Haynes
2005/0210569 A1 9/2005 Panzenbock et al.
2010/0282808 A1 11/2010 Debnam et al.
2010/0313329 A1 12/2010 Haynes
2012/0074182 A1 * 3/2012 Harris ..... A47D 13/025 224/160
2013/0305429 A1 11/2013 Haynes
2014/0027481 A1 1/2014 Schultz et al.
2014/0157484 A1 * 6/2014 Ezell ..... A41D 13/0058 2/102
2015/0374043 A1 * 12/2015 Dahl ..... A41D 1/04 2/102
2016/0360864 A1 * 12/2016 Drake ..... A45F 4/02
2017/0295913 A1 * 10/2017 Gaskin ..... A41D 1/04
2020/0289875 A1 * 9/2020 Fewell ..... A63B 21/16
2021/0339069 A1 * 11/2021 Coughlan ..... A41D 1/04
2022/0232908 A1 * 7/2022 You ..... A41D 1/04
2023/0321479 A1 * 10/2023 Yu ..... A63B 21/00185 482/124
2024/0023654 A1 * 1/2024 Schneider ..... F16G 11/14
2024/0023656 A1 * 1/2024 Schneider ..... F16G 11/14
2024/0215707 A1 * 7/2024 Porter ..... A45F 3/02
2025/0067541 A1 * 2/2025 Beck ..... F41H 5/0478
2025/0089822 A1 * 3/2025 Bassoo ..... A63B 21/0557

* cited by examiner

DUAL STRAPPED UTILITY GARMENT

CROSS-REFERENCE TO RELATED APPLICATIONS

This application claims priority to U.S. Provisional Ser. No. 63/724,184, filed Nov. 22, 2024, entitled "Dual Strapped Utility Garment," which is hereby incorporated by reference in its entirety.

FIELD OF THE DISCLOSURE

The present disclosure relates generally to the field of storage garments, and more specifically to a dual-strapped utility garment (also referred to herein as a strapvest) for carrying and storing various objects (such as tools) and personal items for easy access to a wearer.

BACKGROUND

Various types of workers, including carpenters, painters, electricians and the like, often need to carry and store a wide range of tools and objects on worksites. For a particular task, a worker may need a variety of different tools close at hand for immediate access, as well as personal items and other objects. These needs can arise while working at a site far removed from toolboxes and secure storage sites, and it may be inconvenient or dangerous to step away from a work in progress to retrieve additional tools. Hobbies and recreational activities such as hiking, fishing, hunting, crafting, biking, traveling, skateboarding, and boating also require specialized tools, gadgets, and electronics that must be carried when they are not in use, often for long distances away from secured storage locations. Attendees of special events like concerts and sporting events may also need to carry and store various objects, e.g., concert tickets and personal items, in a secure location that is easily accessible to a wearer. Everyday activities like shopping, running errands, and childcare also require a variety of objects that are inconvenient to carry in one's hands.

A variety of tool boxes, tool belts, backpacks, and pocketed garments are available for workers and recreation enthusiasts, however, these garments may be cumbersome to wear over clothing and can be difficult to maneuver while performing delicate tasks. Additionally, these existing technologies may lack sufficient storage capacity and tailored compartments for holding appropriate gadgets and tools, and their contents may be difficult to access at a moment's notice. Further, conventional storage devices may not be practical and fashionable for everyday use, making them less appealing to wear over clothing or outside of a worksite, e.g., as sportswear or urban wear. Accordingly, there is a need for a functional garment that can secure a variety of tools close at hand, while reducing interference with a wearer's movement and choice of clothing.

BRIEF SUMMARY

Provided herein are wearable garments that can be used to carry miscellaneous objects. In some embodiments, provided herein is a dual-strapped utility garment (also referred to herein as a strapvest) that advantageously provides storage for carrying tools, devices, and other objects in a way that makes them easily accessible to a wearer, increases storage space, and provides a more ergonomic garment.

Provided herein is a strapvest comprising: a first main strap comprising an exterior face adapted to face outward from a wearer and an interior face opposite the exterior face, wherein the first main strap comprises a shoulder portion adapted to run up over a shoulder of the wearer, a torso portion adapted to run down a front torso of the wearer, a right side portion adapted to run around a right-side body of the wearer, and a back portion adapted to run up a back of the wearer; and a second main strap comprising an exterior face adapted to face outward from the wearer and an interior face opposite the exterior face, wherein the second main strap comprises a shoulder portion adapted to run up over another shoulder of the wearer, a torso portion adapted to run down the front torso of the wearer, a left side portion adapted to run around a left side body of the wearer, and a back portion adapted to run up the back of the wearer.

Also provided herein is a strapvest comprising: a first main strap comprising an exterior face adapted to face outward from a wearer and an interior face opposite the exterior face, wherein the first main strap comprises a shoulder portion adapted to run up over a shoulder of the wearer, and a torso portion adapted to run down a front torso of the wearer; and a second main strap comprising an exterior face adapted to face outward from the wearer and an interior face opposite the exterior face, wherein the second main strap comprises a shoulder portion adapted to run up over another shoulder of the wearer, and a torso portion adapted to run down the front torso of the wearer; wherein the shoulder portion of the first main strap and the shoulder portion of the second main strap are connected.

In some embodiments, the shoulder portion of the first main strap and the shoulder portion of the second main strap are connected by a strap. In some embodiments, the strap connecting the shoulder portion of the first main strap and the shoulder portion of the second main strap passes behind a wearer's neck when the strapvest is worn by the wearer.

In some of any of such embodiments, the strap connecting the shoulder portion of the first main strap and the shoulder portion of the second main strap has a weight of at least 1, 2, 3, 4, 5, 6, 7, 8, 9, 10, 11, 12, 13, 14, or 15 pounds. In some of any of such embodiments, the strap connecting the shoulder portion of the first main strap and the shoulder portion of the second main strap comprises a weighted compartment configured to contain one or more weight elements. In some of any of such embodiments, the strap connecting the shoulder portion of the first main strap and the shoulder portion of the second main strap comprises an attachment mechanism for reversibly connecting one or more weight elements.

In some of any of such embodiments, the strapvest further comprises an adjustable support strap connected to the first main strap and/or the second main strap. In some embodiments, the adjustable support strap comprises a first strap connected to the first main strap and a second strap connected to the second main strap, wherein the first strap and the second strap each comprise a reversible attachment mechanism that is complementary to one another.

In some of any of such embodiments, the first strap is connected to the first main strap at or near the bottom of the torso portion of the first main strap; and the second strap is connected to the second main strap at or near the bottom of the torso portion of the second main strap. In some of any of such embodiments, the first strap is connected to the first main strap within 6 inches, 4 inches, or 2 inches of the bottom of the torso portion of the first main strap; and the second strap is connected to the second main strap within 6 inches, 4 inches, or 2 inches of the bottom of the torso portion of the second main strap.

In some of any of such embodiments, the reversible attachment mechanism is a buckle, a hook and loop closure, a magnet, a snap closure, or any other two-part connecting system. In some of any of such embodiments, the reversible attachment mechanism is a buckle, wherein the first strap comprise a male end of the buckle, and the second strap comprise a female end of the buckle; or the first strap comprise a female end of the buckle, and the second strap comprise a male end of the buckle. In some of any of such embodiments, the reversible attachment mechanism is a hook and loop closure, wherein the first strap comprise a hook-compatible loop of the hook and loop closure, and the second strap comprise loop-compatible hook of the hook and loop closure; or the first strap comprise a loop-compatible hook of the hook and loop closure, and the second strap comprise hook-compatible loop of the hook and loop closure.

In some of any of such embodiments, the first main strap and/or the second main strap comprises a rotatable portion. In some of any of such embodiments, the torso portion of the first main strap and/or the second main strap comprises a rotatable portion. In some of any of such embodiments, at least part of the torso portion of the first main strap and/or the second main strap is comprised within the rotatable portion. In some of any of such embodiments, the rotatable portion is situated between the shoulder portion and the right side portion of the first main strap; and/or the rotatable portion is situated between the shoulder portion and the left side portion of the second main strap. In some of any of such embodiments, the rotatable portion is connected to the first main strap and/or the second main strap at a first juncture at a first end of the rotatable portion and at a second juncture at a second end of the rotatable portion opposite the first end optionally wherein the first end of the rotatable portion connects to the shoulder portion of the first main strap and/or the second main strap, and the second end of the rotatable portion connects to the right side portion of the first main strap and/or the second end of the rotatable portion connects to the left side portion of the second main strap In some of any of such embodiments, the rotatable portion comprises a first connecting feature at the first juncture and a second connecting feature at the second juncture. In some of any of such embodiments, the first connecting feature and/or the second connecting feature is selected from the group consisting of a rotatable pin, a retractable pin, a spring-loaded pin, a zipper, a magnet, a buckle, a hook and loop closure, a snap closure, slider clips, two-part release clips, or a ball and socket attachment.

In some of any of such embodiments, the rotatable portion is not detachable from the first main strap and/or the second main strap. In some of any of such embodiments, the rotatable portion is reversibly detachable from the first main strap and/or the second main strap.

In some of any of such embodiments, the rotatable portion comprises one or more compartments. In some of any of such embodiments, the rotatable portion comprises an interior side facing inward and an exterior side facing outward, and wherein the interior side of the rotatable portion comprises one or more compartments and/or the exterior side of the rotatable portion comprises one or more compartments. In some of any of such embodiments, the interior side of the rotatable portion comprises one or more compartments and the exterior side of the rotatable portion comprises one or more compartments. In some of any of such embodiments, the rotatable portion is rotatably connected to the first main strap and/or the second main strap such that the exterior side can be rotated to face inward and the interior side can be rotated to face outward. In some of any of such embodiments, the rotatable portion is rotatable at the first juncture and the second juncture such that the exterior side of the rotatable portion can be rotated to face inward and the interior side of the rotatable portion can be rotated to face outward.

In some of any of such embodiments, the first main strap comprises an adjustable and/or reversible closure that reversibly connects an upper part of the torso portion of the first main strap to a lower portion of the torso portion of the first main strap; and/or the second main strap comprises an adjustable and/or reversible closure that reversibly connects an upper part of the torso portion of the second main strap to a lower portion of the torso portion of the second main strap.

In some of any of such embodiments, the rotatable portion comprises one or more compartments. In some embodiments, the one or more compartments comprise a pocket. In some embodiments, the pocket is a sealable pocket. In some embodiments, the sealable pocket is sealable by a zipper or a hook and loop closure. In some of any of such embodiments, the sealable pocket is sealable by a zipper.

In some of any of such embodiments, the pocket is a protruding pocket. In some of any of such embodiments, the protruding pocket is irreversibly or permanently connected to the rotatable portion, on one side of the protruding pocket, and is reversibly connected to the rotatable portion, on another side of the protruding pocket by a closing feature. In some of any of such embodiments, the protruding pocket comprises a closing feature and is configured to protrude outward from the rotatable portion upon releasing the closing feature. In some of any of such embodiments, the protruding pocket is configured to protrude outward in a vertical direction. In some of any of such embodiments, the protruding pocket is configured to protrude outward in a horizontal direction. In some of any of such embodiments, the closing feature is selected from the group consisting of a zipper, a magnet, a buckle, a hook and loop closure, a snap closure, a rotatable pin, a retractable pin, a spring-loaded pin, slider clips, or two-part release clips, or a combination thereof. In some of any of such embodiments, the closing feature is a hook and loop closure. In some of any of such embodiments, the closing feature is a magnet. In some of any of such embodiments, the pocket is irreversibly or permanently connected to the rotatable portion.

In some of any of such embodiments, the one or more compartments comprise one or more detachable compartments. In some of any of such embodiments, the one or more compartments comprise one or more non-detachable compartments. In some of any of such embodiments, the one or more compartments comprise one or more detachable compartments and one or more non-detachable compartments. In some of any of such embodiments, the one or more detachable compartments is reversibly attached to the rotatable portion by a reversible attachment mechanism selected from the group consisting of a zipper, a magnet, a buckle, a hook and loop closure, a snap closure, slider clips, or two-part release clips, or a combination thereof. In some of any of such embodiments, the one or more detachable compartments comprise a detachable pocket. In some of any of such embodiments, the rotatable portion comprises a first edge extending between the first end and the second end, and a second edge extending between the first end and the second end opposite the first edge, wherein the first edge and the second edge are parallel.

In some of any of such embodiments, the rotatable portion is rotatable about an axis between or connecting the first juncture and the second juncture. In some of any of such embodiments, the rotatable portion is symmetrical across the axis such that the shape of the first main strap and/or the second main strap is not changed or is not substantially changed by a rotation of the rotatable portion. In some of any of such embodiments, the rotation is a 180 degree rotation. In some of any of such embodiments, the rotatable portion is rotatable without disconnecting or detaching the rotatable portion from the first main strap and/or the second main strap. In some of any of such embodiments, the rotatable portion is rotatable by disconnecting or detaching the rotatable portion from the first main strap and/or the second main strap and re-connecting or re-attaching the rotatable portion in a rotated configuration. In some of any of such embodiments, the rotated configuration is or is about a 180 degree rotation along its axis.

In some of any of such embodiments, the first main strap and/or the second main strap comprises one or more compartments, and wherein the rotatable portion comprises at least one of the one or more compartments on the interior side and/or comprises at least one of the one or more compartments on the exterior side. In some of any of such embodiments, the first main strap and/or the second main strap comprises one or more compartments, and wherein the rotatable portion comprises at least one of the one or more compartments on the interior side and comprises at least one of the one or more compartments on the exterior side.

In some of any of such embodiments, the first main strap and/or the second main strap further comprises one or more compartments. In some embodiments, the one or more compartments of the first main strap and/or the second main strap comprise one or more detachable compartments. In some of any of such embodiments, the one or more compartments of the first main strap and/or the second main strap comprise one or more non-detachable compartments. In some of any of such embodiments, the one or more compartments comprise one or more detachable compartments and one or more non-detachable compartments. In some of any of such embodiments, the one or more detachable compartments is reversibly attached to the first main strap and/or the second main strap by a reversible attachment mechanism selected from the group consisting of a zipper, a magnet, a buckle, a hook and loop closure, a snap closure, slider clips, or two-part release clips, or a combination thereof.

In some of any of such embodiments, the one or more compartments of the first main strap and/or the second main strap comprise a pocket. In some embodiments, the pocket is a sealable pocket. In some embodiments, the sealable pocket is sealable by a zipper or a hook and loop closure. In some embodiments, the sealable pocket is sealable by a zipper.

In some of any of such embodiments, the pocket is a protruding pocket. In some embodiments, the protruding pocket is comprised on the torso portion (e.g., is comprised on a portion over a shoulder area, waist area, lower stomach area, or back area of the torso portion) of the first main strap and/or the second main strap. In some of any of such embodiments, the protruding pocket is comprised on the right side portion of the first main strap and/or the left side portion of the second main strap. In some of any of such embodiments, the protruding pocket is irreversibly or permanently connected to the first main strap and/or the second main strap, on one side of the protruding pocket, and is reversibly connected to the first main strap and/or the second main strap, on another side of the protruding pocket by a closing feature. In some of any of such embodiments, the protruding pocket comprises a closing feature and is configured to protrude outward from the first main strap and/or the second main strap upon releasing the closing feature. In some of any of such embodiments, the protruding pocket is configured to protrude outward in a vertical direction. In some of any of such embodiments, the protruding pocket is configured to protrude outward in a horizontal direction. In some of any of such embodiments, the closing feature is selected from the group consisting of a zipper, a magnet, a buckle, a hook and loop closure, a snap closure, a rotatable pin, a retractable pin, a spring-loaded pin, slider clips, or two-part release clips, or a combination thereof. In some of any of such embodiments, the closing feature is a hook and loop closure. In some of any of such embodiments, the pocket is irreversibly or permanently connected to the first main strap and/or the second main strap.

In some of any of such embodiments, the one or more detachable compartments comprise a detachable pocket. In some of any of such embodiments, the one or more non-detachable compartments comprise a non-detachable pocket. In some embodiments, the non-detachable pocket is a protruding pocket. In some of any of such embodiments, the protruding pocket is reversibly connected to the interior face of the first main strap and/or the second main strap.

In some of any of such embodiments, the one or more compartments of the first main strap and/or the second main strap comprises at least one compartment on the torso portion of the first main strap and/or the second main strap. In some of any of such embodiments, the one or more compartments of the first main strap and/or the second main strap comprises at least one compartment on the left side portion of the second main strap and/or the right side portion of the first main strap. In some of any of such embodiments, the one or more compartments of the first main strap and/or the second main strap comprises at least one compartment on the shoulder portion of the first main strap and/or the second main strap. In some of any of such embodiments, the one or more compartments of the first main strap and/or the second main strap comprises at least one compartment on the torso portion, at least one compartment on the left side portion, at least one compartment on the right side portion.

In some of any of such embodiments, the one or more compartments of the rotatable portion comprises at least one compartment on an exterior side of one or more of the torso portion, the right side portion, the shoulder portion, and/or the back portion of the first main strap; and at least one compartment on an interior side of one or more of the torso portion, the left side portion, the shoulder portion, and/or the back portion of the second main strap. In some of any of such embodiments, the one or more compartments of the rotatable portion and/or the one or more further compartments of the first main strap and/or the second main strap comprises a compartment comprising an interior.

In some of any of such embodiments, the one or more compartments of the rotatable portion and/or the one or more further compartments of the first main strap and/or the second main strap comprises a compartment comprising a compressible foam material within the interior of the compartment. In some of any of such embodiments, the compressible foam material is located on one or more of an upper portion, a lower portion, an internal portion, or a side portion within the interior of the compartment. In some of any of such embodiments, the compressible foam material fills at least 25%, at least 50%, or at least 75% of the volume of the interior of the compartment. In some of any of such embodiments, the compressible foam material fills at least 25%, at least 50%, or at least 75%, and up to 100% of the volume of the interior of the compartment. In some of any of such embodiments, the compressible foam material is a compressible foam insert shaped to fill at least a portion of the interior of the compartment. In some of any of such embodiments, the compressible foam insert fills at least 25%, at least 50%, or at least 75% of the volume of the interior of the compartment. In some of any of such embodiments, the compressible foam insert fills at least 25%, at least 50%, or at least 75%, and up to 100% of the volume of the interior of the compartment.

In some of any of such embodiments, the first main strap and/or the second main strap comprises a first fabric layer, and at least one of the one or more compartments comprises a second fabric layer that is connected to the first fabric layer, wherein the interior of the compartment is situated between the first fabric layer and the second fabric layer. In some embodiments, at least one of the first fabric layer or the second fabric layer comprises a compressible foam material adapted to secure items within the at least one compartment comprising the second fabric layer.

In some of any of such embodiments, at least one of the one or more compartments of the rotatable portion is accessible from an upper opening and/or a side opening. In some of any of such embodiments, at least one of the one or more compartments of the first main strap and/or the second main strap is accessible from an upper opening and/or a side opening.

In some of any of such embodiments, the strapvest further comprises one or more detachable compartments removably attached to the first main strap and/or the second main strap. In some embodiments, the one or more detachable compartments comprises at least one detachable compartment on the torso portion of the first main strap and/or the second main strap. In some of any of such embodiments, the one or more detachable compartments comprises at least one detachable compartment on the left side portion of the second main strap and/or the right side portion of the first main strap. In some of any of such embodiments, the one or more detachable compartments comprises at least one detachable compartment on the shoulder portion of the first main strap and/or the second main strap. In some of any of such embodiments, the one or more detachable compartments is removably attached by at least one of a zipper, a magnet, a buckle, a hook and loop closure, a snap closure, a rotatable pin, a retractable pin, a spring-loaded pin, slider clips, or two-part release clips, or a combination thereof.

In some of any of such embodiments, the first main strap and/or the second main strap comprises an upper release mechanism removably attached to an upper portion of the detachable compartment and a lower release mechanism removably attachable to a lower portion of the detachable compartment, and wherein the one or more detachable compartments are removably attachable to the first main strap and/or the second main strap by the upper release mechanism and the lower release mechanism. In some of any of such embodiments, the first main strap and/or the second main strap comprises an upper release mechanism removably attachable to an upper portion of the detachable compartment and/or a lower release mechanism removably attachable to a lower portion of the detachable compartment, and wherein the one or more detachable compartments are removably attachable to the first main strap and/or the second main strap by the upper release mechanism and/or the lower release mechanism. In some of any of such embodiments, the first main strap and/or the second main strap comprises one or more strap-side attachment mechanisms, and the one or more detachable compartments comprise one or more compartment-side attachment mechanisms. In some of any of such embodiments, each of the one or more strap-side attachment mechanisms is adapted to reversibly attach to one or more of the compartment-side attachment mechanisms.

In some of any of such embodiments: (i) the one or more strap-side attachment mechanisms is a hook-compatible loop closure, and the one or more compartment-side attachment mechanisms is a loop-compatible hook closure; or (ii) the one or more strap-side attachment mechanisms is a loop-compatible hook closure, and the one or more compartment-side attachment mechanisms is a hook-compatible loop closure; or (iii) the one or more strap-side attachment mechanisms is a stud-compatible socket, and the one or more compartment-side attachment mechanisms is a socket-compatible stud; or (iv) the one or more strap-side attachment mechanisms is a buckle, and the one or more compartment-side attachment mechanisms is a buckle-compatible strap; or (v) the one or more strap-side attachment mechanisms is a buckle-compatible strap, and the one or more compartment-side attachment mechanisms is a buckle; or (iv) the one or more strap-side attachment mechanisms is a buckle comprising a male end, and the one or more compartment-side attachment mechanisms is a buckle comprising a female end; or (v) the one or more strap-side attachment mechanisms is a buckle comprising a female end, and the one or more compartment-side attachment mechanisms is a buckle comprising a male end.

In some of any of such embodiments, the one or more detachable compartments are removably attached to the torso portion of the first main strap and/or the second main strap. In some of any of such embodiments, one or more of the detachable compartments are removably attached to the right side portion of the first main strap; and/or one or more of the detachable compartments are removably attached to the left side portion of the second main strap.

In some of any of such embodiments, the one or more detachable compartments comprises a sliding compartment. In some embodiments, the sliding compartment comprises a pair of rail inserts that are parallel to one another. In some of any of such embodiments, the first main strap and/or the second main strap comprises a pair of rail tracks that are parallel to one another and adapted to receive the pair of rail inserts of the sliding compartment.

In some of any of such embodiments, the first main strap and the second main strap are releasably connected by a closure. In some embodiments, the closure is or comprises a zipper. In some embodiments, the closure is a single-point closure. In some embodiments, the single-point closure comprises a button, a buckle, a hook and loop closure, a snap, or a stud-type closure on the first main strap, and a complementary connecting feature on the second main strap. In some of any of such embodiments, the single-point closure releasably connects the first main strap to the second main strap at a single point. In some of any of such embodiments, the single-point closure comprises: (i) a hook-compatible loop closure on the first main strap, and a loop-compatible hook closure on the second main strap; or (ii) a loop-compatible hook closure on the first main strap, and a hook-compatible loop closure on the second main strap; or (iii) a stud-compatible socket on the first main strap, and a socket-compatible stud on the second main strap; or (iv) a socket-compatible stud on the first main strap, and a stud-compatible socket on the second main strap; or (v) a buckle on the first main strap, and a buckle-compatible strap on the second main strap; or (vi) a buckle-compatible strap on the first main strap, and a buckle on the second main strap; or (vii) a buckle comprising a male end on the first main strap, and a buckle comprising a female end on the second main strap; or (viii) a buckle comprising a female end on the first main strap, and a buckle comprising a male end on the second main strap.

In some of any of such embodiments, the single-point closure comprises a first connector on the first main strap and a second connector on the second main strap, wherein the first connector and the second connector are adapted to releasably connect with one another. In some embodiments, the first connector is connected to the torso portion of the first main strap, and the second connector is connected to the torso portion of the second main strap. In some of any of such embodiments, the single-point closure is positioned over a sternum of the wearer or within 1 inch, two inches, three inches, four inches, five inches, or six inches below the bottom of a sternum of a wearer when the strapvest is worn by the wearer. In some of any of such embodiments, the single-point closure is positioned over the abdomen of a wearer when the strapvest is worn by the wearer.

In some of any of such embodiments, the first connector is connected to the right side portion of the first main strap, and the second connector is connected to the left side portion of the second main strap.

In some of any of such embodiments, the single-point closure is connected to the first main strap and/or the second main strap by a stabilizing belt. In some embodiments, the stabilizing belt is extendible and/or adjustable.

In some of any of such embodiments, the first main strap and the second main strap are releasably connected by a closure comprising a zipper. In some embodiments, the closure comprising a zipper releasably connects the first main strap and the second main strap across at least a portion of the torso portion of the first main strap and the second main strap.

In some of any of such embodiments, the strapvest further comprises one or more holster bands connected to the first main strap and/or the second main strap at a first end and a second end of each of the one or more holster bands. In some embodiments: a holster band of the one or more holster bands is connected to the first main strap at a first end of the holster band and at a second end of the holster band, wherein the first end and the second end of the holster band are located on opposite ends of the holster band; and/or a holster band of the one or more holster bands is connected to the second main strap at a first end of the holster band and at a second end of the holster band, wherein the first end and the second end of the holster band are located on opposite ends of the holster band. In some of any of such embodiments, at least one of the one or more holster bands is adapted to secure a tool to the strapvest. In some of any of such embodiments, at least one of the one or more holster bands is connected to the right side portion; and/or at least one of the one or more holster bands is connected to the left side portion.

In some of any of such embodiments, the strapvest further comprises a stabilizing belt comprising a first end and a second end, wherein the first end of the stabilizing belt is connected, e.g., horizontally connected, to the back portion of the first main strap and/or the second end of the stabilizing belt is connected, e.g., horizontally connected, to the back portion of the second main strap. In some embodiments, the first end of the stabilizing belt is reversibly connected to the back portion of the first main strap and/or the second end of the stabilizing belt is reversibly connected to the back portion of the second main strap. In some embodiments: (i) the first end of the stabilizing belt is irreversibly connected to the back portion of the first main strap and the second end of the stabilizing belt is reversibly connected to the back portion of the second main strap; or (ii) the first end of the stabilizing belt is reversibly connected to the back portion of the first main strap and the second end of the stabilizing belt is irreversibly connected to the back portion of the second main strap; or (iii) the first end of the stabilizing belt is irreversibly connected to the back portion of the first main strap and the second end of the stabilizing belt is irreversibly connected to the back portion of the second main strap.

In some of any of such embodiments: the first end of the stabilizing belt is connected to the back portion of the first main strap at a position that is less than or less than about 10, 9, 8, 7, 6, 5, 4, 3, 2, or 1 inch from the top of the shoulder portion of the first main strap; and/or the second end of the stabilizing belt is connected to the back portion of the second main strap at a position that is less than or less than about 10, 9, 8, 7, 6, 5, 4, 3, 2, or 1 inch from the top of the shoulder portion of the second main strap. In some of any of such embodiments: the first end of the stabilizing belt is connected to the back portion of the first main strap at a position that is between or between about 2 and 6 inches from the top of the shoulder portion of the first main strap; and/or the second end of the stabilizing belt is connected to the back portion of the second main strap at a position that is between or between about 2 and 6 inches from the top of the shoulder portion of the second main strap. In some of any of such embodiments, the length of the stabilizing belt from the first end to the second end is adjustable and/or extendible. In some of any of such embodiments involving a horizontal connection, the length of the stabilizing belt from the first end to the second end is adjustable and/or extendible.

In some of any of such embodiments, the torso portion and the right side portion of the first main strap forms a J-shape, a semi-J shape, and the torso portion and the left side portion of the second main strap forms a reverse J-shape, e.g., an L-shape or a semi-L-shape.

In some of any of such embodiments, the first main strap comprises a right side portion adapted to run around a right side body of the wearer, and a back portion adapted to run up a back of the wearer; and the second main strap comprises a left side portion adapted to run around a left side body of the wearer, and a back portion adapted to run up the back of the wearer.

DESCRIPTION OF THE FIGURES

FIG. 3A depicts an exemplary strapvest that is white with black trim. FIG. 3B depicts an exemplary strapvest that is black and includes a single-point closure located at a juncture between the straps, and includes a rail track depicted by substantially vertical white lines for reversibly sliding a sliding compartment into.

FIG. 7A depicts the front face of the exemplary detachable compartments, and FIG. 7B depicts a view from the top of two exemplary detachable compartments and a view from the back side of a third exemplary detachable compartment. The exemplary detachable compartments of FIGS. 7A and 7B include buckles as an exemplary attachment mechanism for removable attachment, which can optionally be reversible.

FIG. 10A and FIG. 10B depict an exemplary strapvest where the shoulder portion of the first main strap and the shoulder portion of the second main strap are connected and the torso portion of the first main strap and the second main strap are releasably connected by a closure that is a zipper that can be closed (FIG. 10A) or opened (FIG. 10B). FIG. 10C depicts a part of the torso portion of a first main strap and a second main strap that are releasably connected by a closure that is a zipper. FIGS. 10A-10C include compartments that are sealable pockets that can be reversibly opened using a zipper, and also include a stabilizing belt. The zipper of the sealable pockets runs along a portion of the first main strap and the second main strap of the strapvest as a means for reversibly sealing each pocket.

In FIGS. 11A-11C, the exemplary detachable compartments include a strap that contains a snap closure for reversible attaching to a buckle that is connected to the strapvest, e.g., a first main strap and/or a second main strap of the strapvest. The snap closure includes a male connecting feature and a female connecting feature, which connect to one another to secure the exemplary detachable compartments to the strapvest, e.g., to a buckle connected to the strapvest, such as depicted in FIGS. 11A-11C.

DETAILED DESCRIPTION

Figure 1B:
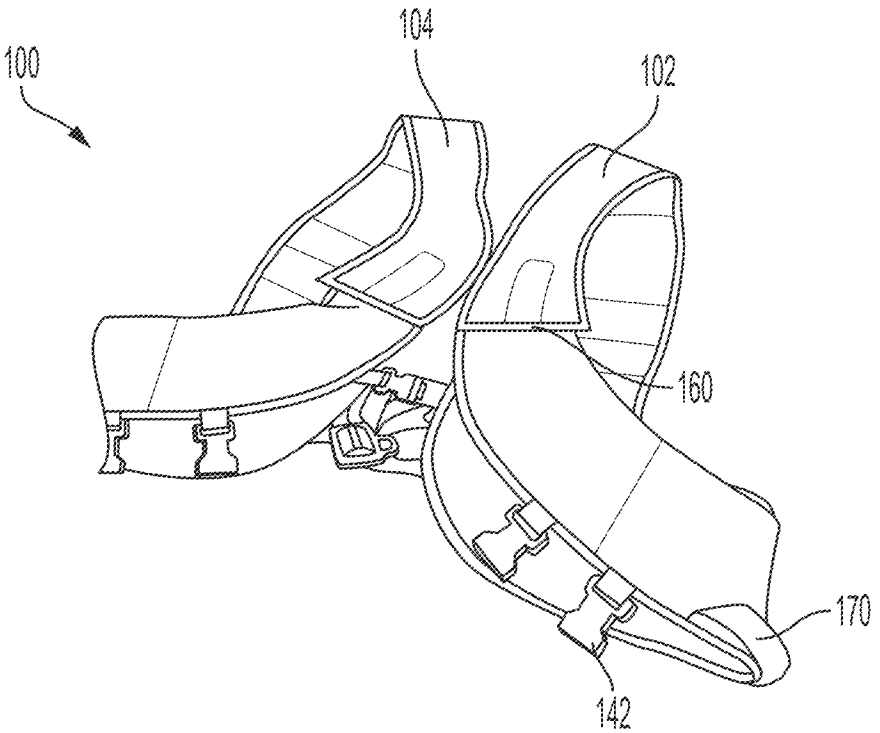
FIG. 1B depicts the exemplary strapvest of FIG. 1A viewed from a back side perspective.

Provided herein are dual-strapped utility garments (also referred to herein as strapvests) comprising various compartments, e.g., compressible and/or collapsible compartments, for conveniently and securely storing various tools, devices, and other important objects, such that they are easily accessible to a wearer of the strapvest.

Provided herein is a strapvest comprising: a first main strap comprising an exterior face adapted to face outward from a wearer and an interior face opposite the exterior face, wherein the first main strap comprises a shoulder portion adapted to run up over a shoulder of the wearer, a torso portion adapted to run down a front torso of the wearer, a right side portion adapted to run around a right-side body of the wearer, and a back portion adapted to run up a back of the wearer; and a second main strap comprising an exterior face adapted to face outward from the wearer and an interior face opposite the exterior face, wherein the second main strap comprises a shoulder portion adapted to run up over another shoulder of the wearer, a torso portion adapted to run down the front torso of the wearer, a left side portion adapted to run around a left side body of the wearer, and a back portion adapted to run up the back of the wearer. In some embodiments, the first main strap and/or the second main strap comprises a rotatable portion, such as any of the rotatable portions described herein. In some embodiments, the torso portion of the first main strap and/or the second main strap comprises a rotatable portion.

Also provided herein, in some embodiments, is a strapvest comprising: a first main strap comprising an exterior face adapted to face outward from a wearer and an interior face opposite the exterior face, wherein the first main strap comprises a shoulder portion adapted to run up over a shoulder of the wearer, and a torso portion adapted to run down a front torso of the wearer; and a second main strap comprising an exterior face adapted to face outward from the wearer and an interior face opposite the exterior face, wherein the second main strap comprises a shoulder portion adapted to run up over another shoulder of the wearer, and a torso portion adapted to run down the front torso of the wearer; wherein the shoulder portion of the first main strap and the shoulder portion of the second main strap are connected.

Also provided herein, in some embodiments, is a strapvest comprising: a first main strap comprising an exterior face and an interior face opposite the exterior face, wherein the first main strap comprises a shoulder portion, a torso portion, a right side portion, and a back portion, wherein the shoulder portion of the first main strap connects the torso portion of the first main strap to the back portion of the first main strap and the back portion of the first main strap connects the shoulder portion of the first main strap to the right side portion of the first main strap; and a second main strap comprising an exterior face and an interior face opposite the exterior face, wherein the second main strap comprises a shoulder portion, a torso portion, a left side portion, and a back portion, wherein the shoulder portion of the second main strap connects the torso portion of the second main strap to the back portion of the second main strap and the back portion of the second main strap connects the shoulder portion of the second main strap to the left side portion of the second main strap.

Also provided herein, in some embodiments, is a strapvest comprising: a first main strap comprising an exterior face and an interior face opposite the exterior face, wherein the first main strap comprises a shoulder portion and a torso portion; and a second main strap comprising an exterior face and an interior face opposite the exterior face, wherein the second main strap comprises a shoulder portion and a torso portion; wherein the shoulder portion of the first main strap and the shoulder portion of the second main strap are connected.

In some embodiments, the compartments are integral to the straps of the strapvest, e.g., formed from one or more fabric layers of the straps; however, in other embodiments, the compartments are modular and/or detachable from the straps by way of one or more removable connectors. In some embodiments, the strapvest is provided with holster bands, e.g., fabric, and other elements for hanging, storing, and/or securing additional tools and other objects to the strapvest. In further embodiments, at least a portion of one or more of the straps is reversible, e.g., through a rotatable portion, to provide access to compartments accessible from both an interior-facing and an exterior-facing side of the strap. The reversibility of the portions of the straps provides a wearer with increased storage space and more versatile storage options for carrying objects in the strapvest.

In some embodiments, the first main strap comprises a right side portion adapted to run around a right side body of the wearer; and the second main strap comprises a left side portion adapted to run around a left side body of the wearer. In some embodiments, the first main strap comprises a right side portion adapted to run around a right side body of the wearer, and a back portion adapted to run up a back of the wearer; and the second main strap comprises a left side portion adapted to run around a left side body of the wearer, and a back portion adapted to run up the back of the wearer. In some embodiments, the back side portion of the first main strap and/or the second main strap is or comprises a strap. In some embodiments, the right side portion of the first main strap is connected to the shoulder portion of the first main strap. In some embodiments, the left side portion of the second main strap is connected to the shoulder portion of the second main strap. In some embodiments, the right side portion of the first main strap is connected to the shoulder portion of the first main strap, and the left side portion of the second main strap is connected to the shoulder portion of the second main strap. In some embodiments, the right side portion of the first main strap is connected to the back portion of the first main strap. In some embodiments, the left side portion of the second main strap is connected to the back portion of the second main strap. In some embodiments, the right side portion of the first main strap is connected to the back portion of the first main strap, and the left side portion of the second main strap is connected to the back portion of the second main strap. In some embodiments, the right side portion of the first main strap is connected to the back portion of the first main strap, and the back portion of the first main strap is connected to the shoulder portion of the first main strap. In some embodiments, the left side portion of the second main strap is connected to the back portion of the second main strap, and the back portion of the second main strap is connected to the shoulder portion of the second main strap. In some embodiments, the right side portion of the first main strap is connected to the back portion of the first main strap, and the back portion of the first main strap is connected to the shoulder portion of the first main strap; and the left side portion of the second main strap is connected to the back portion of the second main strap, and the back portion of the second main strap is connected to the shoulder portion of the second main strap. In some of any of such embodiments, the connection can be by any connecting means, such as a strap and/or webbing.

Figure 1A:
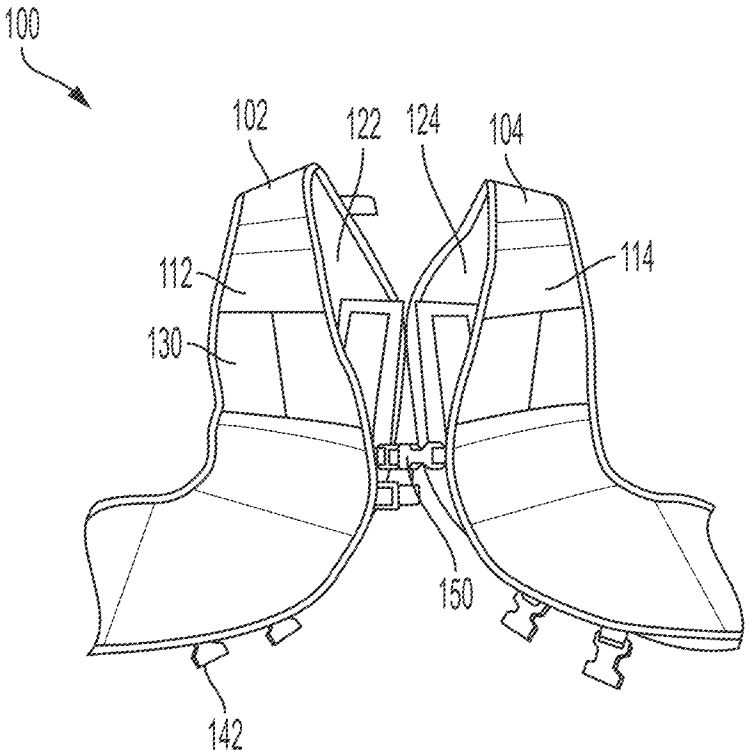
FIG. 1A depicts an exemplary strapvest viewed from a front side perspective.

FIGS. 1A-1B illustrate an exemplary strapvest 100. The strapvest 100 is shaped to be worn around the torso of a wearer, and includes apertures through which a user can insert their arms, waist, and head while wearing the strapvest. In some embodiments, the strapvest comprises two or more straps (depicted as 102 and 104 in FIG. 1A) that can be connected to form an X-shaped or semi-X-shaped garment over the wearer's back and/or front torso.

In some embodiments, the strapvest is removable by actuating one or more closures, such as a single point closure 150 and/or an adjustable and/or reversible closure 160. In some embodiments, the strapvest is removable by actuating a single-point closure 150 located at a juncture between the first main strap and the second main strap, or alternatively by actuating reversible closures 160 located on one or more of the first and second main straps of the vest. The adjustable and/or reversible closure 160, such as depicted in FIG. 1B, is a closure that is reversible in that it can reversibly connect a part of the first main strap with another part of the first main strap, and/or can reversibly connect a part of the second main strap with another part of the second main strap, thereby allowing a wearer to secure the strapvest to the wearer, and/or is adjustable in that it also adjusts the first and second main straps based on, e.g., the wearer's size, weight, height, comfort, intended activity, etc. Accordingly, in some embodiments, the first main strap comprises an adjustable and/or reversible closure that reversibly connects an upper part of the torso portion of the first main strap to a lower portion of the torso portion of the first main strap; and/or the second main strap comprises an adjustable and/or reversible closure that reversibly connects an upper part of the torso portion of the second main strap to a lower portion of the torso portion of the second main strap.

Further, in some embodiments, the strapvest comprises one or more closures, e.g., a single point closure 150. As shown in FIG. 1A, for instance, a single point closure provides a way to connect the two straps (first main strap and the second main strap), and also provides a way to adjust the strapvest, e.g., based on the torso size of the wearer, such as when the single point closure is connected to a stabilizing belt.

As seen in FIGS. 1A-1B, an exemplary strapvest 100 comprises a first main strap 102 (e.g., a right-side strap when worn by a wearer), the strap being adapted to run up over the front of a shoulder of a wearer, down a front torso of a wearer, around a right-side body of the wearer, and up a back of the wearer. In such an example, the strapvest 100 further comprises a second main strap 104 (e.g., a left-side strap when worn by the wearer), the strap being adapted to run up over the front of a shoulder of a wearer, down a front torso of a wearer, around a left side body of the wearer, and up a back of the wearer. In some embodiments, the first main strap 102 comprises an exterior face 112 adapted to face outward from a wearer (i.e., away from the wearer's body) when the strapvest 100 is worn. In some embodiments, the first main strap 102 further comprises an interior face 122 opposite the exterior face 112, the interior face 122 adapted to face inward (i.e., toward the wearer's body) when the strapvest 100 is worn. In some embodiments, the second main strap 104 also comprises an exterior face 114 adapted to face outward from a wearer, and an interior face 124 opposite the exterior face that faces toward a wearer's body when the strapvest 100 is worn.

In some embodiments, the first and second main straps (102 and 104, respectively) of the strapvest 100 are worn in an x-shaped or semi-x-shaped configuration on the wearer's body, such that each of the first main strap 102 and the second main strap 104 are each adapted to run up and over the wearer's backside joining together on the wearer's front side, optionally through a single point closure, and continuing on their respective sides. In such a configuration, the straps 102 and 104 do not overlap or cross at the back and front torso of the wearer, and may be optionally connected together at the front juncture and/or the back juncture portions of the straps, such as with a single-point closure 150. In some embodiments, the first main strap and the second main strap are connected together at both the front junction and the back juncture, such as depicted in FIGS. 4A and 4B. In other words, the first main strap 102 is adapted to run over a left shoulder of the wearer, down a front torso of the wearer, around a left side body of the wearer, and up and across a back of the wearer; and the second main strap 104 is adapted to run over a right shoulder of the wearer, down and across a front torso of the wearer, around a right side body of the wearer, and up and across a back of the wearer.

In some embodiments, and as shown in FIGS. 1A-1B, the first main strap 102 and the second main strap 104 are configured as a respective right-side strap and a left-side strap that are worn around a right and left shoulder and/or side of the wearer. In other words, in some embodiments, the first main strap 102 is adapted to run over a right shoulder of the wearer, down a front torso of the wearer, around a right-side body of the wearer, and up a back of the wearer; and the second main strap 104 is adapted to run over a left shoulder of the wearer, down a front torso of the wearer, around a left side body of the wearer, and up a back of the wearer. In such a configuration, the first main strap 102 and the second main strap 104 need not cross or overlap, but, in some embodiments, cross or overlap proximate to a wearer's back and/or front torso when the strapvest is worn. In such embodiments, the first main strap and the second main strap can be connected together with a single point closure 150, such as depicted in FIG. 1A. Accordingly, in some embodiments, the x-shaped configuration does not involve the first and second main straps to cross over one another, but rather to come in proximity to one another, e.g., near the single-point closure 150, thereby resulting in a configuration resembling an "x" or semi-"x" shape even if there is no overlap of the first and second main straps.

The first main strap 102 and the second main strap 104 are optionally joined together at the wearer's front and/or back torso and/or back, e.g., adjustably and/or reversibly connected at a closure, e.g., a single-point closure 150 or some other connecting means, such that the right-side and left-side straps form an x-shaped garment when joined together. As used herein, "x-shaped" is used to describe configurations where the straps 102 and 104 overlap and cross (forming an "X" shape or "semi-X" shape on the wearer's body), as well as configurations where the straps abut or are worn closely together but do not overlap or cross (forming an approximate") ("shape over the wearer's body), such as depicted in FIG. 1A. In some embodiments, the X shape or semi-X shape formed by the right side strap and the left side strap can be formed using any angle of intersect or near intersect, such as an angle reflecting a traditional X-shape or angles reflecting a heightened or shortened X-shape, i.e., a semi-X shape. In some embodiments, the first and second main straps overlap and/or abut over the wearer's front torso, but not the wearer's back. In other embodiments, the main straps overlap and/or abut over the wearer's back, but not the wearer's front torso.

Figure 10C:
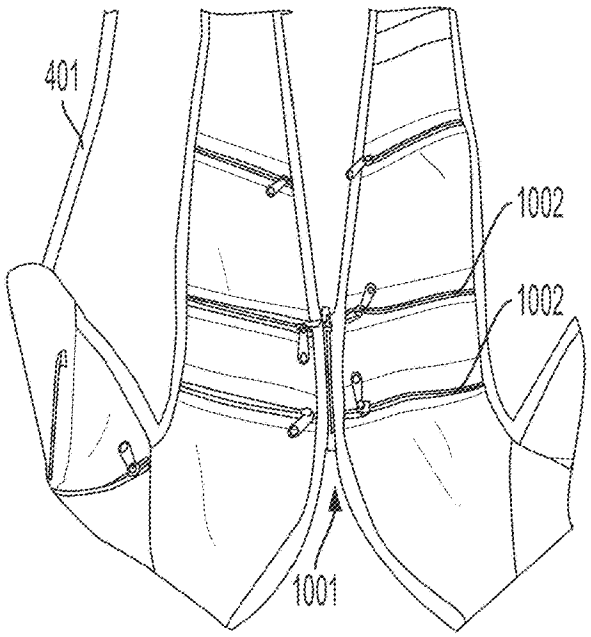
FIGS. 10A-10C depict features of an exemplary strapvest.
Figure 10B:
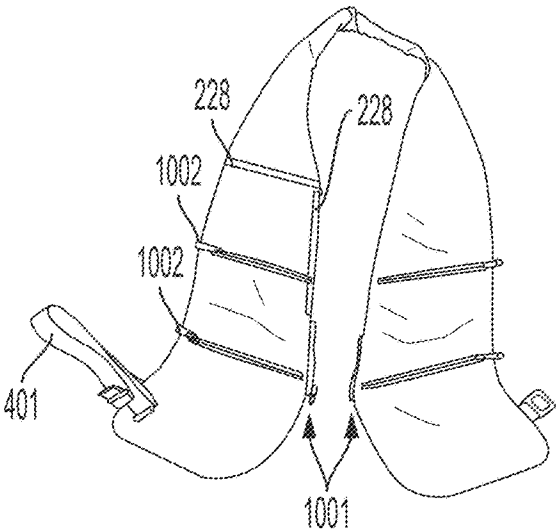
Figure 10A:
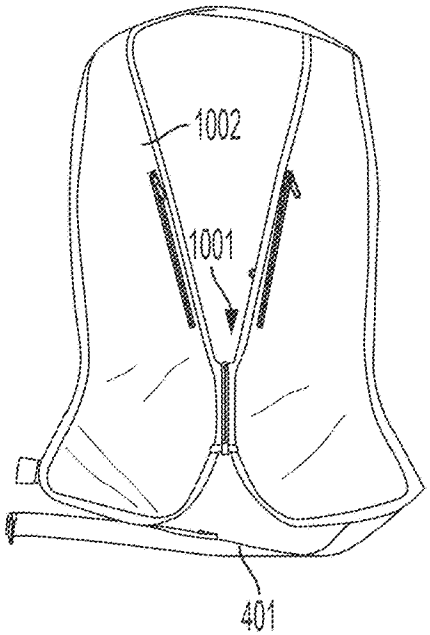

In some embodiments, the shoulder portion of the first main strap and the shoulder portion of the second main strap are connected, such as depicted in FIGS. 10A-10C. In such an embodiment, the first main strap and the second main strap do not comprise a back portion that runs up the back of the wearer. In some embodiments, the shoulder portion of the first main strap and the shoulder portion of the second main strap are connected by a strap, such as depicted in FIGS. 10A-10C. In some embodiments, the strap connecting the shoulder portion of the first main strap and the shoulder portion of the second main strap passes behind a wearer's neck. In some embodiments, the strap connecting the shoulder portion of the first main strap and the shoulder portion of the second main strap passes behind a wearer's neck when the strapvest is worn by the wearer.

In some embodiments, the strap connecting the shoulder portion of the first main strap and the shoulder portion of the second main strap is weighted such that when a wearer includes one or more tools or other objects in one or more compartments of the strapvest, the strap connecting the shoulder portion of the first main strap and the shoulder portion of the second main strap counterbalances the weight of the one or more tools or other objects, thereby improving comfort for the wearer by reducing tension between the strap connecting the shoulder portion of the first main strap and the shoulder portion of the second main strap and the wearer's neck.

In some embodiments, the strap connecting the shoulder portion of the first main strap and the shoulder portion of the second main strap has a weight of or of at least 1, 2, 3, 4, 5, 6, 7, 8, 9, 10, 11, 12, 13, 14, or 15 pounds, or a value between any of the foregoing. In some embodiments, the strap connecting the shoulder portion of the first main strap and the shoulder portion of the second main strap has a weight of about 1, 2, 3, 4, 5, 6, 7, 8, 9, 10, 11, 12, 13, 14, or 15 pounds, or a value between any of the foregoing. In some embodiments, the strap connecting the shoulder portion of the first main strap and the shoulder portion of the second main strap has a weight of at least 1, 2, 3, 4, 5, 6, 7, 8, 9, 10, 11, 12, 13, 14, or 15 pounds. In some embodiments, the strap connecting the shoulder portion of the first main strap and the shoulder portion of the second main strap has a weight of from or from about 1 to 15 pounds, 1 to 12 pounds, 1 to 10 pounds, 1 to 8 pounds, 1 to 6 pounds, 1 to 5 pounds, 2 to 15 pounds, 2 to 12 pounds, 2 to 10 pounds, 2 to 8 pounds, 2 to 6 pounds, 2 to 5 pounds, 3 to 15 pounds, 3 to 12 pounds, 3 to 10 pounds, 3 to 8 pounds, 3 to 6 pounds, 3 to 5 pounds, 5 to 15 pounds, 5 to 12 pounds, 5 to 10 pounds, 5 to 8 pounds, 5 to 6 pounds, 7 to 15 pounds, 7 to 12 pounds, 7 to 10 pounds, 10 to 15 pounds, or 10 to 12 pounds. In some embodiments, the strap connecting the shoulder portion of the first main strap and the shoulder portion of the second main strap has a weight of at least 5 pounds. In some embodiments, the strap connecting the shoulder portion of the first main strap and the shoulder portion of the second main strap has a weight of at least 7 pounds. In some embodiments, the strap connecting the shoulder portion of the first main strap and the shoulder portion of the second main strap has a weight of at least 10 pounds. In some embodiments, the strap connecting the shoulder portion of the first main strap and the shoulder portion of the second main strap has a weight of at least 12 pounds. In some embodiments, the strap connecting the shoulder portion of the first main strap and the shoulder portion of the second main strap has a weight of at least 15 pounds.

In some embodiments, the strap connecting the shoulder portion of the first main strap and the shoulder portion of the second main strap comprises a weighted compartment configured to contain one or more weight elements. In some embodiments, the weighted compartment is integrated into the strap connecting the shoulder portion of the first main strap and the shoulder portion of the second main strap. For instance, in some embodiments, a wearer can adjust the amount of weight that is included in the weighted compartment based on the amount of weight necessary to counterbalance the weight of one or more tools or other objects that are included in one or more compartments or are otherwise attached to the first main strap and/or the second main strap. In some embodiments, the amount of weight included in the weighted compartment is less than the amount of weight of one or more tools or other objects that are included in one or more compartments or are otherwise attached to the first main strap and/or the second main strap.

In some embodiments, the strap connecting the shoulder portion of the first main strap and the shoulder portion of the second main strap comprises an attachment mechanism for reversibly connecting one or more weight elements. For instance, in some embodiments, a wearer can adjust the amount of weight that is attached to the strap via the attachment mechanism based on the amount of weight necessary to counterbalance the weight of one or more tools or other objects that are included in one or more compartments or are otherwise attached to the first main strap and/or the second main strap. In some embodiments, the amount of weight that is attached to the strap via the attachment mechanism is less than the amount of weight of one or more tools or other objects that are included in one or more compartments or are otherwise attached to the first main strap and/or the second main strap.

A weight element can be any object that provides a desired weight, such as at, about, at least, or at least about 0.5, 1, 2, 3, 4, 5, 6, 7, 8, 9, 10, 11, 12, 13, 14, or 15 pounds, or a value between any of the foregoing. In some embodiments, the weight element has a weight of from or from about 1 to 15 pounds, 1 to 12 pounds, 1 to 10 pounds, 1 to 8 pounds, 1 to 6 pounds, 1 to 5 pounds, 2 to 15 pounds, 2 to 12 pounds, 2 to 10 pounds, 2 to 8 pounds, 2 to 6 pounds, 2 to 5 pounds, 3 to 15 pounds, 3 to 12 pounds, 3 to 10 pounds, 3 to 8 pounds, 3 to 6 pounds, 3 to 5 pounds, 5 to 15 pounds, 5 to 12 pounds, 5 to 10 pounds, 5 to 8 pounds, 5 to 6 pounds, 7 to 15 pounds, 7 to 12 pounds, 7 to 10 pounds, 10 to 15 pounds, or 10 to 12 pounds. The weight element can, in some embodiments, be made of any material suitable for adding a desired weight. In some embodiments, the weight element is or comprises a metal. In some embodiments, the weight element is or comprises a weighted granular material, such as sand or granular metal. In some embodiments, the weight element is or comprises a rubber or elastomeric material.

In some embodiments, the strapvest further comprises an adjustable support strap connected to the first main strap and/or the second main strap, such as depicted in FIGS. 10A-10C. In some embodiments, the strapvest further comprises an adjustable support strap connecting the first main strap to the second main strap, and optionally comprises a first strap connected to the first main strap and a second strap connected to the second main strap, wherein the first strap and the second strap each comprise a reversible attachment mechanism that is complementary to one another. These adjustable support straps can be made with material such as fabric, or a stiffer material such as plastic, resonated products, or metal that allows for a fixed semi curved shape. When such materials are used, these stiffer materials will be installed with a softer material to protect the body of the wearer. In some embodiments, the adjustable support strap comprises a first strap connected to the first main strap and a second strap connected to the second main strap, wherein the first strap and the second strap each comprise a reversible attachment mechanism that is complementary to one another. In some embodiments, the first strap is connected to the first main strap at or near the bottom of the torso portion of the first main strap; and the second strap is connected to the second main strap at or near the bottom of the torso portion of the second main strap. In some embodiments, the first strap is connected to the first main strap within 6 inches, 4 inches, or 2 inches of the bottom of the torso portion of the first main strap; and the second strap is connected to the second main strap within 6 inches, 4 inches, or 2 inches of the bottom of the torso portion of the second main strap. By connecting the first strap to the first main strap at or near the bottom of the first main strap, and connecting the second strap to the second main strap at or near the bottom of the second main strap, each with complementary reversible attachment mechanisms, the adjustable support strap provides for improved and more secure attachment of the strapvest to the wearer.

In some embodiments, the reversible attachment mechanism is a buckle, a hook and loop closure, a magnet, or a snap closure, or any other two-part connecting system. In some embodiments, the reversible attachment mechanism is a buckle, wherein the first strap comprise a male end of the buckle, and the second strap comprise a female end of the buckle; or the first strap comprise a female end of the buckle, and the second strap comprise a male end of the buckle. In some embodiments, the reversible attachment mechanism is a hook and loop closure, wherein the first strap comprise a hook-compatible loop of the hook and loop closure, and the second strap comprise loop-compatible hook of the hook and loop closure; or the first strap comprise a loop-compatible hook of the hook and loop closure, and the second strap comprise hook-compatible loop of the hook and loop closure.

In some embodiments, the first main strap 102 and second main strap 104 are releasably connected by one or more closures. In some embodiments, the one or more closures comprises one, two, three, or four closures. In some embodiments, the one or more closures comprises a single-point closure. In some embodiments, the one or more closures comprises a dual-point closure or a multiple-point closure. In some embodiments, the one or more closures comprise a reversible closure. The one or more closures can be adapted for releasably connecting the first and second main straps by any reversible attachment mechanism. In some embodiments, the one or more closures each independently comprise one or more of a button, a buckle, a zipper, a hook and loop closure, a magnet, a snap, a zipper, or a stud-type closure, or any other two-part connecting system, or any combination thereof.

In some embodiments, the first main strap 102 and second main strap 104 are releasably connected by a single-point closure 150. In some embodiments, the first main strap and the second main strap are releasably connected by one or two or more single-point closures. In some embodiments, the torso portion of the first main strap is connected to the torso portion of the second main strap. In some embodiments, the torso portion of the first main strap is connected to the torso portion of the second main strap by a closure that provides an adjustable and/or releasable connection, such as depicted in FIG. 1A. In some embodiments, the adjustable and/or releasable connection is an adjustable connection. In some embodiments, the adjustable and/or releasable connection is a releasable connection. In some embodiments, the adjustable and/or releasable connection is an adjustable and releasable connection. In some embodiments, the torso portion of the first main strap is releasably connected to the torso portion of the second main strap by a single-point closure that comprises a releasable connection, such as depicted in FIG. 1A. In some embodiments, the back portion of the first main strap is connected to the back portion of the second main strap. In some embodiments, the back portion of the first main strap is connected to the back portion of the second main strap by a releasable connection. In some embodiments, the back portion of the first main strap is releasably connected to the back portion of the second main strap by a single-point closure that comprises an adjustable and/or releasable connection or any other mechanism as described herein. In some embodiments, the single-point closure comprises any of the releasable connections described herein, e.g., one or more of a button, a buckle, a hook and loop closure, a magnet, a snap, or a stud-type closure, or any other two-part connecting system, or any combination thereof.

In some embodiments, the first main strap and the second main strap are releasably connected by a closure. In some embodiments, the first main strap and the second main strap are releasably connected by a closure comprising a zipper, such as depicted in FIGS. 10A and 10C (connected configuration) and FIG. 10B (released configuration). In some embodiments, the closure comprising a zipper releasably connects the first main strap and the second main strap across at least a portion of the torso portion of the first main strap and the second main strap. In some embodiments, the closure comprising a zipper releasably connects the first main strap and the second main strap across the torso portion of the first main strap and the second main strap. In some embodiments, the closure comprising a zipper releasably connects the first main strap and the second main strap across at least a portion of the torso portion of the first main strap and the second main strap. In some embodiments, the closure comprising a zipper releasably connects the first main strap and the second main strap across at least 15%, 25%, 30%, 40%, 50%, 60%, 70%, 80%, or 90% (or across a range between any two of the foregoing values) of the torso portion of the first main strap and the second main strap. In some embodiments, the closure comprising a zipper releasably connects the first main strap and the second main strap across about 15%, about 20%, about 25%, about 30%, about 35%, about 40%, about 45%, about 50%, about 55%, about 60%, about 65%, about 70%, about 75%, about 80%, about 85%, about 90%, about 95%, or about 100%, or a value between any of the foregoing, of the torso portion of the first main strap and the second main strap. In some embodiments, the closure comprising a zipper releasably connects the first main strap and the second main strap across about 15%, 20%, 25%, 30%, 35%, 40%, 45%, or 50% to about 100%, about 15%, 20%, 25%, 30%, 35%, 40%, 45%, or 50% to about 90%, about 15%, 20%, 25%, 30%, 35%, 40%, 45%, or 50% to about 80%, about 15%, 20%, 25%, 30%, 35%, 40%, 45%, or 50% to about 70%, or about 15%, 20%, 25%, 30%, 35%, 40%, 45%, or 50% to about 60%, of the torso portion of the first main strap and the second main strap. In some embodiments, the closure comprising a zipper releasably connects the first main strap and the second main strap across at least 50% of the torso portion of the first main strap and the second main strap.

In some embodiments, the torso portion of the first main strap is connected to the torso portion of the second main strap by a non-releasable connection. In some embodiments, the torso portion of the first main strap is non-releasably connected to the torso portion of the second main strap by a single-point closure. In some embodiments, the back portion of the first main strap is connected to the back portion of the second main strap by a non-releasable connection. In some embodiments, the back portion of the first main strap is non-releasably connected to the back portion of the second main strap by a single-point closure. In some embodiments, the shoulder portion of the first main strap is connected to the shoulder portion of the second main strap by a non-releasable connection. In some embodiments, the shoulder portion of the first main strap is non-releasably connected to the shoulder portion of the second main strap by a single-point closure. In some embodiments, the single-point closure comprises a first connector on the first main strap and a second connector on the second main strap, wherein the first connector and the second connector are adapted to releasably connect with one another. In some embodiments, the first connector is connected to the torso portion of the first main strap, and the second connector is connected to the torso portion of the second main strap. In some embodiments, the first connector is connected to the right side portion of the first main strap, and the second connector is connected to the left side portion of the second main strap.

In some embodiments, the torso portion of the first main strap is connected to the torso portion of the second main strap by a releasable connection, and the back portion of the first main strap is connected to the back portion of the second main strap by a non-releasable connection. In some embodiments, the torso portion of the first main strap is non-releasably connected to the torso portion of the second main strap by a single-point closure, and the back portion of the first main strap is releasably connected to the back portion of the second main strap by a single-point closure.

In some embodiments, the torso portion of the first main strap is connected to the torso portion of the second main strap by a releasable connection, and the shoulder portion of the first main strap is connected to the shoulder portion of the second main strap by a non-releasable connection. In some embodiments, the torso portion of the first main strap is non-releasably connected to the torso portion of the second main strap by a single-point closure, and the shoulder portion of the first main strap is releasably connected to the shoulder portion of the second main strap by a single-point closure.

Accordingly, in some embodiments, the closure that releasably connects the first main strap and the second main strap is a single-point closure. In some embodiments, the single-point closure releasably connects the first main strap to the second main strap at a single point. In some embodiments, the single-point closure 150 comprises a button, a buckle, a hook and loop closure, a zipper, a magnet, a snap, or a stud-type closure on the first main strap 102 and a complementary connecting feature on the second main strap 104. In some embodiments, the single-point closure 150 comprises a button, a buckle, a hook and loop closure, a zipper, a magnet, a snap, or a stud-type closure on the second main strap 104 and a complementary connecting feature on the first main strap 102. In some embodiments, the single-point closure comprises a button, a buckle, a hook and loop closure, a zipper, a magnet, a snap, or a stud-type closure. In some embodiment, the single-point closure comprises: (i) a hook-compatible loop closure on the first main strap, and a loop-compatible hook closure on the second main strap; or (ii) a loop-compatible hook closure on the first main strap, and a hook-compatible loop closure on the second main strap; or (iii) a stud-compatible socket on the first main strap, and a socket-compatible stud on the second main strap; or (iv) a socket-compatible stud on the first main strap, and a stud-compatible socket on the second main strap; or (v) a buckle on the first main strap, and a buckle-compatible strap on the second main strap; or (vi) a buckle-compatible strap on the first main strap, and a buckle on the second main strap; or (vii) a buckle comprising a male end on the first main strap, and a buckle comprising a female end on the second main strap; or (viii) a buckle comprising a female end on the first main strap, and a buckle comprising a male end on the second main strap; or (ix) a first half zipper on the first main strap, and a second half zipper on the second main strap. In some embodiments, the single-point closure comprises a buckle on the first main strap, and a buckle-compatible strap on the second main strap. In some embodiments, the single-point closure comprises a buckle-compatible strap on the first main strap, and a buckle on the second main strap. In some embodiments, the single-point closure comprises a buckle comprising a male end on the first main strap, and a buckle comprising a female end on the second main strap. In some embodiments, the single-point closure comprises a buckle comprising a female end on the first main strap, and a buckle comprising a male end on the second main strap.

In some embodiments, the single-point closure is connected to the torso portion of the first main strap and/or the second main strap. In some embodiments, the single-point closure is positioned over the torso of the wearer. In some embodiments, the single-point closure is positioned over a sternum of the wearer or within 1 inch, two inches, three inches, four inches, five inches, or six inches below the bottom of a sternum of the wearer. In some embodiments, the single-point closure is positioned over the abdomen of the wearer. In some embodiments, the single-point closure is positioned over the back, e.g., upper back, of the wearer. In some embodiments, a first single-point closure is positioned over the torso, sternum, or abdomen of the wearer, and a second single-point closure is positioned over the back, e.g., upper back, of the wearer.

In some embodiments, the single-point closure reversibly connects the back portion of the first main strap and the back portion of the second main strap. In some embodiments, the single-point closure reversibly connects the back portion of the first main strap and the back portion of the second main strap at or proximate to the junction of the back portion and the shoulder portion. The shoulder portion 430 passes over the shoulder of the wearer and is depicted, for instance, in FIG. 4A. In some embodiments, the single-point closure reversibly connects the torso portion of the first main strap and the torso portion of the second main strap. The torso portion 440 passes over the front torso of the wearer and is depicted, for instance, in FIG. 4A. In some embodiments, the shoulder portion of the first main strap and the shoulder portion of the second main strap are connected by a stabilizing strap 401, such as depicted in FIG. 4A.

In some embodiments, a first single-point closure reversibly connects the torso portion of the first main strap and the torso portion of the second main strap, and a second single-point closure reversibly connects the back portion of the first main strap and the back portion of the second main strap. In some embodiments, a first single-point closure reversibly connects the torso portion of the first main strap and the torso portion of the second main strap, and a second single-point closure reversibly connects the back portion of the first main strap and the back portion of the second main strap at or proximate to the junction of the back portion and the shoulder portion.

In the particular embodiment shown in FIG. 1A, the single-point closure is a buckle. As seen in FIG. 1A, the first main strap 102 comprises a first "male" connecting feature of the buckle, and the second main strap 104 comprises a second complementary "female" connecting feature of the buckle that can be joined with the first connecting feature to releasably connect the straps 102 and 104 in an x-shaped configuration. Accordingly, in some embodiments, the single-point closure is a buckle comprising a buckle comprising a male end and a buckle comprising a female end. Connection between the male end and the female end of the buckle results in connection between the first and second main straps.

As used herein, "releasably connected" indicates that the first main strap 102 and second main strap 104 are connected by a means that permits reversible attachment and detachment of the straps from one another by actuating a single-point closure 150 or some other connecting feature(s). In some examples, the straps are connected by a dual-point or multiple-point closure that permits reversible attachment and detachment of the first main strap 102 from the second main strap 104 at two or more points. For instance, in some embodiments, the first main strap and the second main strap are connected, e.g., releasably connected, by a dual-point closure or a multiple-point closure at two or more locations on each of the first main strap and the second main strap. As used herein, "non-releasably connected" indicates that the first main strap and the second main strap are connected by a means that does not permit reversible attachment and detachment of the straps from one another by actuating a reversible attachment feature.

As seen in FIG. 1A, an exemplary single-point closure 150 is positioned near the wearer's sternum. For instance, in various embodiments, the single-point closure 150 is positioned over a sternum of the wearer, just below the sternum of the wearer, e.g., within 1 inch, 2 inches, three inches, or four inches below the sternum, or above the middle of the sternum of the wearer when the strapvest 100 is worn. Additionally, or alternatively, a closure, such as a single-point closure (e.g., single point closure 150 or an additional single-point closure) is positioned against or near the wearer's back, i.e., to releasably connect the first main strap 102 and the second main strap 104 at the back of the wearer. In some embodiments, the single-point closure is positioned over a sternum of the wearer or within 1 inch, two inches, three inches, four inches, five inches, or six inches below the bottom of a sternum of a wearer when the strapvest is worn by the wearer. In some embodiments, the single-point closure is positioned over the abdomen of a wearer when the strapvest is worn by the wearer.

In some embodiments, one or more of the first main strap 102 and the second main strap 104 comprises an adjustable and/or reversible closure 160, such as depicted in FIG. 1B. In some embodiments, the adjustable and/or reversible closure 160 extends across a width of the first main strap 102. In some embodiments, the adjustable and/or reversible closure 160 extends across a width of the second main strap 104. In some embodiments, the adjustable and/or reversible closure 160 is adapted to reversibly connect a portion of a first and/or second main strap to another portion of the same strap at the juncture, such that when the adjustable and/or reversible closure 160 is closed, the strap forms a continuous band around the wearer. The adjustable and/or reversible closure 160 can, in some embodiments, be actuated to open the strap at the juncture. Disconnecting one or more of the first main strap 102 and/or the second main strap 104 at the reversible closure of the adjustable and/or reversible closure 160 allows a wearer of the strapvest 100 to remove the strapvest without disconnecting the first main strap 102 from the second main strap 104, e.g., while maintaining the single point closure 150 in a closed or connected position. For instance, in some embodiments, the torso portion of the first main strap and/or the second main strap comprises a first end and a second end that are reversibly connected at the adjustable and/or reversible closure.

In some embodiments, the strapvest comprises one or more compartments 130. As seen in FIG. 1A, in some embodiments, the strapvest 100 comprises at least one compartment 130, and, in some embodiments, comprises a series of compartments arranged along the length of the respective first main strap 102 and/or second main strap 104. In some embodiments, the first main strap and/or the second main strap comprises one or more compartments. In some embodiments, the strapvest comprise a rotatable portion comprising one or more compartments. In some embodiments, the first main strap and/or the second main strap comprises one or more compartments, and the rotatable portion comprises one or more compartments. Each of the one or more compartments can individually be any compartment described herein.

In some embodiments, the first main strap and/or the second main strap comprises one or more compartments. In some embodiments, the one or more compartments of the first main strap and/or the second main strap comprise one or more detachable compartments. In some embodiments, the one or more compartments of the first main strap and/or the second main strap comprise one or more non-detachable compartments. In some embodiments, the one or more compartments comprise one or more detachable compartments and one or more non-detachable compartments. In some embodiments, the one or more detachable compartments is reversibly attached to the first main strap and/or the second main strap by a reversible attachment mechanism selected from the group consisting of a zipper, a magnet, a buckle, a hook and loop closure, a snap closure, slider clips, or two-part release clips, or a combination thereof. In some embodiments, the one or more compartments of the first main strap and/or the second main strap comprise a pocket.

In some embodiments, the one or more compartments 130 comprise a pocket and/or a detachable compartment. In some embodiments, the one or more compartments 130 comprise a pocket and a detachable compartment. In some embodiments, the one or more compartments comprise a pocket. In some embodiments, the pocket is a protruding pocket. In some embodiments, the protruding pocket is a sealable pocket. In some embodiments, the pocket is a sealable pocket. The sealable pocket can be reversibly sealable by any mechanism. In some embodiments, the sealable pocket is sealable by a zipper or a hook and loop closure. In some embodiments, the sealable pocket is sealable by a zipper. In some embodiments, the compartment is a sealable compartment. In some embodiments, the one or more compartments comprises a detachable compartment. In some embodiments, the detachable compartment is a sealable detachable compartment. In some embodiments, the one or more compartments comprises a protruding pocket and a compartment. In some embodiments, the one or more compartments comprises a protruding pocket and a detachable compartment. In some embodiments, the one or more compartments are attached to the first main strap and/or the second main strap.

In some embodiments, the pocket is a protruding pocket. In some embodiments, the protruding pocket comprises a closing feature and is configured to protrude outward from the rotatable portion upon releasing the closing feature. In some embodiments, the protruding pocket is irreversibly or permanently connected to the first main strap and/or the second main strap, on one side of the protruding pocket, and is reversibly connected to the first main strap and/or the second main strap, on another side of the protruding pocket by a closing feature. In some embodiments, the closing feature is selected from the group consisting of a zipper, a magnet, a buckle, a hook and loop closure, a snap closure, a rotatable pin, a retractable pin, a spring-loaded pin, slider clips, or two-part release clips, or a combination thereof. In some embodiments, the closing feature is a hook and loop closure. In some embodiments, the closing feature is a magnet. In some embodiments, the pocket is irreversibly or permanently connected to the rotatable portion.

In some embodiments, the protruding pocket is configured to protrude outward in a vertical direction. In some embodiments, the protruding pocket is configured to protrude outward in a horizontal direction.

In some embodiments, one or more protruding pockets is/are comprised anywhere on the strapvest, e.g., anywhere on the first main strap and/or the second main strap. In some embodiments, a protruding pocket is comprised on the torso portion (e.g., is comprised on a torso portion over a shoulder area, waist area, lower stomach area, or back area of the torso portion) of the first main strap and/or a protruding pocket is comprised on the torso portion (e.g., is comprised on a torso portion over a shoulder area, waist area, lower stomach area, or back area of the torso portion) of the second main strap. In some embodiments, a protruding pocket is comprised on the right side portion of the first main strap and/or a protruding pocket is comprised on the left side portion of the second main strap. In some embodiments, the protruding pocket is comprised on a lower part of the torso portion of the first main strap and/or the second main strap. In some embodiments, the protruding pocket is comprised on an upper part of the torso portion of the first main strap and/or the second main strap.

In some embodiments, the protruding pocket opens horizontally, e.g., from left to right or from right to left. In some embodiments, the protruding pocket opens vertically, e.g., from top to bottom or from bottom to top. In some embodiments, the protruding pocket opens horizontally, e.g., from left to right or from right to left. In some embodiments, the protruding pocket opens vertically, e.g., from top to bottom or from bottom to top. In some embodiments, the protruding pocket is configured to protrude outward in a vertical direction, e.g., from top to bottom or from bottom to top. In some embodiments, the protruding pocket is configured to protrude outward in a horizontal direction, e.g., from left to right or from right to left.

In some embodiments, the pocket is irreversibly or permanently connected to the first main strap and/or the second main strap.

In some embodiments, the one or more detachable compartments comprise a detachable pocket. In some embodiments, the one or more non-detachable compartments comprise a non-detachable pocket. In some embodiments, the non-detachable pocket is a protruding pocket. In some embodiments, the protruding pocket is reversibly connected to the interior face of the first main strap and/or the second main strap. In some embodiments, the one or more compartments of the first main strap and/or the second main strap comprises at least one compartment on the torso portion of the first main strap and/or the second main strap. In some embodiments, the one or more compartments of the first main strap and/or the second main strap comprises at least one compartment on the left side portion of the second main strap and/or the right side portion of the first main strap. In some embodiments, the one or more compartments of the first main strap and/or the second main strap comprises at least one compartment on the shoulder portion of the first main strap and/or the second main strap. In some embodiments, the one or more compartments of the first main strap and/or the second main strap comprises at least one compartment on the torso portion, at least one compartment on the left side portion, at least one compartment on the right side portion. In some embodiments, the one or more compartments of the rotatable portion comprises at least one compartment on an exterior side of one or more of the torso portion, the right side portion, the shoulder portion, and/or the back portion of the first main strap; and at least one compartment on an interior side of one or more of the torso portion, the left side portion, the shoulder portion, and/or the back portion of the second main strap. In some embodiments, the one or more compartments of the rotatable portion and/or the one or more further compartments of the first main strap and/or the second main strap comprises a compartment comprising an interior.

In some embodiments, the one or more compartments of the rotatable portion and/or the one or more further compartments of the first main strap and/or the second main strap comprises a compartment comprising a compressible foam material within the interior of the compartment.

In some embodiments, the one or more compartments comprise one or more detachable compartments. In some embodiments, the one or more compartments of the rotatable portion comprise one or more non-detachable compartments. In some embodiments, the one or more compartments comprise one or more detachable compartments and one or more non-detachable compartments. In some embodiments, the one or more detachable compartments is reversibly attached to the rotatable portion by a reversible attachment mechanism selected from the group consisting of a zipper, a magnet, a buckle, a hook and loop closure, a snap closure, slider clips, or two-part release clips, or a combination thereof. In some embodiments, the one or more detachable compartments comprise a detachable pocket.

In some embodiments, the first main strap and/or the second main strap comprises a compartment comprising an interior.

In some embodiments, at least one compartment 130 is a pocket, e.g., a flat pocket. In some embodiments, the pocket, e.g., flat pocket, protrudes only minimally from the exterior face of strap(s) 102 and/or 104. In some embodiments, at least one compartment is a pocket that is a protruding pocket.

In some embodiments, the strapvest comprises at least 2, at least 3, at least 4, at least 5, at least 6, at least 7, at least 8, at least 9, or at least 10 compartments, or a number of compartments between any of the foregoing values. In some embodiments, the strapvest comprises between 2 and 40, 2 and 30, 2 and 20, 2 and 15, 2 and 10, 4 and 20, 4 and 15, 4 and 10, 6 and 20, 6 and 15, or 6 and 10 compartments. In some embodiments, the first main strap and/or the second main strap comprises at least 2, at least 3, at least 4, at least 5, at least 6, at least 7, at least 8, at least 9, or at least 10 compartments, or a number of compartments between any of the foregoing values. In some embodiments, the first main strap and/or the second main strap of the strapvest comprises between 2 and 20, 2 and 15, 2 and 10, 4 and 20, 4 and 15, 4 and 10, 6 and 20, 6 and 15, or 6 and 10 compartments. Each of the one or more compartments or the at least 2, 3, 4, 5, 6, 7, 8, 9, or 10 compartments, or the number of compartments between any of the foregoing values, can independently be any of the compartments described herein.

The location of the one or more compartments is not particularly limited and can be on any accessible part of the strapvest. In some embodiments, the one or more compartments comprises at least one compartment on the exterior face of the first main strap. In some embodiments, the one or more compartments comprises at least one compartment on the exterior face and/or the interior face of the first and/or the second main strap. For instance, FIG. 1A depicts a compartment 130 that is located on the exterior face of the first main strap 112, and FIG. 2A depicts pockets 230*a*, 230*b*, and 230*c* that comprise a pocket opening 228 for accessing the interior of the pocket. In some embodiments, the one or more compartments comprises at least one compartment on the torso portion. In some embodiments, the one or more compartments comprises at least one compartment on the left side portion. In some embodiments, the one or more compartments comprises at least one compartment on the right side portion. In some embodiments, the one or more compartments comprises at least one compartment located on a rotatable portion.

In some embodiments, the one or more compartments comprises at least one compartment on one or more of the torso portions, the left side portion, and the right side portion. In some embodiments, the one or more compartments comprises at least one compartment on the exterior face and/or the interior face on one or more of the torso portion, the left side portion, and the right side portion. In some embodiments, the one or more compartments comprises at least one compartment on the exterior face on one or more of the torso portion, the left side portion, and the right side portion. The right side portion 450 passes across the right side of the wearer and is depicted, for instance, in FIG. 4A.

In some embodiments, at least one of the one or more compartments comprises a compressible foam material within the interior that is adapted to secure items within the compartment. In some embodiments, the compressible foam material is located on one or more of an upper portion, a lower portion, an internal portion, or a side portion within the interior of the compartment. In some embodiments, the compressible foam material of each of the one or more of an upper portion, a lower portion, an internal portion, or a side portion, is permanently fixed to the interior of the compartment or is removable. In some embodiments, the compressible foam material that is located on one or more of an upper portion, a lower portion, an internal portion, or a side portion within the interior of the compartment is permanently fixed to the interior of the compartment. In some embodiments, the compressible foam material that is located on one or more of an upper portion, a lower portion, an internal portion, or a side portion within the interior of the compartment is removable from the interior of the compartment. In some embodiments, the compressible foam material that is located in the internal portion of the interior of the compartment is removable. In some embodiments, the compressible foam material fills at least 25%, at least 50%, or at least 75%, or a value between any of the foregoing, of the volume of the interior of the compartment. In some embodiments, the compressible foam material fills at least 25%, at least 50%, or at least 75%, and up to 100%, or a value between any of the foregoing, of the volume of the interior of the compartment. In some embodiments, the compressible foam material fills between about 25% and about 100%, between about 25% and about 90%, between about 25% and about 80%, between about 25% and about 75%, between about 25% and about 60%, between about 25% and about 50%, between about 25% and about 40%, between about 40% and about 100%, between about 40% and about 90%, between about 40% and about 80%, between about 40% and about 75%, between about 40% and about 60%, between about 40% and about 50%, between about 50% and about 100%, between about 50% and about 90%, between about 50% and about 80%, between about 50% and about 75%, between about 50% and about 60%, between about 60% and about 100%, between about 60% and about 90%, between about 60% and about 80%, between about 75% and about 100%, or between about 75% and about 90% of the volume of the interior of the compartment.

In some embodiments, the compressible foam material is a compressible foam insert shaped to fill at least a portion of the interior of the compartment. In some embodiments, the compressible foam insert fills at least 25%, at least 50%, or at least 75%, or a value between any of the foregoing, of the volume of the interior of the compartment. In some embodiments, the compressible foam insert fills at least 25%, at least 50%, or at least 75%, and up to 100%, or a value between any of the foregoing, of the volume of the interior of the compartment. In some embodiments, the compressible foam insert fills at least 25%, at least 50%, or at least 75%, and up to 100% of the volume of the interior of the compartment. In some embodiments, the compressible foam insert fills between about 25% and about 100%, between about 25% and about 90%, between about 25% and about 80%, between about 25% and about 75%, between about 25% and about 60%, between about 25% and about 50%, between about 25% and about 40%, between about 40% and about 100%, between about 40% and about 90%, between about 40% and about 80%, between about 40% and about 75%, between about 40% and about 60%, between about 40% and about 50%, between about 50% and about 100%, between about 50% and about 90%, between about 50% and about 80%, between about 50% and about 75%, between about 50% and about 60%, between about 60% and about 100%, between about 60% and about 90%, between about 60% and about 80%, between about 75% and about 100%, or between about 75% and about 90% of the volume of the interior of the compartment.

In some embodiments, at least one of one or more compartments is accessible from an upper opening, a lower opening, and/or a side opening. The compressible foam material can, in some embodiments, provide for a more secure hold for the contents of the compartment that contains the compressible foam material, and/or provide for a safer and more protective hold of the contents. In some embodiments, at least one of the one or more compartments of the rotatable portion is accessible from an upper opening and/or a side opening. In some embodiments, at least one of the one or more compartments of the first main strap and/or the second main strap is accessible from an upper opening and/or a side opening.

In some embodiments, the first main strap, the second main strap, and the one or more compartments comprises one or more materials that are not limited and may be the same or different. In some embodiments, the first main strap and/or the second main strap comprises a first fabric layer, and at least one of the one or more compartments comprises a second fabric layer that is connected to the first fabric layer, with the interior of the at least one compartment being situated between the first fabric layer and the second fabric layer. In some embodiments, at least one of the first fabric layer or the second fabric layer comprises a compressible foam material adapted to secure items within at least one compartment.

Figure 6B:
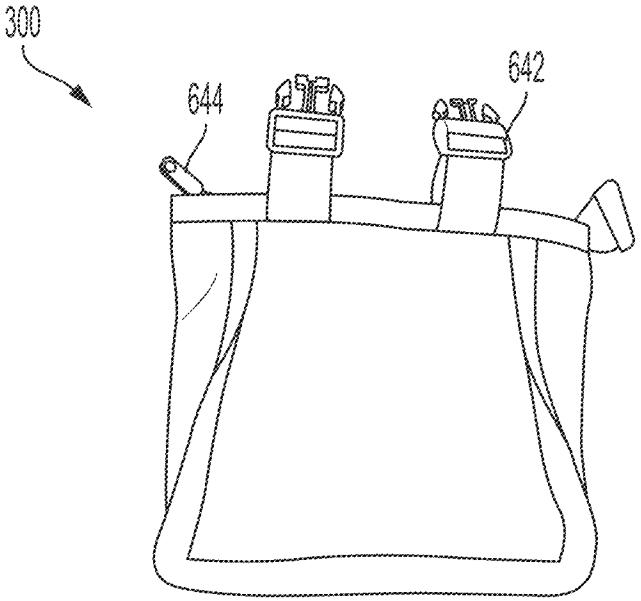
FIGS. 6A and 6B depict the front face (FIG. 6A) and the back face (FIG. 6B) of a removable compartment that can be attached to a strapvest.

In some embodiments, one or more of the compartments is expandable (e.g., comprises expandable and collapsible side walls and/or upper or lower walls) to accommodate thicker and/or longer items within the compartment(s) 130. In some embodiments, at least one of the one or more compartments is open, e.g., permanently open. In some embodiments, the one or more compartments that is open comprises an opening on the top of the compartment. In some embodiments, the compartment that is open is not closeable by a closing mechanism. For instance, in some embodiments, the compartment is open, such that the interior of the compartment is readily accessible for securing and removing items from the strapvest. In other embodiments, one or more of the compartments 130 is closeable, e.g., is a sealable pocket 1002. In some embodiments, the one or more compartments comprises a closeable compartment. In some embodiments, the closeable compartment is a sealable compartment. In some embodiments, the compartment that is closable, e.g., a sealable pocket, is closable by a closing mechanism, such as by way of, e.g., a zipper, a magnet, or a flap top that closes the compartment, or any suitable mechanism for opening and closing a compartment. For instance, in some embodiments, the compartment is a sealable pocket 1002, such as shown in FIG. 10C. The closing mechanism is not limited and may be any suitable mechanism for opening and closing a compartment on the strapvest. In some embodiments, the closing mechanism is by way of a zipper, a magnet, a flap top, a snap, a hook, a button, a fastener, or a hook-and-loop closure. For instance, as shown in FIG. 6B, a compartment can comprise a closing mechanism 644 that is a zipper.

In some embodiments, the first main strap and/or the second main strap comprises a first fabric layer, and at least one of the one or more compartments comprises a second fabric layer that is connected to the first fabric layer, wherein the interior of the compartment is situated between the first fabric layer and the second fabric layer. In some embodiments, at least one of the first fabric layer or the second fabric layer comprises a compressible foam material adapted to secure items within the at least one compartment comprising the second fabric layer.

Each of the one or more compartment(s) 130 may take any desired shape. Exemplary shapes include, e.g., a rectangular shape, a square shape, and a trapezoid shape, and shapes that are substantially rectangular, substantially square, or substantially trapezoid. For instance, in some embodiments, one or more of the compartments is substantially rectangular, and in some embodiments, one or more of the compartments has a width approximately equal to the width of the first main strap 102 or the second main strap 104 at the location on which it is connected. In some embodiments, one or more of the compartments is rectangular. In some embodiments, the width of one or more compartments has a width approximately equal to the width of the first main strap and/or the second main strap at the location on which it is connected. In some embodiments, one or more of the compartments is shaped to hold a particular object. For instance, in some embodiments, at least one of the one or more compartments 130 has an extended shape (e.g., a narrow-extended shape). In some embodiments, the extended shape is sized to receive the handle of tool, or is shaped to secure some other object (e.g., a mobile phone, a writing instrument, or some other object). In some embodiments, at least one of the one or more compartments comprises a strap configured to hold an object, such as a pencil, a mobile phone, or a tool having a handle. In some embodiments, the strap is configured to hold a pencil, a screwdriver, a wrench, a ratchet, a knife, or a flashlight. In some embodiments, one or more of the compartments 130 has a strap that comprises an open bottom (e.g., has a sleeve-like or loop-like shape) such that a tool or object can be inserted through the compartment 130 to secure it to the strapvest 100. Other configurations of compartments are also envisioned.

In some embodiments, at least one of the one or more compartments, e.g., detachable compartments, comprises one or more closing features, e.g., one or more closing features adapted for securing items within the detachable compartment by closing an opening of the compartment. In various embodiments, the closing feature 644 is or comprises a zipper, a magnet, a flap closure, a snap closure, a hook and loop closure, or some other mechanism adapted for sealing or substantially sealing the compartment. In some embodiments, the compartment comprises a closing feature selected from the group consisting of a zipper, a magnet, a flap closure, a snap closure, and a hook and loop closure. In some embodiments, the compartment comprises a closing feature that is a zipper. In some embodiments, the compartment comprises a closing feature that is a hook and loop closure.

In some embodiments, at least one of the one or more compartments is a detachable compartment. A detachable compartment is a compartment that is reversibly attached to the strapvest, such as by any reversible attachment mechanism. In some embodiments, the reversible attachment mechanism for reversibly attaching the detachable compartment to the strapvest, e.g., to the first main strap and/or the second main strap, is or comprises one or more of a zipper, a magnet, a flap closure, a snap closure, or a hook and loop closure.

In some embodiments, the detachable compartment comprises one or more closing features, e.g., one or more closing features adapted for securing items within the detachable compartment by closing an opening of the compartment, such as one or more of a zipper, a magnet, a flap closure, a snap closure, a hook and loop closure, or some other mechanism adapted for sealing or substantially sealing the compartment. In some embodiments, the detachable compartment comprises a closing feature selected from the group consisting of a zipper, a magnet, a flap closure, a snap closure, and a hook and loop closure. In some embodiments, the detachable compartment comprises a closing feature that is a zipper. In some embodiments, the detachable compartment comprises a closing feature that is a hook and loop closure.

Figure 3A:
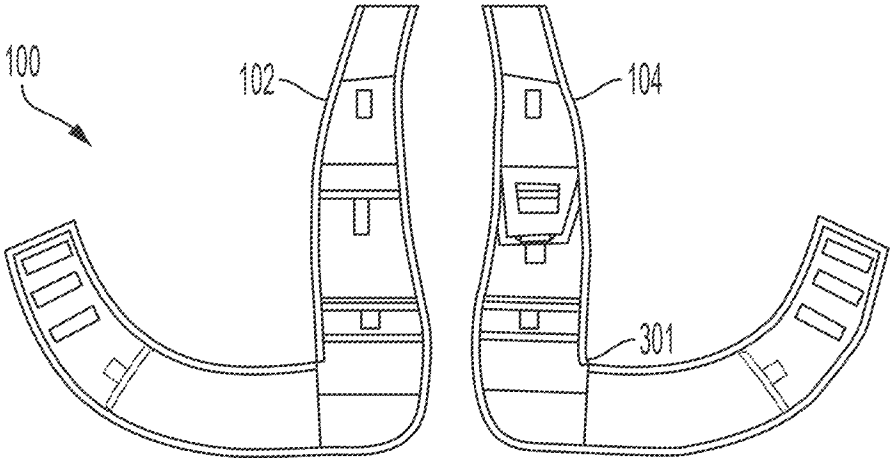
FIGS. 3A and 3B depict exemplary strapvests viewed from the front perspective.
Figure 3B:
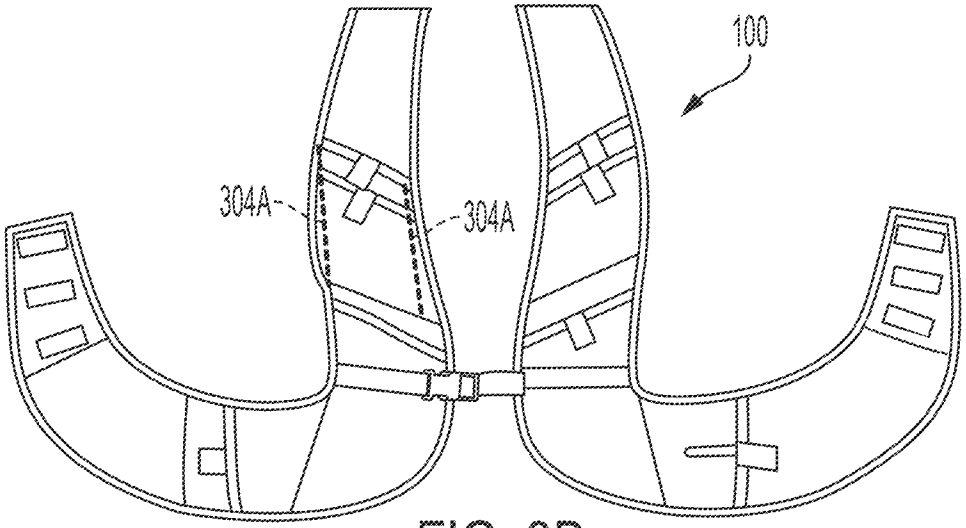
Figure 3C:
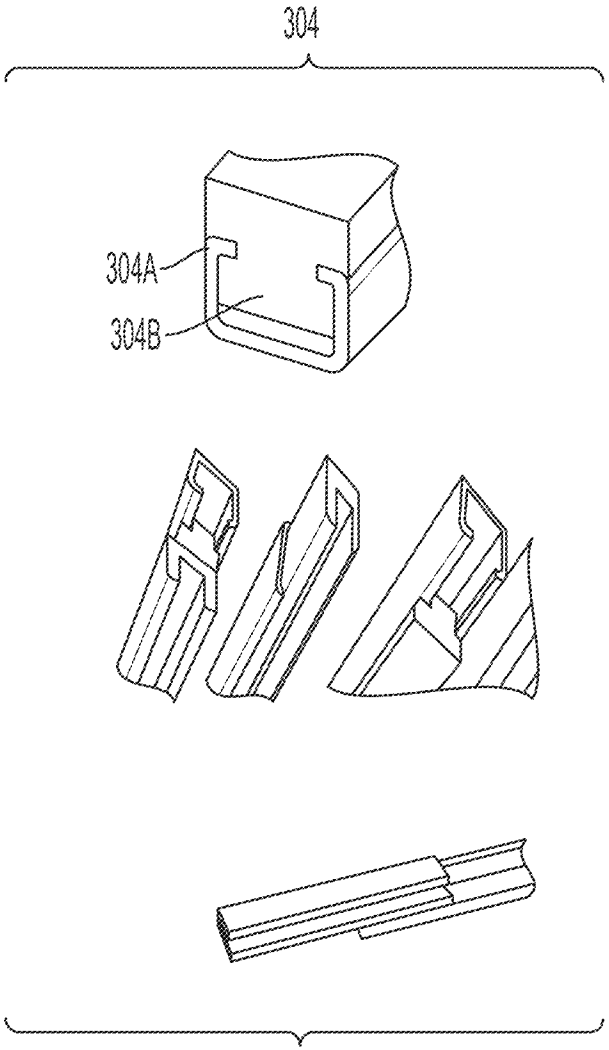
FIG. 3C shows an exemplary two-part railing system 304 that includes a rail track 304A that mounts to the edges of the body of a strapvest, e.g., a first main strap and/or a second main strap, such as in a vertical or substantially vertical direction, into which a rail insert 304B that is permanently fixed to opposite sides of a sliding compartment slides into.

In some embodiments, the detachable compartment is a sliding compartment. A sliding compartment is a detachable compartment that is reversibly attached to the first main strap and/or the second main strap using a two-part railing system, such as depicted in FIG. 3B by the pair of rail tracks (304A), and as depicted in FIG. 3C. In some embodiments, the two-part railing system comprises at least two rail tracks that are permanently fixed to the strapvest, e.g., to the first main strap and/or to the second main strap, and are parallel to one another. In some embodiments, the two-part railing system comprises (i) a pair of rail tracks that are permanently fixed to the first main strap and/or the second main strap and are parallel to one another; and (ii) a pair of rail inserts that are permanently fixed to a sliding compartment, and are parallel to one another. The pair of rail inserts slide into the pair of rail tracks such that the sliding compartment is reversibly attached to the first main strap and/or the second main strap via the two-part railing system.

In some embodiments, the sliding compartment comprises a pair of rail inserts that are parallel to one another. In some embodiments, the first main strap and/or the second main strap comprises a pair of rail tracks that are parallel to one another and adapted to receive the pair of rail inserts of the sliding compartment.

In some embodiments, the pair of rail tracks are permanently fixed to any portion of the first main strap and/or the second main strap, such that they are parallel to one another. In some embodiments, the pair of rail tracks are permanently fixed to the torso portion of the first main strap and/or the second main strap, and are parallel to one another. In some embodiments, the pair of rail tracks run vertically or substantially vertically along the first main strap and/or the second main strap, and are parallel to one another. In some embodiments, the pair of rail tracks run horizontally or substantially horizontally along the first main strap and/or the second main strap, and are parallel to one another. In some embodiments, the pair of rail tracks run vertically or substantially vertically along the edges of the first main strap and/or the second main strap, and are parallel to one another. In some embodiments, when the rail track 304A slides into the rail insert 304B, the sliding compartment slides along the rail track 304A keeping the rail insert in place until it stops by a locking mechanism located at an end of the of rail track. In some embodiments, the sliding compartment is removed by sliding the rail insert along the rail track until the sliding compartment is detached from the strapvest. In some embodiments, the sliding compartment is securely held in place until the wearer disengages the sliding compartment such that the rail insert can be slid along the rail track. In some embodiments, to remove the sliding compartment from the strapvest, a mechanism near the top of the rail is squeezed allowing both the rail track 304A and the rail insert 304B to disconnect.

In some embodiments, the railing system, e.g., the rail track and/or the rail insert, has a width of between or between about 1/32 of an inch to about 1 inch, between or between about 1/16 of an inch to about 3/4 inch, or between or between about 1/16 of an inch to about 1/2 inch. In some embodiments, the railing system has a width of between or between about 1/16 of an inch to about 1/2 inch. In some embodiments, the railing system has a width of about 1/16, about 1/15, about 1/14, about 1/13, about 1/12, about 1/11, about 1/10, about 1/9, about 1/8, about 1/7, about 1/6, about 1/5, about 1/4, about 1/3, or about 1/2 inch. In some embodiments, the railing system, e.g., the rail track and/or the rail insert, has a length of at least 2, 3, 4, 5, 6, 7, 8, 9, or 10 inches long, or a value between any of the foregoing. In some embodiments, the railing system, e.g., the rail track and/or the rail insert, has a length of about 2 to about 10 inches long, about 2 to about 9 inches long, about 2 to about 8 inches long, about 2 to about 7 inches long, about 2 to about 6 inches long, about 2 to about 5 inches long, about 2 to about 4 inches long, about 2 to about 3 inches long, about 3 to about 10 inches long, about 3 to about 9 inches long, about 3 to about 8 inches long, about 3 to about 7 inches long, about 3 to about 6 inches long, about 3 to about 5 inches long, about 3 to about 4 inches long, about 4 to about 10 inches long, about 4 to about 9 inches long, about 4 to about 8 inches long, about 4 to about 7 inches long, about 4 to about 6 inches long, or about 4 to about 5 inches. In some embodiments, the railing system, e.g., the rail track and/or the rail insert, has a length of about 2, 2.5, 3, 3.5, 4, 4.5, 5, 5.5, 6, 6.5, 7, 7.5, 8, 8.5, 9, 9.5, or 10 inches, or a value between any of the foregoing. In some embodiments, the railing system, e.g., the rail track and/or the rail insert, has a length of about 3, 3.5, 4, 4.5, 5, 5.5, 6, 6.5, 7, 7.5, or 8 inches, or a value between any of the foregoing. In some embodiments, the railing system, e.g., the rail track and/or the rail insert, has a width of between or between about 1/16 to about 1/2 inch, and a length of about 3 to about 8 inches.

The rail track of the railing system can be attached to any portion of the strapvest. In some embodiments, the rail track of the railing system is attached to the first main strap. In some embodiments, the rail track of the railing system is attached to the second main strap. In some embodiments, the rail track of the railing system is attached to the first main strap and the second main strap. In some embodiments, the rail track of the railing system is attached to the torso portion of the first main strap. In some embodiments, the rail track of the railing system is attached to the torso portion of the second main strap. In some embodiments, the rail track of the railing system is attached to the torso portion of the first main strap and the torso portion of the second main strap. In some embodiments, the rail track of the railing system is attached to the side portion of the first main strap. In some embodiments, the rail track of the railing system is attached to the side portion of the second main strap. In some embodiments, the rail track of the railing system is attached to the side portion of the first main strap and the side portion of the second main strap. In some embodiments, the rail track of the railing system is attached to the shoulder portion of the first main strap. In some embodiments, the rail track of the railing system is attached to the shoulder portion of the second main strap. In some embodiments, the rail track of the railing system is attached to the shoulder portion of the first main strap and the shoulder portion of the second main strap.

In some embodiments, the sliding compartment comprises one or more closing features, e.g., one or more closing features adapted for securing items within the sliding compartment by closing an opening of the compartment, such as one or more of a zipper, a magnet, a flap closure, a snap closure, a hook and loop closure, or some other mechanism adapted for sealing or substantially sealing the compartment. In some embodiments, the sliding compartment comprises a closing feature selected from the group consisting of a zipper, a magnet, a flap closure, a snap closure, and a hook and loop closure. In some embodiments, the sliding compartment comprises a closing feature that is a zipper. In some embodiments, the sliding compartment comprises a closing feature that is a hook and loop closure.

As seen in FIG. 1B, in some embodiments, the strapvest 100 comprises one or more holster bands 170 extending along a length (e.g. lower edge, across the length of a featured strap in whole or partial) of the first main strap 102 or the second main strap 104. The holster band comprises a band having a first end and a second end that each connect to the strapvest to provide a holster that is adapted for, e.g., hanging tools or securing other items to the strapvest or a portion thereof. In some embodiments, at least one of the one or more holster bands is adapted to secure a tool to the strapvest. In some embodiments, at least one of the one or more holster bands is connected to the right side portion; and/or at least one of the one or more holster bands is connected to the left side portion. The holster band 170 is joined to the first or second main strap at its ends (i.e., at a first end of the holster band 170 and a second end of the holster band opposite the first end) and is adapted for, e.g., hanging tools or securing other items to the strapvest 100. For instance, in some embodiments, the holster band is adapted for hanging a hammer or other tool, e.g., by attaching the first and second ends of the band to the first or second main strap such that the holster band forms an opening that is large enough to accept a handle of the tool, e.g., hammer, but small enough to secure the tool, e.g., hammer, to the holster band by not allowing the head of the tool, e.g., hammer, to fall through the holster band. In some embodiments, the holster band is adapted for hanging a tool having a handle that is narrower than the head of the tool, wherein the holster band comprises an opening that is large enough to accept the handle of the tool but not the head of the tool, thereby securing the tool to the strapvest. The holster band 170 may extend along any desired portion of the strapvest 100. For instance, in some embodiments the holster band 170 extends along a right-side body or left-side body of the wearer and is joined to the same portion of the first main strap 102 or the second main strap 104. It should be noted that the holster band 170 may be formed from any desired material and is not limited to a fabric or textile strip. For instance, in some embodiments, the holster band 170 is a cord, a wire, a fabric, a metal, plastic, or some other holster band adapted for hanging tools and other objects. In some embodiments, the holster band comprises one or more openings that secure tools, e.g., secure the handle of a tool or other object. In some embodiments, the one or more holster bands is or comprises one or more strips of fabric.

In some embodiments, the strapvest further comprises one or more holster bands connected to the first main strap and/or the second main strap. In some embodiments, each of the one or more holster bands comprises a first end and a second end. In some embodiments, the one or more holster bands are connected to the first main strap and/or the second main strap at a first end and a second end of each of the one or more holster bands. In some embodiments, the strapvest further comprises one or more holster bands connected to the first main strap and/or the second main strap at a first end and a second end of each of the one or more holster bands. In some embodiments: (i) a holster band of the one or more holster bands is connected to the first main strap at a first end of the holster band and at a second end of the holster band, wherein the first end and the second end of the holster band are located on opposite ends of the holster band; and/or (ii) a holster band of the one or more holster bands is connected to the second main strap at a first end of the holster band and at a second end of the holster band, wherein the first end and the second end of the holster band are located on opposite ends of the holster band. In some embodiments, at least one of the one or more holster bands is adapted to secure a tool to the strapvest. In some embodiments, at least one of the one or more holster bands is connected to the right side portion; and/or at least one of the one or more holster bands is connected to the left side portion.

Figure 4C:
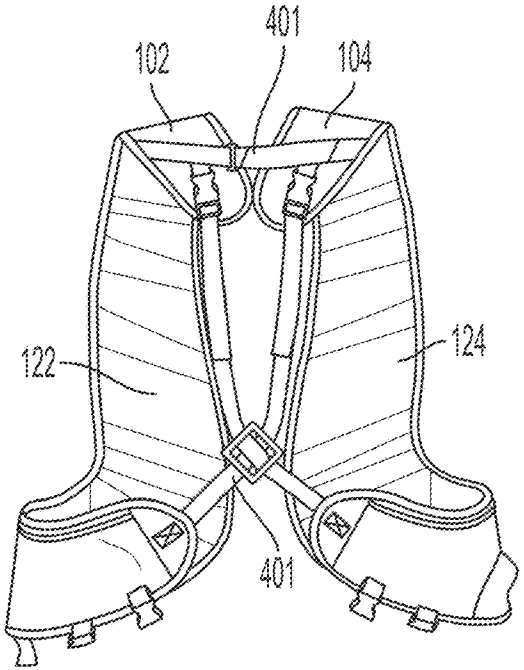
FIGS. 4A and 4B depict exemplary strapvests viewed from the front side and FIG. 4C is viewed from the back side. These exemplary embodiments include an embodiment having a single-point closure located at a juncture between the straps on the front side (FIG. 4A), an embodiment having a single-point closure located at a juncture between the straps on the front side and a single-point closure located at a juncture between the back portion of the first and second main straps (FIG. 4B), and an embodiment having a single-point closure located at a juncture between the back portion of the first and second main straps (FIG. 4C). In the embodiment depicted in FIGS. 4A and 4B, the single-point closure on the front side (connecting the torso portion of the first and second main straps) includes a buckle having a male connector and a female connector.
Figure 4B:
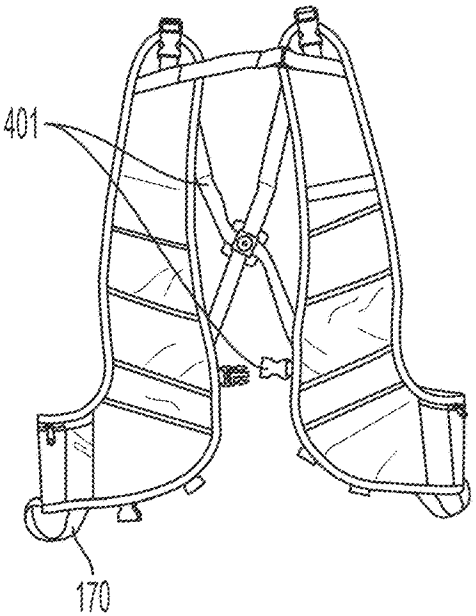
Figure 4A:
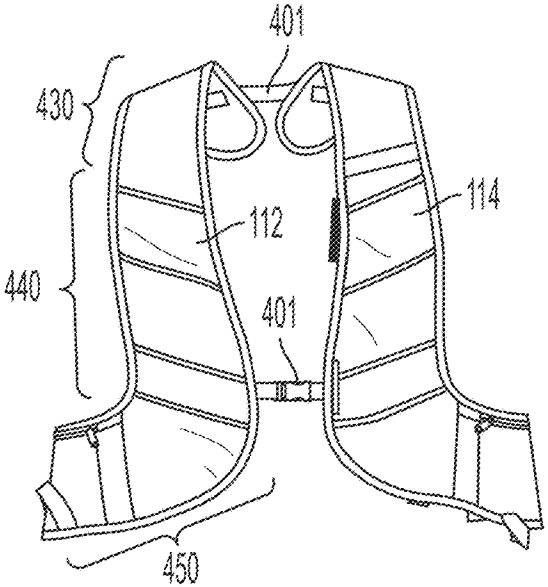

In some embodiments, the strapvest comprises one or more stabilizing belts 401, e.g., as shown in FIGS. 4A-C. In some embodiments, a stabilizing belt is connected to a closure, e.g., a single-point closure, such as depicted in FIGS. 4A and 4B. Accordingly, in some embodiments, the strapvest further comprises a stabilizing belt comprising a first end and a second end, wherein the first end of the stabilizing belt is connected to the back portion of the first main strap and/or the second end of the stabilizing belt is connected to the back portion of the second main strap. A stabilizing belt connected to a closure allows, e.g., for the closure to secure the strapvest to the wearer while providing an extendible belt that can be lengthened or shortened depending on the size of the wearer. In some embodiments, the single-point closure is connected to the first main strap and/or the second main strap by a stabilizing belt. In some embodiments, the stabilizing belt is extendible and/or adjustable.

In some embodiments, the one or more stabilizing belts can be of any suitable material, such as fabric or rubberized (e.g., elastomeric) materials, that connect the first main strap 102 and the second main strap 104 to add support and maintain the overall shape of the strapvest 100. In some embodiments, the one or more stabilizing belts comprise a fabric material. In some embodiments, the one or more stabilizing belts comprise an elastomeric material. In some embodiments, the one or more stabilizing belts comprise a fabric material and an elastomeric material. The one or more stabilizing belt(s) may, in some embodiments, extend between the first main strap 102 and the second main strap 104 at any desired location along the strapvest, for instance, across a lower back of the wearer, across a middle back of the wearer, between shoulders of a wearer, across a chest of a wearer, or around a waist of the wearer, or any combination thereof. In some embodiments, one or more of the stabilizing belt(s) extend horizontally between the main straps 102, 104; however, in other embodiments one or more of the stabilizing belt(s) may be provided in, e.g., in an x-shaped or lattice configuration, or in some other configuration.

In some embodiments, the torso portion and/or the back portion comprises one or more stabilizing belts that extends between the first main strap and the second main strap. In some embodiments, a stabilizing belt connects the first main strap and the second main strap on the back portion in an x-shaped configuration, such as depicted in FIGS. 4B and 4C.

In some embodiments, the strapvest comprises one or more stabilizing belts that extends from the torso portion of the first main strap to the torso portion of the second main strap; and/or comprises one or more stabilizing belts that extends from the back portion of the first main strap to the back portion of the second main strap. In some embodiments, one or more of the stabilizing belts cross one another, e.g., are in an x-shaped or lattice configuration. In some embodiments, one or more of the stabilizing belts do not cross one another, e.g., are in parallel with one another. To improve the fit of the strapvest and better secure the first and second main straps 102, 104 around the wearer's body, the material of the stabilizing belt(s) is optionally constructed of one or more of a variety of fabrics, plastics, or other materials, such as elastic, that serve the function. In some examples, the one or more stabilizing belt(s) are adjustable in length to modify the size of the strapvest (e.g., adjustable using a slider clip, hook & loop or some other adjustment mechanism).

In some embodiments, the stabilizing belt is an adjustable support strap. In some embodiments, the adjustable support strap comprises a first strap connected to the first main strap and a second strap connected to the second main strap, wherein the first strap and the second strap each comprise a reversible attachment mechanism that is complementary to one another. In some embodiments, the first end of the stabilizing belt is reversibly connected to the back portion of the first main strap and/or the second end of the stabilizing belt is reversibly connected to the back portion of the second main strap. In some embodiments, the reversible attachment mechanism is a buckle.

In some embodiments, the stabilizing belt comprises a first end and a second end, wherein the first end of the stabilizing belt is connected, e.g., horizontally connected, to the back portion of the first main strap and/or the second end of the stabilizing belt is connected, e.g., horizontally connected, to the back portion of the second main strap. In some embodiments, the first end of the stabilizing belt is reversibly connected to the back portion of the first main strap and/or the second end of the stabilizing belt is reversibly connected to the back portion of the second main strap. In some embodiments, the first end of the stabilizing belt is irreversibly connected to the back portion of the first main strap and the second end of the stabilizing belt is reversibly connected to the back portion of the second main strap. In some embodiments, the first end of the stabilizing belt is reversibly connected to the back portion of the first main strap and the second end of the stabilizing belt is irreversibly connected to the back portion of the second main strap. In some embodiments, the first end of the stabilizing belt is irreversibly connected to the back portion of the first main strap and the second end of the stabilizing belt is irreversibly connected to the back portion of the second main strap. In some embodiments, the stabilizing belt comprises a first end and a second end, wherein the first end of the stabilizing belt is horizontally connected to the back portion of the first main strap and/or the second end of the stabilizing belt is horizontally connected to the back portion of the second main strap.

In some embodiments, (i) the first end of the stabilizing belt is irreversibly connected to the back portion of the first main strap and the second end of the stabilizing belt is reversibly connected to the back portion of the second main strap; or (ii) the first end of the stabilizing belt is reversibly connected to the back portion of the first main strap and the second end of the stabilizing belt is irreversibly connected to the back portion of the second main strap; or (iii) the first end of the stabilizing belt is irreversibly connected to the back portion of the first main strap and the second end of the stabilizing belt is irreversibly connected to the back portion of the second main strap.

In some embodiments, the first end of the stabilizing belt is connected to the back portion of the first main strap at a position that is less than or less than about 10, 9, 8, 7, 6, 5, 4, 3, 2, or 1 inch, or a value between any of the foregoing, from the top of the shoulder portion of the first main strap; and/or the second end of the stabilizing belt is connected to the back portion of the second main strap at a position that is less than or less than about 10, 9, 8, 7, 6, 5, 4, 3, 2, or 1 inch, or a value between any of the foregoing, from the top of the shoulder portion of the second main strap. In some embodiments, the first end of the stabilizing belt is connected to the back portion of the first main strap at a position that is less than or less than about 10, 9, 8, 7, 6, 5, 4, 3, 2, or 1 inch, or a value between any of the foregoing, from the top of the shoulder portion of the first main strap. In some embodiments, the second end of the stabilizing belt is connected to the back portion of the second main strap at a position that is less than or less than about 10, 9, 8, 7, 6, 5, 4, 3, 2, or 1 inch, or a value between any of the foregoing, from the top of the shoulder portion of the second main strap. The "top of the shoulder portion" refers to the peak of the shoulder portion when the strapvest is worn by a wearer that is resting on the highest point of the wearer's shoulder, i.e., is vertically the highest part of the shoulder portion when the wearer is wearing the strapvest upright. The top of the shoulder portion is depicted, for instance, in FIG. 1A, FIG. 1B, and in FIG. 4A and FIG. 4C along with an exemplary stabilizing belt 401.

In some embodiments, the first end of the stabilizing belt is connected to the back portion of the first main strap at a position that is between or between about 1 and 6 inches from the top of the shoulder portion of the first main strap; and/or the second end of the stabilizing belt is connected to the back portion of the second main strap at a position that is between or between about 1 and 6 inches from the top of the shoulder portion of the second main strap. In some embodiments, the first end of the stabilizing belt is connected to the back portion of the first main strap at a position that is between or between about 1 and 6 inches from the top of the shoulder portion of the first main strap. In some embodiments, the second end of the stabilizing belt is connected to the back portion of the second main strap at a position that is between or between about 1 and 6 inches from the top of the shoulder portion of the second main strap. In some embodiments, the position that is between or between about 1 and 6 inches, 1 and 5.5 inches, 1 and 5 inches, 1 and 4.5 inches, 1 and 4 inches, 1 and 3.5 inches, 1 and 3 inches, 1 and 2.5 inches, 1 and 2 inches, 1 and 1.5 inches, 2 and 6 inches, 2 and 5.5 inches, 2 and 5 inches, 2 and 4.5 inches, 2 and 4 inches, 2 and 3.5 inches, 2 and 3 inches, 2 and 2.5 inches, 3 and 6 inches, 3 and 5.5 inches, 3 and 5 inches, 3 and 4.5 inches, 3 and 4 inches, or 3 and 3.5 inches, from the top of the shoulder of the first and/or second main strap is or is about 1 inch, 1.5 inch, 2 inches, 2.5 inches, 3 inches, 3.5 inches, 4 inches, 4.5 inches, 5 inches, 5.5 inches, or 6 inches, or any value in between any of the foregoing.

In some embodiments, the first end of the stabilizing belt is connected to the back portion of the first main strap at a position that is between or between about 2 and 6 inches from the top of the shoulder portion of the first main strap; and/or the second end of the stabilizing belt is connected to the back portion of the second main strap at a position that is between or between about 2 and 6 inches from the top of the shoulder portion of the second main strap. In some embodiments, the length of the stabilizing belt from the first end to the second end is adjustable and/or extendible.

In some embodiments, the length of the stabilizing belt from the first end to the second end is adjustable and/or extendible. An adjustable and/or extendible strap is a strap whose length is adjustable to accommodate wearers of different sizes, weights, heights, or needs. This is advantageous because it negates the need for customizing each strapvest to a wearer of numerous different sizes.

In some embodiments, the first main strap 102 and the second main strap 104 are formed from and/or comprise one or more fabric layers. In some embodiments, the first main strap and the second main strap comprise one or more fabric layers. For instance, an exterior face 112 of the first main strap and an exterior face 114 of the second main strap is defined by a first fabric layer, and the interior face 122 of the first main strap and the interior face 124 of the second main strap is defined by a second fabric layer. In various embodiments, the fabric layers are formed from, for instance, a waterproof or tear-resistant nylon, a polymer material, a cotton, a canvas, a woven fabric, a leather, hemp, denim, an elastomeric material, or some other material, or a combination of materials, such as a combination of any of the foregoing materials. Optionally, one or more additional layers of material is included between the first and the second fabric layers, for instance, additional fabric layers, a compressible foam layer, a rigid structural layer, or some other layers of material. In some embodiments, additional layers may beneficially provide structural support to the strapvest, improve the durability or comfort of the strapvest, or provide protection to a wearer of the strapvest. In some embodiments, the exterior face of the first main strap comprises a first fabric layer and the interior face of the first main strap comprises a second fabric layer; and the exterior face of the second main strap comprises a first fabric layer and the interior face of the second main strap comprises a second fabric layer. In some embodiments, the first main strap and/or the second main strap further comprises a foam material in between the first layer and the second layer. In some embodiments, the first main strap and the second main strap further comprises a foam material in between the first layer and the second layer. In some embodiments, the foam material is a compressible foam material.

In some embodiments, the one or more layers of the first main strap 102 and the second main strap 104 define various compartments in the strapvest 100. For example, a compartment 130 of a strapvest 100 is formed from one or more of the fabric layers of the first main strap 102 and/or the second main strap 104, and is accessible by way of a gap or pocket opening that permits entry between the one or more layers of the straps. In a particular example, the portion of the first main strap 102 and the second main strap 104 including the one or more compartment(s) 130 comprises a first fabric layer and a second fabric layer, and the first and second fabric layers define one or more compartments 130 between the layers. However, in some embodiments, each of the one or more compartment(s) 130 may be formed from any desired number of layers. For instance, in some embodiments, a compartment 130 is lined with an additional fabric layer, e.g., an elastic or compressible layer that facilitates securing objects within the compartment, or a soft or padded layer that protects objects within the compartment or protects the wearer of the strapvest. In some embodiments, the pocketed portion of the strapvest 100 is formed from a plurality of layers, for instance, layers that improve the durability or function of the strapvest (e.g., a first outer water-resistant layer, a second padded layer, a third compressible foam layer, a fourth rigid or semi-rigid structural layer, etc.), and the compartment(s) 130 are defined by any two or more of the layers.

In some embodiments, the one or more compartment(s) 130 may be comprised in any desired portion of the first main strap and/or the second main strap. For instance, in some examples, one or more compartment(s) 130 are comprised in a portion of the first main strap 102 or the second main strap 104 that is adapted to run down a front torso of the wearer, e.g., the torso portion of the first and/or second main strap. For instance, one or more compartment(s) 130 could be comprised on, or made out of, the first and/or second main strap(s) 102, 104 proximate to the wearer's chest or stomach. In some embodiments, the first main strap and/or the second main strap comprises the one or more compartments in one or more portions, such as the torso portion of the first main strap and/or the second main strap, or the left side portion, or the right side portion.

Additionally, or alternatively, one or more compartment(s) are comprised in a portion of the first main strap 102 or the second main strap 104 that is adapted to run over a shoulder of the wearer, down around a side body of the wearer, across the back of the wearer, or in some other portion of the first main strap 102 and/or the second main strap 104. In some embodiments, one or more compartment(s) are comprised in a portion of the first main strap 102 or the second main strap 104 that is adapted to run over a shoulder of the wearer, down around a side body of the wearer, and down the back of the wearer, such that the first main strap 102 and the second main strap 104 do not intersect and/or are parallel or substantially parallel to one another. In some embodiments, one or more of the compartments are formed by the first main strap and/or the second main strap itself, such as by incorporating openings, slits, straps, or other embodiments of the compartment in the first main strap and/or the second main strap itself, e.g., in the material, e.g., fabric, used to form the first main strap and/or the second main strap. In some embodiments, one or more of the compartments are reversibly attached to the first main strap and/or the second main strap using any known attachment mechanism, including any as described herein.

Various embodiments include one or more compartment(s) 130 proximate to the wearer's waist, chest, shoulders, and/or back. In some embodiments, one or more compartments are located on the torso portion of the first main strap and/or the second main strap; and/or one or more compartments are located on the left side portion of the second main strap and/or the right side portion of the first main strap; and/or one or more compartments are located on the shoulder portion of the first main strap and/or the second main strap; and/or one or more compartments are located on the back portion of the first main strap and/or the second main strap; or any combination thereof. For instance, as shown in FIG. 1A, one or more compartment(s) 130 is located on the exterior face of a main strap.

Figure 2B:
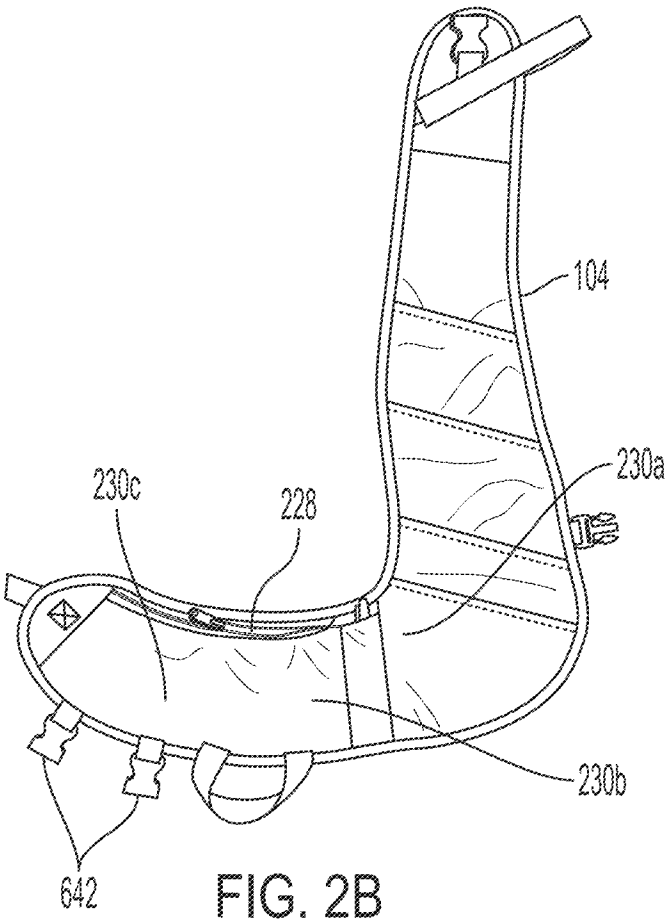
FIG. 2B depicts a portion of an exemplary strapvest that runs around a right side body of the wearer.
Figure 2A:
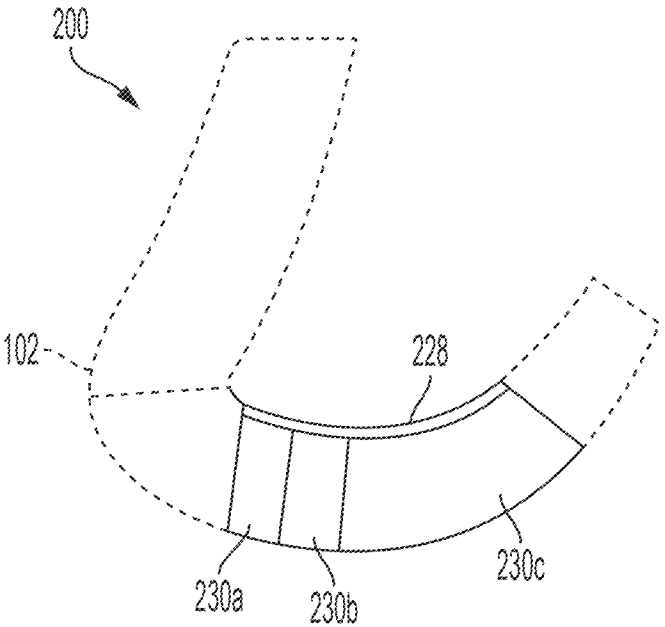
FIG. 2A depicts a portion of an exemplary strapvest that runs around a left side body of the wearer.

FIGS. 2A and 2B illustrates another exemplary configuration of compartments on a portion 200 of a strap of a strapvest (e.g., a portion of the first main strap 102 of FIG. 2A or the second main strap 104 of FIG. 2B of the strapvest of FIGS. 2A and 2B that includes, e.g., a shoulder portion, a torso portion, and a left side or right side portion). As seen in FIGS. 2A and 2B, one or more pockets (230*a*, 230*b*, 230*c*) are positioned proximate to a side or waist of the wearer when the strapvest is worn, e.g., in a left side portion (FIG. 2A) or a right side portion (FIG. 2B). In such an embodiment, the portion of the first main strap or the second main strap (i.e., the compartment-including portion 200) is adapted to run around a right-side body or a left-side body of the wearer. As shown in FIG. 2A, the pockets 230*b* and 230*c* can be entered from a pocket opening 228 of the first and/or second main strap of the strapvest. In some embodiments, the one or more compartment(s) are defined by one or more fabric layers of a multi-layered strap portion 200, and the compartment(s) are entered at a pocket opening 228 that permits entry to an interior space between two or more of the fabric layers of the compartment. In some embodiments, the first main strap and/or the second main strap comprises a pocket opening that comprises an opening into one or more of the pockets. In some embodiments, the pocket opening 228 is reversibly closed, such as with a zipper as depicted in FIG. 2B, a magnet, a hook and loop closure system, buttons, hooks, or any other suitable reversible closure mechanism. In some embodiments, the pocket opening is an upper opening that is located on or proximate to an upper portion of the pockets, such as depicted in FIG. 2A and FIG. 10B.

In some embodiments, the pocket opening 228 is a side opening that is located on or proximate to the side of a pocket, e.g., vertically to the compartment when being worn, which allows access to the compartment from one or more sides of the compartment, such as depicted in FIG. 10B (white substantially vertical and horizontal lines). In some embodiments, the pocket opening is an exterior opening that is located on the exterior face of a compartment, e.g., to allow direct access into the compartment from the exterior face.

In some embodiments, the pocket opening is an interior opening that is located on the interior face of a compartment that faces inward toward the wearer, e.g., to allow direct access into the compartment from the interior face of the compartment. An interior opening may be desirable in situations where the seam is to be protected from the elements, such as rain, water, or debris, and/or in situations where it is desirable to hide the existence of the seam and/or compartment.

Figure 6A:
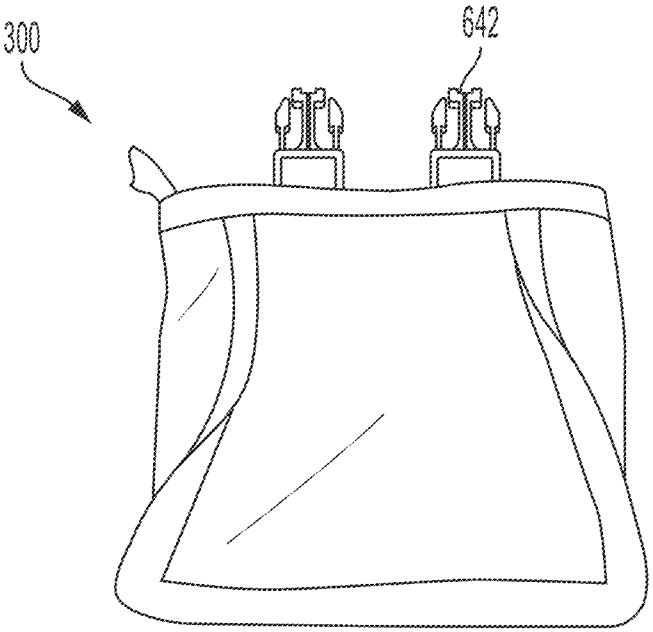
Figure 7B:
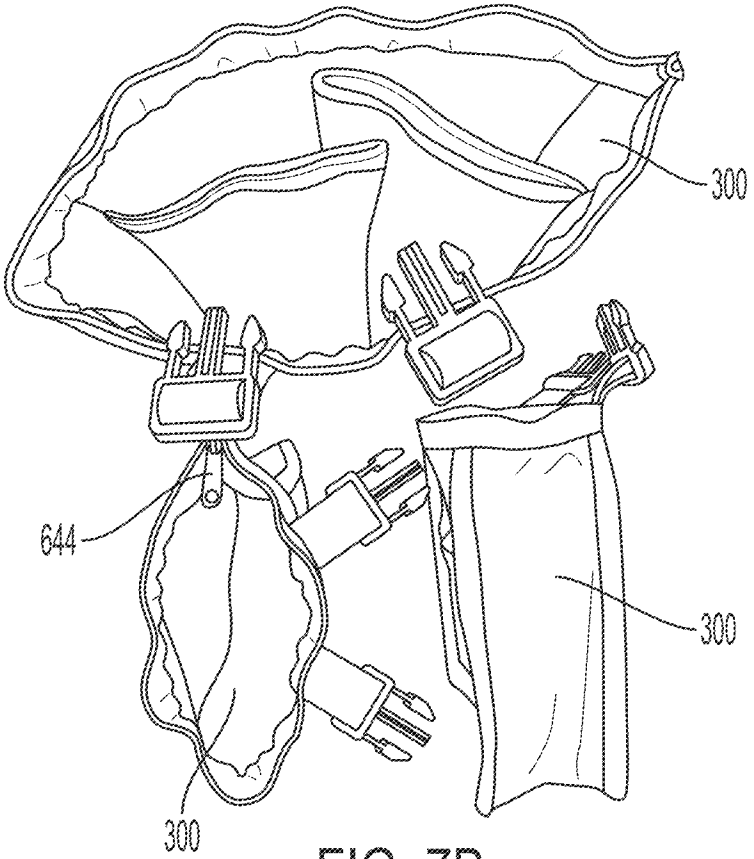
FIGS. 7A and 7B depict different exemplary detachable compartments, according to different embodiments.
Figure 7A:
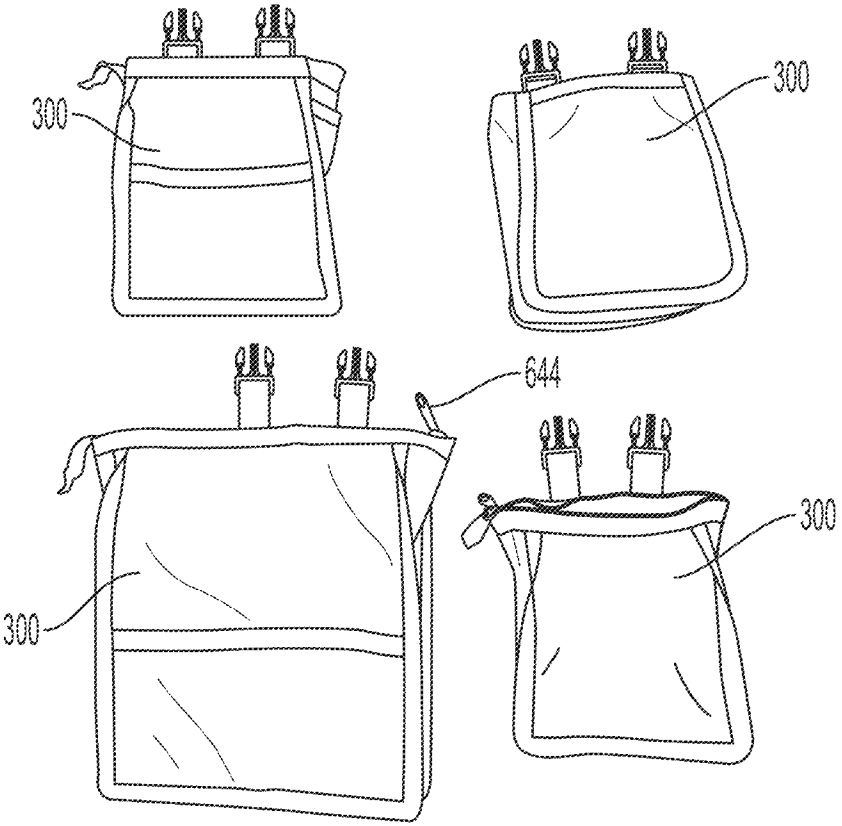
Figure 9C:
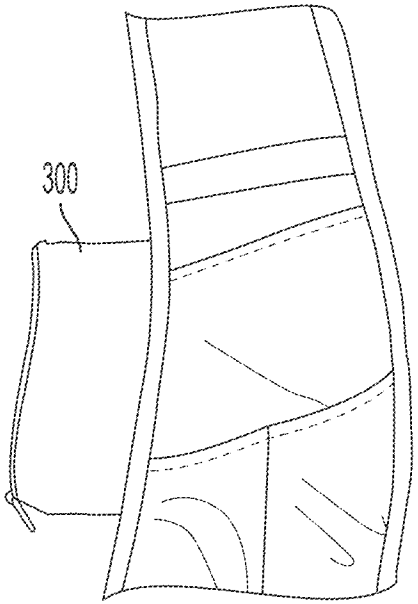
FIGS. 9A-9C depict portions of an exemplary embodiment of a strapvest, including portions of the first main strap and the second main strap, and compartments attached thereto.
Figure 9B:
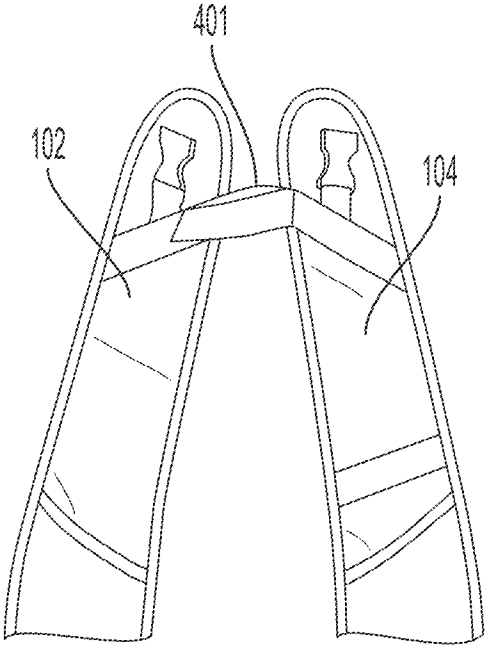
Figure 9A:
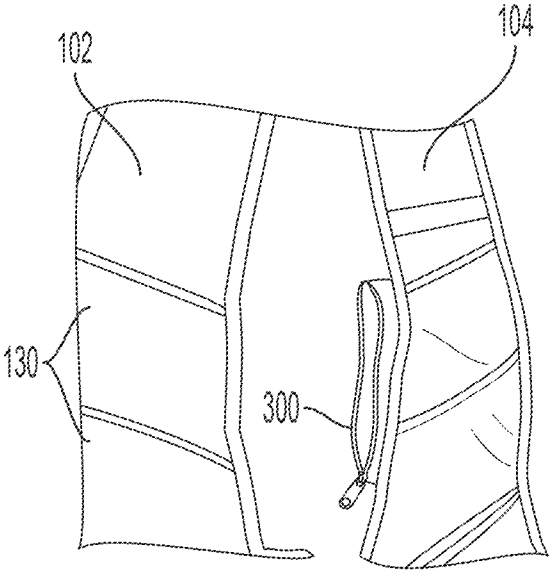
Figure 11B:
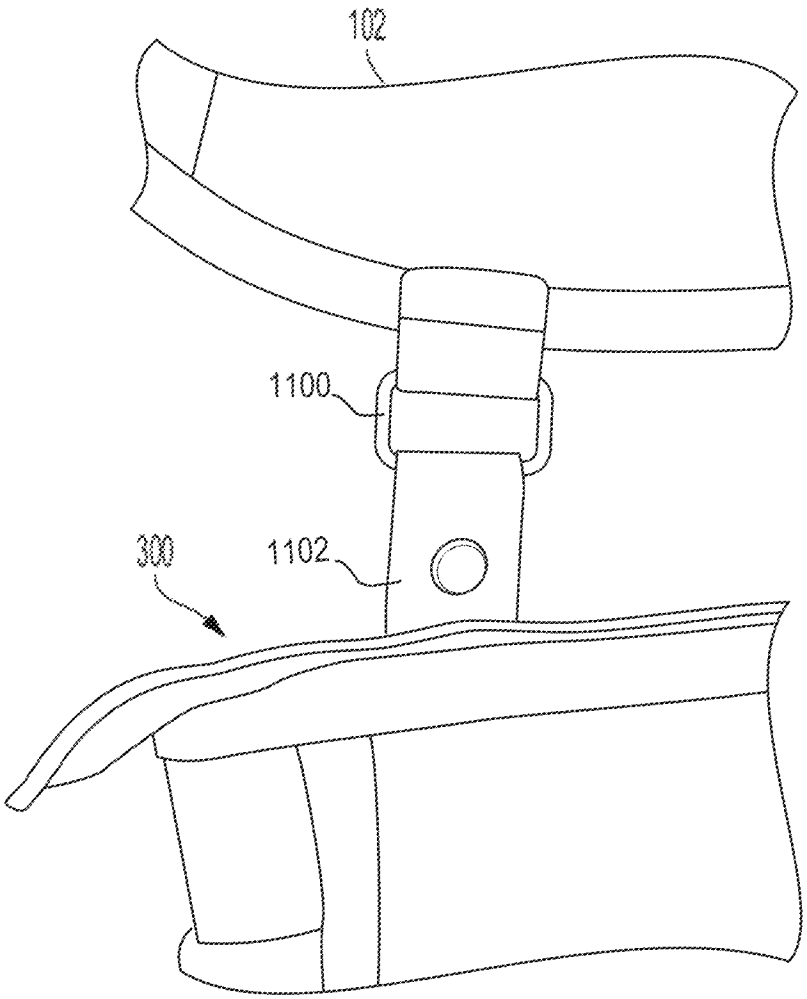
FIGS. 11A-11C depict exemplary detachable compartments that include a snap closure as an exemplary attachment mechanism for removable attachment, which can optionally be reversible.
Figure 11A:
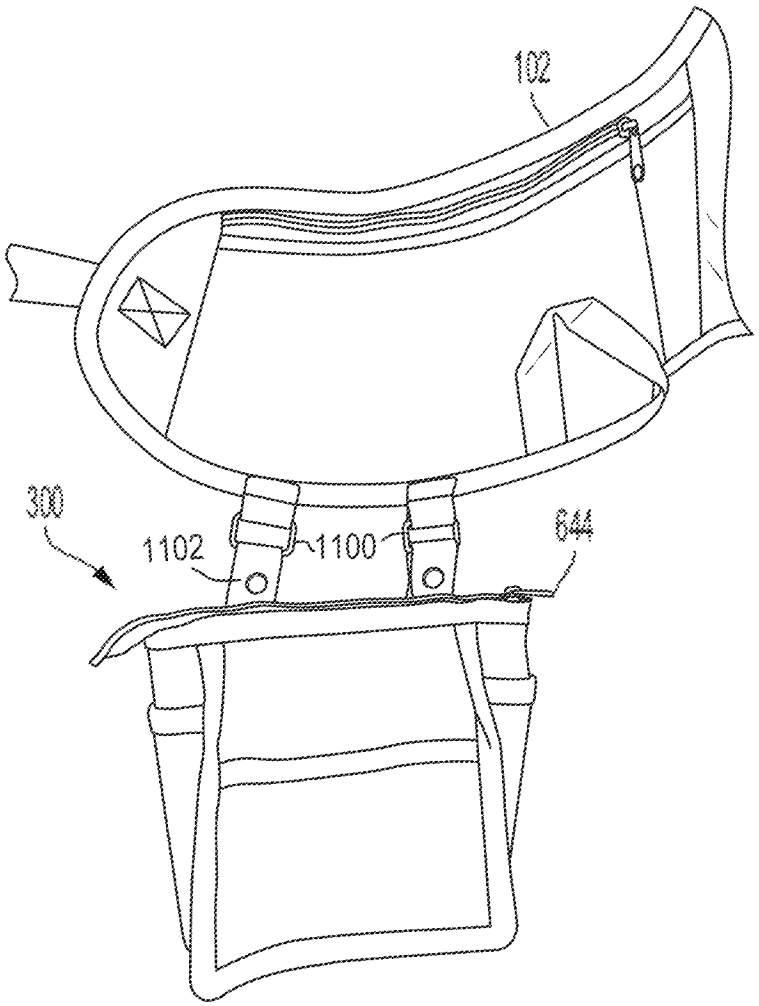
Figure 11C:
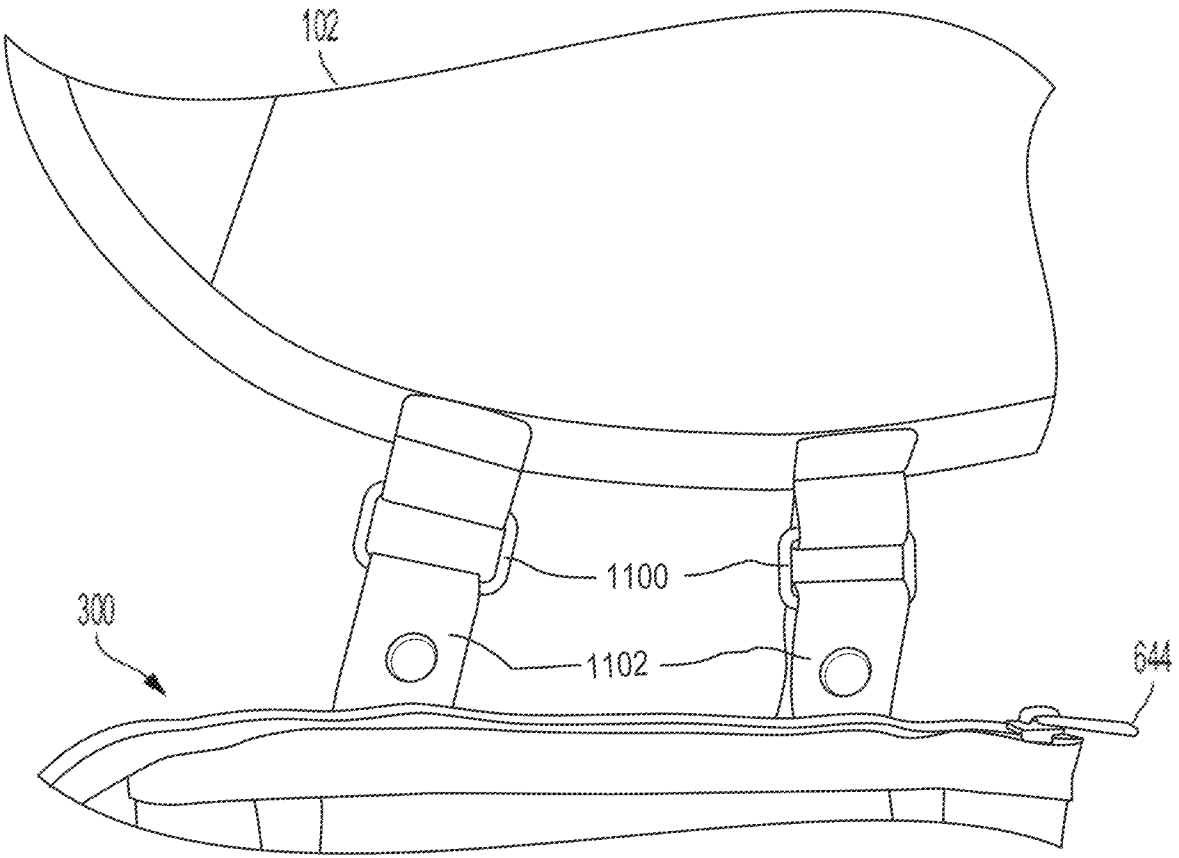

In some embodiments, the strapvest comprises one or more detachable compartments removably attached to the first main strap and/or the second main strap. In some embodiments, at least one of the one or more compartments is a detachable compartment 300, such as shown in FIGS. 6A, 6C, 9A, 9C, and 11A-11C. In some embodiments, the detachable compartment is connected to an upper portion (e.g., an upper portion of the torso portion or an portion of the shoulder portion) of a main strap, such as shown in FIGS. 9A and 9C. Another exemplary detachable compartment 300 is shown in FIGS. 6A and 6B, with the front face of the detachable compartment shown in FIG. 6A and the rear face of the detachable compartment shown in FIG. 6B. Additional exemplary detachable compartments are shown in FIG. 7A, which depict the front face of several exemplary detachable compartments of different sizes, and are shown in FIG. 7B, which depict a view from the top side of two detachable compartments and the side view of another detachable compartment. Additional exemplary detachable compartments are shown in FIGS. 11A-11C, which depicts the use of a snap closure, e.g., a snap closure comprising a male connecting feature that is compatible with a female connecting feature for securing the detachable compartment to a buckle connected to a first main strap or a second main strap. Accordingly, in some embodiments, the strapvest, e.g., the first main strap and/or the second main strap, comprises one or more detachable compartments. For instance, the strapvest can include one or more detachable compartments that can be attached or detached depending on the needs of the user. The one or more detachable compartments can be reversibly attached by any suitable reversible attachment mechanism, such as a zipper, a magnet, a buckle, a hook and loop closure, a snap closure, a rotatable pin, a retractable pin, a spring-loaded pin, slider clips, or two-part release clips.

In some embodiments, a compartment, e.g., a detachable compartment, can be connected or attached to another compartment. For instance, in some embodiments, the compartment is a detachable compartment and is attached to, connected to, or otherwise overlaps, in whole or in part, with one or more other compartments. In some embodiments, a detachable compartment is connected to, or overlaps with, the first main strap and/or the second main strap in a location that comprises one or more compartments that are formed by the first main strap and/or the second main strap itself, such as by incorporating openings, slits, straps, or other embodiments of the compartment in the first main strap and/or the second main strap itself, e.g., in the material, e.g., fabric, used to form the first main strap and/or the second main strap. In some embodiments, a detachable compartment is connected to the exterior face of a first main strap and/or a second main strap.

In some embodiments, the one or more detachable compartments can be configured to hold an object, such as a tool or personal item or any other object that is suitable for being held by the detachable compartment and, thus, is not limited.

In some embodiments, a detachable compartment comprises one or more securing features, e.g., loops, straps, hooks, clips, e.g., releasable clips (e.g., two-part release clips), or internal pockets, within the interior of the detachable compartment, such as depicted in FIG. 7B, top detachable compartment. The one or more securing features, e.g., loops, straps, hooks, clips, e.g., releasable clips (e.g., two-part release clips), or internal pockets, can secure a tool or personal item within the detachable compartment. In some embodiments, the one or more securing features is releasable, such that the detachable compartment can be released from the strapvest.

In some embodiments, the one or more detachable compartments comprises at least one detachable compartment on the torso portion of the first main strap and/or the second main strap. In some embodiments, the one or more detachable compartments comprises at least one detachable compartment on the left side portion of the second main strap and/or the right side portion of the first main strap. In some embodiments, the one or more detachable compartments comprises at least one detachable compartment on the shoulder portion of the first main strap and/or the second main strap. In some embodiments, the one or more detachable compartments comprises at least one detachable compartment on the torso portion of the first main strap and/or the second main strap, at least one detachable compartment on the left side portion of the second main strap and/or the right side portion of the first main strap, and at least one detachable compartment on the shoulder portion of the first main strap and/or the second main strap. For instance, as depicted in FIGS. 9A and 9C, a detachable compartment 300 can, in some embodiments, be attached to the interior face of a strapvest, e.g., the interior face of a first main strap and/or a second main strap. In some embodiments, the detachable compartment that is attached to the interior face of the strapvest, e.g., the interior face of a first main strap and/or a second main strap, and can be protruded outward, such as depicted by the protruding pocket of FIG. 9A (hidden by the main strap on the interior face) and FIG. 9C (protruded outward for accessibility), or as depicted by the protruding pocket of FIG. 8A (protruding outward for accessibility) and FIG. 8B (secured to the main strap by hook and loop fasteners).

In some embodiments, the one or more detachable compartments comprises at least one detachable compartment on the torso portion of the first main strap and/or the second main strap. In some embodiments, the one or more detachable compartments comprises at least one detachable compartment on the left side portion of the second main strap and/or the right side portion of the first main strap. In some embodiments, the one or more detachable compartments comprises at least one detachable compartment on the shoulder portion of the first main strap and/or the second main strap. In some embodiments, the one or more detachable compartments is removably attached by at least one of a zipper, a magnet, a buckle, a hook and loop closure, a snap closure, a rotatable pin, a retractable pin, a spring-loaded pin, slider clips, or two-part release clips, or a combination thereof. In some embodiments, each of the one or more detachable compartments is, independently, removably attached by at least one of a zipper, a magnet, a buckle, a hook and loop closure, a snap closure, a rotatable pin, a retractable pin, a spring-loaded pin, slider clips, or two-part release clips, or a combination thereof.

In some embodiments, the first main strap and/or the second main strap comprises a loop 1100. In some embodiments, the first main strap and/or the second main strap comprises a loop 1100 that a snap closure 1102 of a detachable compartment is reversibly connected to, such as depicted in FIGS. 11A-11C. In some embodiments, the loop 1100 is a D-ring, rectangular ring (such as depicted in FIGS. 11A-11C), a webbing loop, a buckle, or any other loop feature that is compatible with connecting to a snap closure 1102 of a detachable compartment. In some embodiments, the loop can be of any shape, such as a square, a rectangle, a D-shape, a circle, an oval.

In some embodiments, the first main strap and/or the second main strap comprises an upper release mechanism removably attached to an upper portion of the detachable compartment and a lower release mechanism removably attachable to a lower portion of the detachable compartment, and wherein the one or more detachable compartments are removably attachable to the first main strap and/or the second main strap by the upper release mechanism and the lower release mechanism. In some embodiments, the first main strap and/or the second main strap comprises an upper release mechanism removably attachable to an upper portion of the detachable compartment and/or a lower release mechanism removably attachable to a lower portion of the detachable compartment, and wherein the one or more detachable compartments are removably attachable to the first main strap and/or the second main strap by the upper release mechanism and/or the lower release mechanism.

In some embodiments, the first main strap and/or the second main strap comprises one or more strap-side attachment mechanisms, and the one or more detachable compartments comprise one or more compartment-side attachment mechanisms. In some embodiments, each of the one or more strap-side attachment mechanisms is adapted to reversibly attach to one or more of the compartment-side attachment mechanisms. In some embodiments: (i) the one or more strap-side attachment mechanisms is a hook-compatible loop closure, and the one or more compartment-side attachment mechanisms is a loop-compatible hook closure; or (ii) the one or more strap-side attachment mechanisms is a loop-compatible hook closure, and the one or more compartment-side attachment mechanisms is a hook-compatible loop closure; or (iii) the one or more strap-side attachment mechanisms is a stud-compatible socket, and the one or more compartment-side attachment mechanisms is a socket-compatible stud; or (iv) the one or more strap-side attachment mechanisms is a buckle, and the one or more compartment-side attachment mechanisms is a buckle-compatible strap; or (v) the one or more strap-side attachment mechanisms is a buckle-compatible strap, and the one or more compartment-side attachment mechanisms is a buckle; or (vi) the one or more strap-side attachment mechanisms is a buckle comprising a male end, and the one or more compartment-side attachment mechanisms is a buckle comprising a female end; or (vii) the one or more strap-side attachment mechanisms is a buckle comprising a female end, and the one or more compartment-side attachment mechanisms is a buckle comprising a male end; or (viii) the one or more strap-side attachment mechanisms is a first half zipper, and the one or more compartment-side attachment mechanisms is a second half zipper.

In some embodiments, the one or more detachable compartments 300 are removably attached to the torso portion of the first main strap and/or the second main strap, such as depicted in FIG. 9C. In some embodiments, one or more of the detachable compartments are removably attached to the right side portion of the first main strap; and/or one or more of the detachable compartments are removably attached to the left side portion of the second main strap.

In some embodiments, the torso portion of the first main strap and the torso portion of the second main strap are parallel or substantially parallel, or comprise at least a portion of the torso portions, e.g., at least 25%, 50%, or 75%, or a value between any of the foregoing, that are parallel or substantially parallel with one another, such as depicted in FIGS. 1A, 1B, 3A, 3B, 4A-C, 8A, 8B, and 10A-C. For instance, in some embodiments, the torso portion of the first main strap and the torso portion of the second main strap are parallel or substantially parallel, such that a plane of the torso portion of the second main strap and a plane of the torso portion of the first main strap do not intersect or, if they intersect (e.g., at a closure, such as a single-point closure), the angle created by their intersection is less than 30%, less than 25%, less than 20%, less than 15%, less than 10%, or less than 5%, or a value between any of the foregoing. In some embodiments, between about 25% and 75%, 25% and 60%, 25% and 50%, 25% and 40%, 40% and 75%, 40% and 60%, 40% and 50%, 50% and 75%, or 50% and 60%, of the first main strap and the torso portion of the second main strap are parallel or substantially parallel with one another.

Figure 8B:
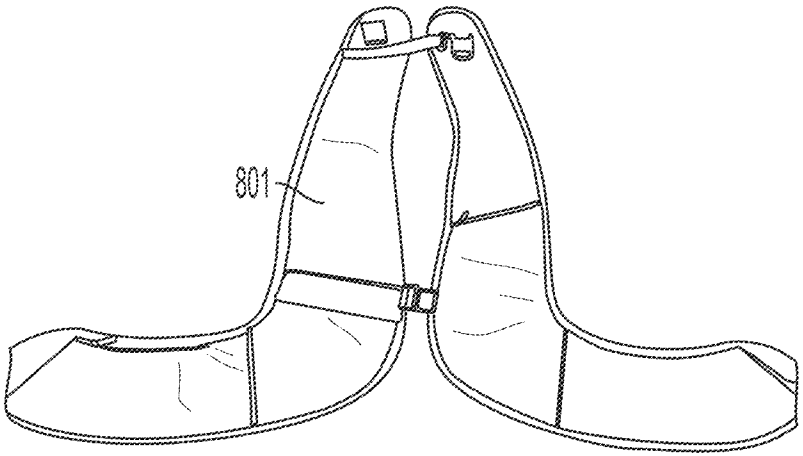
FIGS. 8A and 8B depict an exemplary embodiment of a strapvest that includes a protruding pocket that has been opened outward (FIG. 8A) or has been closed inward and is against the main strap by the closing feature 802 that is depicted as a hook-and-loop closure (FIG. 8B).
Figure 8A:
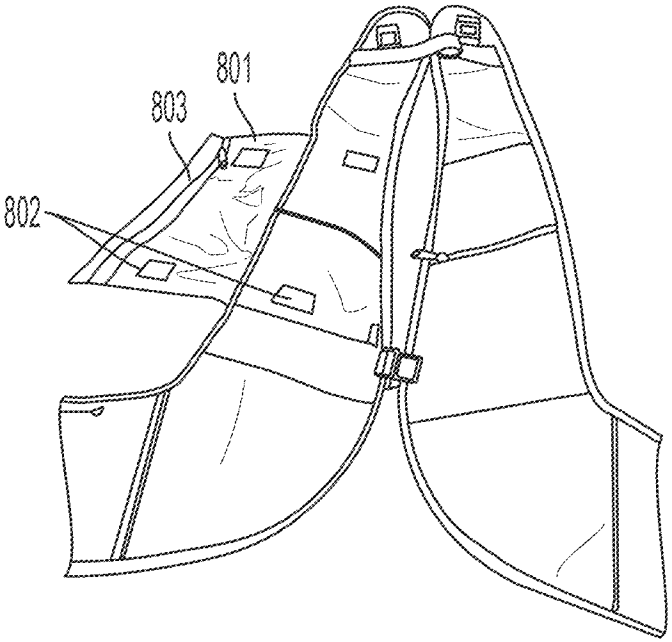

In some embodiments, the first main strap comprises a juncture where the torso portion and the right side portion intersect; and/or the second main strap comprises a juncture where the torso portion and the left side portion intersect. The junction results in an angle between the torso portion and the left side or right side portion, such as depicted by 301 of FIG. 3A. In some embodiments, the junction results in a curved or semi-curved J-shape, such as depicted in FIGS. 1A, 1B, 2A, 2B, 3A, 3B, 8A, and 8B. In some embodiments, the junction results in an angle that ranges from 35 degrees to 150 degrees, or from about 35 degrees to about 150 degrees, including a range between any two values in between. For instance, in some embodiments, the junction results in an angle that is or is about 35 degrees, 40 degrees, 45 degrees, 50 degrees, 55 degrees, 60 degrees, 65 degrees, 70 degrees, 75 degrees, 80 degrees, 85 degrees, 90 degrees, 95 degrees, 100 degrees, 105 degrees, 110 degrees, 115 degrees, 120 degrees, 125 degrees, 130 degrees, 135 degrees, 140 degrees, 145 degrees, or 150 degrees, or a value between any of the foregoing. In some embodiments, the junction results in an angle that is between or between about 35 degrees and 90 degrees, 35 degrees and 80 degrees, 35 degrees and 70 degrees, 35 degrees and 60 degrees, 35 degrees and 50 degrees, 45 degrees and 90 degrees, 45 degrees and 80 degrees, 45 degrees and 70 degrees, 45 degrees and 60 degrees, 55 degrees and 90 degrees, 55 degrees and 80 degrees, 65 degrees and 90 degrees, 65 degrees and 80 degrees, 80 and 100 degrees, 100 and 120 degrees, or 120 and 150 degrees. In some embodiments, the junction results in an angle that is between or between about 90 degrees and 120 degrees, such as depicted in FIGS. 8A and 8B.

In some embodiments, the torso portion and the right side portion of the first main strap forms a J-shape or a semi-J-shape, and the torso portion and the left side portion of the second main strap forms a reverse J-shape, a reverse semi-J-shape, an L-shape, or a semi-L shape. A reverse J-shape refers to a J-shape that appears as a mirror image of the J-shape. For instance, the curved lower portion of the J-shape curves to the right side of the wearer, whereas the curved lower portion of the reverse J-shape curves to the left s ide of the wearer, thereby having the curved lower portions being in opposite directions from the vertical portion of the J-shape and the reverse J-shape. This is depicted, for instance, in FIGS. 3A, 3B, and 8B. A "semi" J-shape is a shape that resembles a J but may differ with regards to the angle and/or proportion of the curved portion of the J; and a "semi" L shape is a shape that resembles an L but may differ with regards to the angle of the vertical and horizontal segment intersection (e.g., more of less than 90 degrees) and/or the proportion of the vertical and horizontal segments of the "L."

Returning to FIGS. 1A-1B, an exemplary strapvest 100 also includes one or more connecting features 142 for attaching one or more detachable compartments to the first and/or second main straps 102, 104 of the strapvest. In various examples, the one or more connecting feature(s) 142 include at least one of a zipper, a magnet, a buckle, a hook and loop closure, a snap closure, a rotatable pin, a retractable pin, a spring-loaded pin, slider clips, or two-part release clips. In some embodiments, the detachable compartment(s) are removably attachable to the first main strap 102 or the second main strap 104 proximate to the left-side body or the right-side body of the wearer. In other words, one or more of the connecting features 142 is included in a portion of one or more of the first or second main straps 102, 104 that is adapted to run around a right-side body or a left side body of the wearer. However, the connecting features 142 may be included in any portion of the first main strap 102 and the second main strap 104 to permit the attachment of detachable compartments at any desired location along the strapvest 100. For instance, one or more connecting features 142 could be included proximate to the wearer's chest, back, shoulders, waist, or some other location on the first and second main straps 102, 104. In other words, connecting features 142 could be included in portions of the strap(s) adapted to run up over a shoulder of the wearer, or portions that run down a front torso of the wearer. In some embodiments, one or more connecting features 142 are included on one or more of the torso portion of the first main strap and/or the second main strap, on the right side portion, on the left side portion, on the back portion of the first main strap and/or the second main strap, and/or on the shoulder portion of the first main strap and/or the second main strap, or any combination thereof.

FIGS. 6A, 6B, 7A, 7B, and 11A-11C illustrate exemplary detachable compartments 300 that can be removably attached to a strapvest, such as the strapvest 100 of FIG. 1A, 1B, 3A, or 3B. As shown in FIGS. 6A and 6B, in some embodiments, the detachable compartment 300 comprises a connecting feature that comprises a first connecting element 642 that can be mated with a corresponding second connecting element 142, such as the corresponding second connecting element 142 of FIGS. 1A-1B, to attach the detachable compartments to the strapvest 100. In various embodiments, the connecting features could include one or more buckles, zippers, magnets, hook, and loop closures, snap closures, slider clips, or two-part release clips. As seen in FIGS. 6B, 7A, and 7B, a detachable compartment 300 also comprises, in some embodiments, one or more closing features 644 adapted for securing items within the detachable compartment by closing an opening of the compartment using a closing feature 644, such as a zipper as depicted in FIGS. 6B, 7A, and 7B. In some embodiments, the one or more closing features 644 is or comprises a zipper, but other exemplary closing features are contemplated. Accordingly, in some embodiments, the detachable compartment comprises one or more closing features, e.g., one or more closing features adapted for securing items within the detachable compartment by closing an opening of the compartment. In various embodiments, the closing feature 644 is or comprises a zipper, a magnet, a flap closure, a snap closure, a hook and loop closure, or some other mechanism adapted for sealing the compartment 300.

As shown in FIGS. 11A-11C, in some embodiments, the detachable compartment 300 comprises a connecting feature that is a snap closure 1102 comprising a male connecting feature and a female connecting feature that secure the detachable compartment to a loop 1100 of the strapvest, e.g., a loop connected to the first main strap or the second main strap of the strapvest. In some embodiments, the loop 1100 is a D-ring, rectangular ring (such as depicted in FIGS. 11A-11C), a webbing loop, a buckle, or any other loop feature that is compatible with connecting to a snap closure 1102 of a detachable compartment. In some embodiments, the loop can be of any shape, such as a square, a rectangle, a D-shape, a circle, an oval. In some embodiments, the first main strap and/or the second main strap comprises a loop, e.g., a D-ring, rectangular ring, a webbing loop, a buckle, or any other loop feature that is compatible with connecting to a snap closure 1102 of a detachable compartment, and the detachable compartment comprises a snap closure 1102, e.g., a snap closure comprising a male connecting feature and a female connecting feature that is attached to a strap connected to the detachable compartment. In some embodiments, the snap closure 1102 of the detachable compartment attaches the detachable compartment to the loop of the first main strap and/or the second main strap, such as depicted in FIGS. 11A-11C.

In some examples, the detachable compartment 300 is attachable to the strapvest at two or more junctures, e.g., a connecting feature at a top edge of the compartment and a second connecting feature at a bottom edge of the compartment. In such an embodiment, the first main strap and/or the second main strap also comprises two connecting features (e.g., an upper release mechanism removably attachable to an upper portion of the detachable compartment 300 and a lower release mechanism removably attachable to a lower portion of the detachable compartment 300). In some embodiments, the first main strap and/or the second main strap comprises one or more connecting features 642 that removably attach a detachable compartment 300 to the strapvest, such as depicted in FIG. 2B. In some embodiments, one or more detachable compartments 300 are removably attachable to the strap(s) by way of the upper release mechanism and the lower release mechanism. Alternatively, and as shown in FIGS. 6A, 6B, 7A, and 7B, compartment 300 could comprise two connecting features, such as two first connecting elements 642, on the same edge of the compartment, e.g., on the top edge or on the bottom edge of the compartment. By including multiple connecting elements, the detachable compartment can be more securely attached to the strapvest.

Returning to FIGS. 1A and 1B, in some embodiments, the compartment(s) 130 and/or the detachable compartment(s) comprise a compressible foam adapted to secure objects within the compartment(s). In some examples, the compartments are lined with the compressible foam, or comprise one or more compressible foam inserts. In some embodiments, the compressible foam inserts are sized to the approximate area (i.e., a 2-dimensional area) of the compartment, or are shaped to fill an interior (i.e., a 3-dimensional interior volume) of the compartment. In other embodiments, the compressible foam is sized smaller than the interior volume of the compartment(s) 130. For instance, in some embodiments, the compressible foam is shaped as a strip of foam that is positioned adjacent to, e.g., at a top edge or a side edge of the compartment, or some other portion of the compartment. In some embodiments, e.g., where the compartment(s) 130 are formed between layers of the first main strap 102 or the second main strap 104, at least one fabric layer (e.g., the first fabric layer or the second fabric layer) comprises the compressible foam material.

Figure 5:
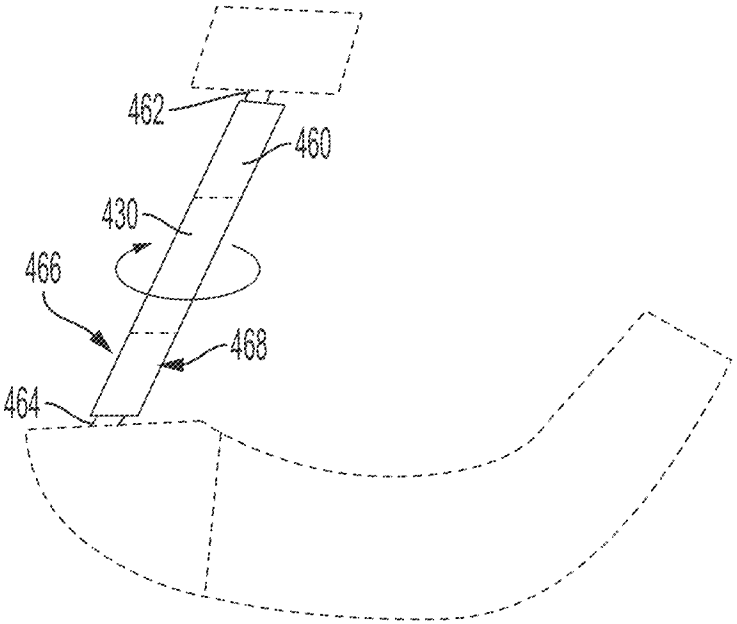
FIG. 5 depicts a reversible portion of an exemplary strapvest that runs across a front torso of a wearer. The reversible portion rotates around its axis, which allows for access to both sides of the reversible portion, e.g., a front side and a back side.

In some embodiments, the strapvest comprises a rotatable portion 460. FIG. 5 provides an illustration of a rotatable portion 460 of a first and/or second main strap of an exemplary strapvest, which can be included in the first main strap 102 and/or the second main strap 104 of the exemplary strapvest 100, such as depicted in FIG. 1A, 1B, 3A, or 3B. For instance, a rotatable portion can be situated on the first main strap 102 and the second main strap 104 of FIG. 1A or FIG. 3A beginning at or approximately at the top of the chest area to the lower chest area. In some embodiments, the rotatable portion is connected to the main strap by a mechanism, e.g., a two-part mechanism with a mechanism where each end of the rotatable portion connects with the main strap, which is mounted to the first and second main strap of the strapvest, as illustrated in FIG. 5. In some embodiments, the rotatable portion is connected to the main strap by a mechanism adapted to allow the rotatable portion to rotate around its axis. In some embodiments, at least part of the torso portion of the first main strap and/or the second main strap is comprised within the rotatable portion.

In some embodiments, the rotatable portion is connected to the first main strap and/or the second main strap at a first juncture 462 and a second juncture 464, wherein the first juncture and the second juncture are located on opposite ends of the rotatable portion, such as depicted in FIG. 5. In some embodiments, the rotatable portion is connected to the first main strap and/or the second main strap at a first juncture at a first end of the rotatable portion and at a second juncture at a second end of the rotatable portion opposite the first end. In some embodiments, the first end of the rotatable portion connects to the shoulder portion of the first main strap and/or the second main strap, and the second end of the rotatable portion connects to the right side portion of the first main strap and/or the second end of the rotatable portion connects to the left side portion of the second main strap. In some embodiments, the first end of the rotatable portion connects to the shoulder portion of the first main strap, and the second end of the rotatable portion connects to the right side portion of the first main strap. In some embodiments, the first end of the rotatable portion connects to the shoulder portion of the second main strap, and the second end of the rotatable portion connects to the left side portion of the second main strap.

In some embodiments, the rotatable portion comprises a first edge extending between the first end and the second end, and a second edge extending between the first end and the second end opposite the first edge, wherein the first edge and the second edge are parallel.

In some embodiments, the rotatable portion comprises a first connecting feature at the first juncture and a second connecting feature at the second juncture. In some embodiments, the rotatable portion is rotatable about an axis between or connecting the first juncture and the second juncture. In some embodiments, the rotatable portion is symmetrical across the axis such that the shape of the first main strap and/or the second main strap is not changed or is not substantially changed by a rotation of the rotatable portion. In some embodiments, the rotation is a 180 degree rotation.

In some embodiments, the first connecting feature and/or the second connecting feature is selected from the group consisting of a rotatable pin, a retractable pin, a spring-loaded pin, a zipper, a magnet, a buckle, a hook and loop closure, a snap closure, slider clips, two-part release clips, or a ball and socket attachment. In some embodiments, the first connecting feature and the second connecting feature are the same.

In some embodiments, the rotatable portion is situated between the shoulder portion and the right side portion of the first main strap; and/or the rotatable portion is situated between the shoulder portion and the left side portion of the second main strap.

In some embodiments, the rotatable portion is connected to the main strap, e.g., the first main strap and/or the second main strap, at the first juncture by a first connecting feature and at the second juncture by a second connecting feature, such as depicted in FIG. 5. The connecting feature is not limited and can, in some embodiments, be any connecting feature adapted to allow the rotatable portion to rotate around its axis such that the interior side and the exterior side can reverse positions while the strapvest is being worn. In some embodiments, the first connecting feature and the second connecting feature are situated on opposite ends of a rod, pin, or other rigid material that passes through or connects the interior of the rotatable portion, and the first connecting feature and the second connecting feature are attached to the first main strap and/or the second main strap. In some embodiments, the first connecting feature and the second connecting feature are situated on opposite ends of a pin that passes through the interior of the rotatable portion or connects the rotatable portion to the first main strap and/or the second main strap, and the first connecting feature and the second connecting feature are attached to the first main strap and/or the second main strap.

In some embodiments, the rotatable portion is rotatable without detaching, disconnecting, or removing the rotatable portion from the strapvest. In some embodiments, the rotatable portion is rotatable by detaching, disconnecting, or removing the rotatable portion from the strapvest and then re-attaching or re-connecting the rotatable portion to the strapvest in a rotated orientation, e.g., by rotating the rotatable portion by 180 degrees on its axis, such that the previous interior side faces the exterior following the rotation and the previous exterior side faces the interior following the rotation. In some embodiments, the rotatable portion is rotatable without disconnecting or detaching the rotatable portion from the first main strap and/or the second main strap. In some embodiments, the rotatable portion is rotatable by disconnecting or detaching the rotatable portion from the first main strap and/or the second main strap and re-connecting or re-attaching the rotatable portion in a rotated configuration. In some embodiments, the rotated configuration is or is about a 180 degree rotation along its axis.

In some embodiments, the rotatable portion comprises one or more compartments. In some embodiments, the rotatable portion comprises an interior side facing inward and an exterior side facing outward, and wherein the interior side of the rotatable portion comprises one or more compartments and/or the exterior side of the rotatable portion comprises one or more compartments. In some embodiments, the interior side of the rotatable portion comprises one or more compartments and the exterior side of the rotatable portion comprises one or more compartments. In some embodiments, the rotatable portion is rotatably connected to the first main strap and/or the second main strap such that the exterior side can be rotated to face inward and the interior side can be rotated to face outward. In some embodiments, the rotatable portion is rotatable at the first juncture and the second juncture such that the exterior side of the rotatable portion can be rotated to face inward and the interior side of the rotatable portion can be rotated to face outward.

As seen in FIG. 5, in some embodiments, the rotatable portion 460 comprises one or more compartments, e.g., pockets, on both an interior (i.e., wearer-facing) side and an exterior (i.e., externally-facing) side of the rotatable portion. For instance, in some embodiments, the rotatable portion 460 of the first main strap and/or the second main strap comprises a compartment that is an exterior compartment 430 accessible from the exterior side of the rotatable portion and a compartment that is an interior compartment (not shown) accessible from the interior side of the rotatable portion. As used herein, an "exterior side" ("interior side") of the rotatable portion can be understood to be that side of the rotatable portion that faces away (faces toward) the wearer when the strapvest is worn. In some embodiments comprising the rotatable portion, the rotatable portion's exterior side can also be an interior side (and vice-versa), such as when the rotatable portion is rotated, e.g., rotated 180 degrees along its axis.

In some embodiments, the first main strap and/or the second main strap comprises one or more compartments, and wherein the rotatable portion comprises at least one of the one or more compartments on the interior side and/or comprises at least one of the one or more compartments on the exterior side. In some embodiments, the first main strap and/or the second main strap comprises one or more compartments, and wherein the rotatable portion comprises at least one of the one or more compartments on the interior side and comprises at least one of the one or more compartments on the exterior side.

In some embodiments, the one or more compartments of the rotatable portion comprise a pocket. In some embodiments, the pocket is a sealable pocket. The sealable pocket can be reversibly sealable by any mechanism. In some embodiments, the sealable pocket is sealable by a zipper or a hook and loop closure. In some embodiments, the sealable pocket is sealable by a zipper. In some embodiments, the pocket is a protruding pocket. In some embodiments, the protruding pocket is irreversibly or permanently connected to the rotatable portion, on one side of the protruding pocket, and is reversibly connected to the rotatable portion, on another side of the protruding pocket by a closing feature. In some embodiments, the protruding pocket comprises a closing feature and is configured to protrude outward from the rotatable portion upon releasing the closing feature. In some embodiments, the protruding pocket is configured to protrude outward in a vertical direction. In some embodiments, the protruding pocket is configured to protrude outward in a horizontal direction. In some embodiments, the closing feature is selected from the group consisting of a zipper, a magnet, a buckle, a hook and loop closure, a snap closure, a rotatable pin, a retractable pin, a spring-loaded pin, slider clips, or two-part release clips, or a combination thereof. In some embodiments, the closing feature is a hook and loop closure. In some embodiments, the closing feature is a magnet. In some embodiments, the pocket is irreversibly or permanently connected to the rotatable portion.

In some embodiments, the one or more compartments of the rotatable portion comprise one or more detachable compartments. In some embodiments, the one or more compartments of the rotatable portion comprise one or more non-detachable compartments. In some embodiments, the one or more compartments comprise one or more detachable compartments and one or more non-detachable compartments. In some embodiments, the one or more detachable compartments is reversibly attached to the rotatable portion by a reversible attachment mechanism selected from the group consisting of a zipper, a magnet, a buckle, a hook and loop closure, a snap closure, slider clips, or two-part release clips, or a combination thereof. In some embodiments, the one or more detachable compartments comprise a detachable pocket.

In some embodiments, the rotatable portion is situated within the torso portion of the first main strap and/or the second main strap, such as depicted in FIG. 5. In some embodiments, the rotatable portion links one part of the torso portion of the first main strap to another part of the torso portion of the first main strap; and/or the rotatable portion links one part of the torso portion of the second main strap to another part of the torso portion of the second main strap.

In some embodiments, the rotatable portion 460 comprises an exterior side and an interior side, and comprises one or more compartments on the exterior side and one or more compartments on the interior side. In some embodiments, the one or more compartments of the exterior side and/or the interior side are incorporated into the rotatable portion, e.g., are formed by the material, e.g., fabric, of the rotatable portion, such as by being sewn into, or added to, the fabric of the rotatable portion and/or sewn to the rotatable portion. In some embodiments, the one or more compartments incorporated into the rotatable portion comprise one or more pockets, such as any of the pockets described herein. In some embodiments, the one or more compartments of the exterior side and/or the interior side are incorporated into the rotatable portion. In some embodiments, the one or more compartments of the exterior side and/or the interior side are incorporated into the rotatable portion by being incorporated into fabric of the rotatable portion and/or by being connected to the rotatable portion. In some embodiments, the incorporation is by being sewn into the fabric of the rotatable portion. In some embodiments, the one or more compartments are incorporated into the rotatable portion by being connected to the rotatable portion by being sewn to the rotatable portion. In some embodiments, the one or more compartments of the exterior side and/or the interior side are incorporated into the rotatable portion. In some embodiments, the one or more compartments of the exterior side and/or the interior side are incorporated into the rotatable portion by being incorporated into fabric of the rotatable portion and/or by being connected to the rotatable portion. In some embodiments, the incorporation is by being sewn into the fabric of the rotatable portion. In some embodiments, the one or more compartments are incorporated into the rotatable portion by being connected to the rotatable portion by being sewn to the rotatable portion.

In some embodiments, the one or more compartments of the exterior side and/or the interior side that are incorporated into the rotatable portion are pockets. In some embodiments, the one or more compartments of the exterior side and/or the interior side are attached to, e.g., reversibly attached to or irreversibly attached to, the rotatable portion. In some embodiments, one or more of the compartments of the exterior side and/or the interior side is a detachable compartment. In some embodiments, the one or more compartments of the rotatable portion are formed from two layers of material, such as two layers of fabric. In some embodiments, the rotatable portion comprises a pocketed portion on the interior side and/or exterior side that comprises one or more compartments that comprise one or more pockets.

The rotatable portion 460, e.g., as depicted in FIG. 5, allows the wearer to utilize both side of the rotatable portion. For instance, in some embodiments, the rotatable portion comprises one or more compartments on opposite sides of the rotatable portion, such as the exterior side that faces outward away from the wearer when the strapvest is worn, and the interior side that faces toward the wearer when the strapvest is worn. This rotatable feature of the rotatable portion of the strapvest is advantageous in several ways. For example, the rotatable portion allows the wearer to access more compartments when they can be included on two sides, e.g., the exterior side and the interior side, than if they are only included on one side, e.g., the exterior side, and the rotatable feature of the rotatable portion allows all of the compartments to be readily accessed by the wearer without needing to remove the strapvest. Instead, the wearer can merely rotate the rotatable portion so that the previous exterior side that was readily accessible by the wearer becomes the new interior side that is less accessible (and more protected), and the previous interior side that was less accessible becomes the new exterior side that is readily accessible by the wearer. Another advantage of the rotatable portion is that it allows the wearer to protect certain objects from the external environment, such as water, e.g., from rain, or dirt, or other debris. For instance, the wearer may choose to place cash or other important paper material, or sensitive devices within a compartment included on the interior side of the rotatable portion when it is raining. Yet another advantage of the rotatable portion is that it allows the wearer to secure values, e.g., cash, wallet, or mobile phone, in the interior side of the rotatable portion so that it is hidden from sight. Another advantage of the rotatable portion is that it allows the wearer to secure certain objects, such as delicate objects, in a compartment on the interior side so that it is secured away from external exposure where the compartment may otherwise make contact with people and/or objects that may damage objects, e.g., delicate objects, contained therein. For instance, a wearer who is a construction worker may choose to place a mobile phone having a large glass screen within a compartment on the interior side in order to protect the large glass screen from being damaged. Other advantages to the rotatable portion can be appreciated by those skilled in the art.

In some embodiments, and as seen in FIG. 5, the rotatable portion 460 of the first main strap and/or the second main strap is reversible, and, optionally, comprises one or more compartments, such as one or more compartments that comprise pockets. For instance, the rotatable portion 460 is rotatable along a central axis of the rotatable portion of the first main strap and/or the second main strap such that the exterior side of the rotatable portion of the first main strap and/or the second main strap can be rotated to face inward toward the wearer and the interior side of the rotatable portion of the first main strap and/or the second main strap is rotatable to face outward from the wearer. In some embodiments, the rotatable portion comprises one or more compartments that is a protruding pocket, such as any of the protruding pockets described herein. In some embodiments, the protruding pocket is comprised on the interior side of the rotatable portion.

In some embodiments, the rotatable portion is not detachable from the strapvest, e.g., the rotatable portion is not detachable from the first main strap and/or the second main strap. By being "not reversibly detachable," it is meant to indicate that the rotatable portion is not intended to be detached from the strapvest and/or is not configured to be detached and re-attached. In some embodiments, the rotatable portion 460 is rotatable without disconnecting the rotatable portion from the first and/or second main strap, e.g., without disconnecting the first connecting feature and/or the second connecting feature of the rotatable portion from the first and second junctures, respectively, of the first and/or the second main strap, such that a wearer of the strapvest can rotate the rotatable portion 460 to readily access either the interior compartments or exterior compartments 430 without removing the strapvest.

Additionally, or alternatively, the rotatable portion 460 is fully removable from the first main strap 102 and/or the second main strap 104, e.g., by disconnecting the first connecting feature and/or the second connecting feature of the rotatable portion from the first and/or the second main strap, such that reversing the rotatable portion 460 involves detaching the rotatable portion from the remainder of the first main strap and/or the second main strap and reattaching the portion in a reversed orientation (i.e., in an orientation that flips the exterior side and the interior side of the rotatable portion 460). For instance, in some embodiments, the rotatable portion is reversibly detachable from the first main strap and/or the second main strap. By being "reversibly detachable," it is meant to indicate that the rotatable portion can be detached and re-attached by the wearer, such as when reversing the orientation of the interior side and the exterior side.

Accordingly, in some embodiments, the rotatable portion comprises a first connecting feature at the first juncture 462 and a second connecting feature at the second juncture 464, such as depicted in FIG. 5, that reversibly attach the rotatable portion to the first main strap and/or the second main strap of the strapvest, wherein the rotatable portion can be attached such that the interior side can be reversed to face the exterior away from the wearer, and the exterior side can be reversed to face the interior toward the wearer. In some embodiments in which the first connecting feature and the second connecting feature reversibly attach the rotatable portion to the first and/or the second main strap of the strapvest, the first connecting feature and the second connecting feature can comprise any connecting feature suitable for reversible attachment, such as by using a rotatable pin, a retractable pin, a spring-loaded pin, a zipper, a magnet, a buckle, a hook and loop closure, a snap closure, slider clips, or two-part release clips, a ball and socket attachment, or by any other reversible connection mechanism. In some embodiments, the connecting feature suitable for reversible attachment can include a feature that is squeezable or inner locking. For instance, in some embodiments, the rotatable portion is connected to the first main strap and/or the second main strap by the use of one or more squeezable or retractable connecting features, e.g., a spring-loaded pin, that reversibly connect the rotatable portion by use of tension, e.g., produced by a spring, such that the rotatable portion can be reversibly attached or detached by applying tension.

In some embodiments, the rotatable portion is separated from the rest of the first main strap and/or the second main strap by two junctures, e.g., a first juncture and a second juncture, that facilitate the reversibility of the portion. For instance, in some embodiments, the rotatable portion is rotatably connected to the first main strap and/or the second main strap by way of a first juncture 462 comprising a first connecting feature at a first end of the rotatable portion 460 and a second juncture 464 comprising a second connecting feature at a second end of the rotatable portion 460 opposite the first end. Additionally, or alternatively, the rotatable portion 460 is removable from the first main strap and/or the second main strap at the first juncture that comprises the first connecting feature and the second juncture that comprises the second connecting feature. Accordingly, the first and the second junctures are formed from connectors, e.g., first and second connecting features, respectively, that allow the rotatable portion 460 to be rotated or, additionally or alternatively, allow the rotatable portion 460 to be detached from the first main strap and/or the second main strap and reattached in a reversed orientation. For instance, in some embodiments, the first and second junctures comprise a first and second connecting feature, respectively, that comprises at least one of, e.g., a rotatable pin, a retractable pin, a spring-loaded pin, a zipper, a magnet, a buckle, a hook and loop closure, a snap closure, slider clips, two-part release clips, or a ball and socket attachment.

In some embodiments, the rotatable portion 460 is rotatable without changing or substantially changing the overall shape of the first main strap and/or the second main strap and/or the strapvest as a whole. For instance, in some embodiments, the rotatable portion 460 is straight and non-curved, or is symmetrical across a central axis of the portion (e.g., a central axis extending through the first juncture 462 comprising a first connecting feature, and the second juncture 464 comprising a second connecting feature, about which the portion is rotatable). As used herein, a strap portion is symmetrical when it can be rotated without interfering with the non-rotated portions of the strap. In a particular embodiment, the rotatable portion 460 defines a first edge 466 extending between the first end and the second end, and a second edge 468 extending between the first end and the second end opposite the first edge. In such embodiments, the first edge 466 and the second edge 468 are parallel and/or parallel and approximately linear. However, in other embodiments, the rotatable portion 460 has a non-linear or non-symmetrical shape, and rotating the rotatable portion 460 alters the shape of the first main strap and/or the second main strap and/or the strapvest as a whole. For instance, in some embodiments, rotating the rotatable portion alters the shape of the shoulder portion and the torso portion of the first main strap and/or the second main strap. In some embodiments, rotating the rotatable portion alters the shape of the right side portion and the torso portion of the first main strap; and/or alters the shape of the left side portion and the torso portion of the second main strap.

In some embodiments, the first main strap and/or the second main strap, or the rotatable portion of the first main strap and/or the second main strap, comprises one or more compartments comprising a pocket that is a protruding pocket 801. In some embodiments, the first main strap and/or the second main strap, or the rotatable portion of the first main strap and/or the second main strap, comprises one or more compartments that is a protruding pocket 801. A protruding pocket 801 is a pocket that is capable of protruding outward from the strapvest, e.g., the first main strap and/or the second main strap of the strapvest, upon releasing one or more fasteners of the protruding pocket. For instance, as shown in FIG. 8A, the strapvest can comprise, in some embodiments, a protruding pocket that opens, folds, or protrudes outward upon releasing the protruding pocket. In some embodiments, the protruding pocket is releasable by hook-and-loop fasteners, a zipper, a magnet, a buckle, a snap closure, slider clips, or two-part release clips.

As shown in FIG. 8A, upon opening the protruding pocket outward away from the strapvest, the protruding pocket can be opened using a zipper that is accessible on the previously interior facing side of the protruding pocket that is now exterior facing. This allows for advantages including, for instance, securing items, e.g., important documents, licenses, cash, etc., that is hidden from sight, such as shown in FIG. 8B; and providing for a protruding pocket in addition to an additional pocket attached to the first main strap and/or second main strap beneath the protruding pocket that becomes accessible upon opening the protruding pocket outward. Accordingly, in some embodiments, the protruding pocket is configured to protrude outward from the strapvest, e.g., the first main strap and/or the second main strap of the strapvest, upon releasing one or more fasteners of the protruding pocket.

In some embodiments, the protruding pocket is irreversibly or permanently connected to the first main strap and/or the second main strap on one side of the protruding pocket, and is reversibly connected to main strap on another side, e.g., on a side opposite the side that is irreversibly or permanently connected, by a closing feature. In some embodiments, the closing feature is selected from the group consisting of a zipper, a magnet, a buckle, a hook and loop closure, a snap closure, a rotatable pin, a retractable pin, a spring-loaded pin, slider clips, or two-part release clips, or a combination thereof. In some embodiments, the protruding pocket is irreversibly or permanently connected to the side of the protruding pocket, and is reversibly connected to the first main strap and/or the second main strap on another side, e.g., on a side opposite the side that is irreversibly or permanently connected, by a closing feature 802, such as a hook-and-loop closure, such as shown in FIG. 8A. The closing feature can be any closing feature suitable for reversibly connecting the protruding pocket to the first and/or second main strap. In some embodiments, the closing feature is a hook and loop closure, a magnet, or a snap closure.

In some embodiments, the protruding pocket is a sealable pocket. In some embodiments, the protruding pocket is sealable using a sealing feature 803, such as the zipper depicted in FIG. 8A.

In some embodiments, the rotatable portion of the first main strap and/or the second main strap comprises one or more compartments that is a protruding pocket.

The protruding pocket can be comprised anywhere on the strapvest, e.g., anywhere on the first main strap and/or the second main strap. In some embodiments, a protruding pocket is comprised on the torso portion (e.g., is comprised on a portion over a shoulder area, waist area, lower stomach area, or back area of the torso portion) of the first main strap and/or a protruding pocket is comprised on the torso portion (e.g., is comprised on a portion over a shoulder area, waist area, lower stomach area, or back area of the torso portion) of the second main strap. In some embodiments, the protruding pocket is comprised on an upper part of the torso portion of the first main strap and/or the second main strap. In some embodiments, the protruding pocket is comprised on a lower part of the torso portion of the first main strap and/or the second main strap. In some embodiments, the protruding pocket is comprised on the right side portion and/or the left side portion.

In some embodiments, the protruding pocket opens horizontally, e.g., from left to right or from right to left. In some embodiments, the protruding pocket opens vertically, e.g., from top to bottom or from bottom to top. In some embodiments, the protruding pocket is configured to protrude outward in a vertical direction, e.g., from top to bottom or from bottom to top. In some embodiments, the protruding pocket is configured to protrude outward in a horizontal direction, e.g., from left to right or from right to left.

In some embodiments, the protruding pocket opens horizontally after reversibly opening the protruding pocket using a closing feature on two or more sides of the protruding pocket. In some embodiments, the closing feature is a single closing feature that spans two sides of the protruding pocket. In some embodiments, the closing feature is a zipper that runs along two or more sides of the protruding pocket.

In some embodiments, the first main strap and/or the second main strap, or the rotatable portion of the first main strap and/or the second main strap, comprises one or more compartments comprising a pocket that is a sealable pocket 1002. In some embodiments, the sealable pocket is sealable using a sealing feature. In some embodiments, the sealing feature is a zipper or a hook-and-loop closure. In some embodiments, the sealable pocket is sealable using a zipper, such as depicted in FIGS. 10A-10C. In some embodiments, the sealable pocket comprises a zipper that runs vertically or substantially vertically along the first main strap and/or the second main strap, or the rotatable portion of the first main strap and/or the second main strap, such as depicted in FIG. 10A. In some embodiments, the sealable pocket comprises a zipper that runs horizontally or substantially horizontally along the first main strap and/or the second main strap, or the rotatable portion of the first main strap and/or the second main strap, such as depicted in FIGS. 10B and 10C. In some embodiments, the sealable pocket comprises a zipper that runs in a curved shape or in both a vertical (or substantially vertical) and a horizontal (or substantially horizonal) direction on the first main strap and/or the second main strap.

In some embodiments, the zipper runs along the length of the first main strap and/or the second main strap of the strapvest from the shoulder portion, or the portion corresponding to the upper chest area when worn by the wearer, down to where the two straps connect at the closure. When this zipper is open it will allow the user to have access to the interior of the pockets for securing items, and when the zipper is closed the pocket(s) will be sealed up from having access to the interior, thereby securing the items so that they are not lost or damaged. In some embodiments, the zipper will originate on the outer side of a first and/or second main strap traveling horizontally and curve into a downward vertical direction stopping before the closure area where the first and second main straps of the strapvest connect, such as depicted by the white angled line in FIG. 10B.

In some embodiments, the one or more compartments comprises a compartment that is both a protruding pocket and a sealable pocket.

In some embodiments, the torso portion and the right side portion of the first main strap forms a J-shape or a semi-J shape, and the torso portion and the left side portion of the second main strap forms a reverse J-shape, a semi-reverse J-shape, an L-shape, or a semi-L shape.

The foregoing description is presented to enable a person of ordinary skill in the art to make and use the various embodiments disclosed herein. Descriptions of specific devices, techniques, and applications are provided only as examples. Various modifications to the examples described herein will be readily apparent to those of ordinary skill in the art, and the general principles described herein may be applied to other examples and applications without departing from the spirit and scope of the various embodiments. Thus, the various embodiments are not intended to be limited to the examples described herein and shown, but are to be accorded the scope consistent with the claims.

It should be noted that the elements and features of the exemplary strapvests illustrated in FIGS. 1A-1B, 2, 3A-3B, 4A, 4B, 5, 6A, 6B, 7A, 7B, 8A, 8B, 9A-9C, and 10A-10C may be rearranged, recombined, and modified without departing from the present disclosure. For instance, while FIGS. 1A-3B, 4A-5, and 8A-10C illustrate exemplary strap portions of a strapvest, including exemplary compartments, a strapvest may have a variety of strap configurations and compartments, and the placement and design of the straps and compartments can be modified and/or interchangeable without departing from the scope of the present disclosure.

Further, as used herein, "and/or" should be construed broadly and without limitation to a particular quantity, proportion, or grouping of elements. For instance, an embodiment including elements "A and/or B" could include, without limitation, only element A (in any desired quantity), only element B (in any desired quantity), both elements A and B (in any desired quantities and relative proportions), or, in some cases, neither A or B. Furthermore, the descriptors "one or more" element, "at least one" element, "a variety" or "a plurality" of elements, and the like indicate that there is at least one of the elements, but there could be any number of the elements so described. Further, the inclusion of "one or more", "at least one", "a variety", "a plurality", and like descriptors before certain elements should not be construed to mean that elements lacking such descriptors only exist in a quantity of one. Accordingly, elements of the embodiments described herein may be included in any desired quantity without departing from the scope of the present disclosure.

It will be understood that the foregoing is only illustrative of the general principles of the strapvest, and that various modifications, alterations and combinations can be made by those skilled in the art without departing from the scope and spirit of the disclosure. Any of the variations of the various strapvests disclosed herein can include features described by any other strapvest or combination of strapvests herein. Accordingly, it is not intended that the disclosure be limited.

EXEMPLARY EMBODIMENTS

Among the provided embodiments are:

1. A strapvest comprising:
   a first main strap comprising an exterior face adapted to face outward from a wearer and an interior face opposite the exterior face, wherein the first main strap comprises a shoulder portion adapted to run up over a shoulder of the wearer, a torso portion adapted to run down a front torso of the wearer, a right side portion adapted to run around a right-side body of the wearer, and a back portion adapted to run up a back of the wearer; and
   a second main strap comprising an exterior face adapted to face outward from the wearer and an interior face opposite the exterior face, wherein the second main strap comprises a shoulder portion adapted to run up over another shoulder of the wearer, a torso portion adapted to run down the front torso of the wearer, a left side portion adapted to run around a left side body of the wearer, and a back portion adapted to run up the back of the wearer.
2. A strapvest comprising:
   a first main strap comprising an exterior face adapted to face outward from a wearer and an interior face opposite the exterior face, wherein the first main strap comprises a shoulder portion adapted to run up over a shoulder of the wearer, and a torso portion adapted to run down a front torso of the wearer; and
   a second main strap comprising an exterior face adapted to face outward from the wearer and an interior face opposite the exterior face, wherein the second main strap comprises a shoulder portion adapted to run up over another shoulder of the wearer, and a torso portion adapted to run down the front torso of the wearer;
   wherein the shoulder portion of the first main strap and the shoulder portion of the second main strap are connected.

3. The strapvest of embodiment 2, wherein the shoulder portion of the first main strap and the shoulder portion of the second main strap are connected by a strap.

4. The strapvest of embodiment 3, wherein the strap connecting the shoulder portion of the first main strap and the shoulder portion of the second main strap passes behind a wearer's neck when the strapvest is worn by the wearer.

5. The strapvest of embodiment 3 or embodiment 4, wherein the strap connecting the shoulder portion of the first main strap and the shoulder portion of the second main strap has a weight of at least 1, 2, 3, 4, 5, 6, 7, 8, 9, 10, 11, 12, 13, 14, or 15 pounds.

6. The strapvest of any one of embodiments 3-5, wherein the strap connecting the shoulder portion of the first main strap and the shoulder portion of the second main strap comprises a weighted compartment configured to contain one or more weight elements.

7. The strapvest of any one of embodiments 3-5, wherein the strap connecting the shoulder portion of the first main strap and the shoulder portion of the second main strap comprises an attachment mechanism for reversibly connecting one or more weight elements.

8. The strapvest of any one of embodiments 1-7, further comprising an adjustable support strap connected to the first main strap and/or the second main strap.

9. The strapvest of embodiment 8, wherein the adjustable support strap comprises a first strap connected to the first main strap and a second strap connected to the second main strap, wherein the first strap and the second strap each comprise a reversible attachment mechanism that is complementary to one another.

10. The strapvest of embodiment 9, wherein the first strap is connected to the first main strap at or near the bottom of the torso portion of the first main strap; and the second strap is connected to the second main strap at or near the bottom of the torso portion of the second main strap.

11. The strapvest of embodiment 9 or embodiment 10, wherein the first strap is connected to the first main strap within 6 inches, 4 inches, or 2 inches of the bottom of the torso portion of the first main strap; and the second strap is connected to the second main strap within 6 inches, 4 inches, or 2 inches of the bottom of the torso portion of the second main strap.

12. The strapvest of any one of embodiments 9-11, wherein the reversible attachment mechanism is a buckle, a hook and loop closure, a magnet, or a snap closure.

13. The strapvest of any one of embodiments 9-12, wherein the reversible attachment mechanism is a buckle, wherein the first strap comprise a male end of the buckle, and the second strap comprise a female end of the buckle; or the first strap comprise a female end of the buckle, and the second strap comprise a male end of the buckle.

14. The strapvest of any one of embodiments 9-12, wherein the reversible attachment mechanism is a hook and loop closure, wherein the first strap comprise a hook-compatible loop of the hook and loop closure, and the second strap comprise loop-compatible hook of the hook and loop closure; or the first strap comprise a loop-compatible hook of the hook and loop closure, and the second strap comprise hook-compatible loop of the hook and loop closure.

15. The strapvest of any one of embodiments 1-14, wherein the first main strap and/or the second main strap comprises a rotatable portion.

16. The strapvest of any one of embodiments 1-15, wherein the torso portion of the first main strap and/or the second main strap comprises a rotatable portion.

17. The strapvest of embodiment 15 or embodiment 16, wherein at least part of the torso portion of the first main strap and/or the second main strap is comprised within the rotatable portion.

18. The strapvest of any one of embodiments 15-17, wherein the rotatable portion is situated between the shoulder portion and the right side portion of the first main strap; and/or the rotatable portion is situated between the shoulder portion and the left side portion of the second main strap.

19. The strapvest of any one of embodiments 15-18, wherein the rotatable portion is connected to the first main strap and/or the second main strap at a first juncture at a first end of the rotatable portion and at a second juncture at a second end of the rotatable portion opposite the first end, optionally wherein the first end of the rotatable portion connects to the shoulder portion of the first main strap and/or the second main strap, and the second end of the rotatable portion connects to the right side portion of the first main strap and/or the second end of the rotatable portion connects to the left side portion of the second main strap.

20. The strapvest of embodiment 19, wherein the rotatable portion comprises a first connecting feature at the first juncture and a second connecting feature at the second juncture.

21. The strapvest of embodiment 20, wherein the first connecting feature and/or the second connecting feature is selected from the group consisting of a rotatable pin, a retractable pin, a spring-loaded pin, a zipper, a magnet, a buckle, a hook and loop closure, a snap closure, slider clips, two-part release clips, and a ball and socket attachment.

22. The strapvest of any one of embodiments 15-21, wherein the rotatable portion is not detachable from the first main strap and/or the second main strap.

23. The strapvest of any one of embodiments 15-21, wherein the rotatable portion is reversibly detachable from the first main strap and/or the second main strap.

24. The strapvest of any one of embodiments 15-23, wherein the rotatable portion comprises one or more compartments.

25. The strapvest of any one of embodiments 15-24, wherein the rotatable portion comprises an interior side facing inward and an exterior side facing outward, and wherein the interior side of the rotatable portion comprises one or more compartments and/or the exterior side of the rotatable portion comprises one or more compartments.

26. The strapvest of embodiment 25, wherein the interior side of the rotatable portion comprises one or more compartments and the exterior side of the rotatable portion comprises one or more compartments.

27. The strapvest of embodiment 25 or embodiment 26, wherein the rotatable portion is rotatably connected to the first main strap and/or the second main strap such that the exterior side can be rotated to face inward and the interior side can be rotated to face outward.

28. The strapvest of any one of embodiments 25-27, wherein the rotatable portion is rotatable at the first juncture and the second juncture such that the exterior side of the rotatable portion can be rotated to face inward and the interior side of the rotatable portion can be rotated to face outward.

29. The strapvest of any one of embodiments 1-28, wherein the first main strap comprises an adjustable and/or reversible closure that reversibly connects an upper part of the torso portion of the first main strap to a lower portion of the torso portion of the first main strap; and/or the second main strap comprises an adjustable and/or reversible closure that reversibly connects an upper part of the torso portion of the second main strap to a lower portion of the torso portion of the second main strap.

30. The strapvest of any one of embodiments 15-29, wherein the rotatable portion comprises one or more compartments.

31. The strapvest of embodiment 30, wherein the one or more compartments comprise a pocket.

32. The strapvest of embodiment 31, wherein the pocket is a sealable pocket.

33. The strapvest of embodiment 32, wherein the sealable pocket is sealable by a zipper or a hook and loop closure.

34. The strapvest of embodiment 32 or embodiment 33, wherein the sealable pocket is sealable by a zipper.

35. The strapvest of embodiment 31, wherein the pocket is a protruding pocket.

36. The strapvest of embodiment 35, wherein the protruding pocket is irreversibly or permanently connected to the rotatable portion, on one side of the protruding pocket, and is reversibly connected to the rotatable portion, on another side of the protruding pocket by a closing feature.

37. The strapvest of embodiment 35 or embodiment 36, wherein the protruding pocket comprises a closing feature and is configured to protrude outward from the rotatable portion upon releasing the closing feature.

38. The strapvest of embodiment 37, wherein the protruding pocket is configured to protrude outward in a vertical direction.

39. The strapvest of embodiment 37, wherein the protruding pocket is configured to protrude outward in a horizontal direction.

40. The strapvest of any one of embodiments 36-39, wherein the closing feature is selected from the group consisting of a zipper, a magnet, a buckle, a hook and loop closure, a snap closure, a rotatable pin, a retractable pin, a spring-loaded pin, slider clips, or two-part release clips, or a combination thereof.

41. The strapvest of any one of embodiments 36-40, wherein the closing feature is a hook and loop closure.

42. The strapvest of any one of embodiments 36-40, wherein the closing feature is a magnet.

43. The strapvest of any one of embodiments 31-42, wherein the pocket is irreversibly or permanently connected to the rotatable portion.

44. The strapvest of any one of embodiments 30-43, wherein the one or more compartments comprise one or more detachable compartments.

45. The strapvest of any one of embodiments 30-44, wherein the one or more compartments comprise one or more non-detachable compartments.

46. The strapvest of any one of embodiments 30-45, wherein the one or more compartments comprise one or more detachable compartments and one or more non-detachable compartments.

47. The strapvest of any one of embodiments 44-46, wherein the one or more detachable compartments is reversibly attached to the rotatable portion by a reversible attachment mechanism selected from the group consisting of a zipper, a magnet, a buckle, a hook and loop closure, a snap closure, slider clips, or two-part release clips, or a combination thereof.

48. The strapvest of any one of embodiments 44-47, wherein the one or more detachable compartments comprise a detachable pocket.

49. The strapvest of any of embodiments 15-48, wherein the rotatable portion comprises a first edge extending between the first end and the second end, and a second edge extending between the first end and the second end opposite the first edge, wherein the first edge and the second edge are parallel.

50. The strapvest of any of embodiments 15-49, wherein the rotatable portion is rotatable about an axis between or connecting the first juncture and the second juncture.

51. The strapvest of embodiment 50, wherein the rotatable portion is symmetrical across the axis such that the shape of the first main strap and/or the second main strap is not changed or is not substantially changed by a rotation of the rotatable portion.

52. The strapvest of embodiment 51, wherein the rotation is a 180 degree rotation.

53. The strapvest of any of embodiments 15-52, wherein the rotatable portion is rotatable without disconnecting or detaching the rotatable portion from the first main strap and/or the second main strap.

54. The strapvest of any of embodiments 15-52, wherein the rotatable portion is rotatable by disconnecting or detaching the rotatable portion from the first main strap and/or the second main strap and re-connecting or re-attaching the rotatable portion in a rotated configuration.

55. The strapvest of embodiment 54, wherein the rotated configuration is or is about a 180 degree rotation along its axis.

56. The strapvest of any one of embodiments 15-55, wherein the first main strap and/or the second main strap comprises one or more compartments, and wherein the rotatable portion comprises at least one of the one or more compartments on the interior side and/or comprises at least one of the one or more compartments on the exterior side.

57. The strapvest of any one of embodiments 15-56, wherein the first main strap and/or the second main strap comprises one or more compartments, and wherein the rotatable portion comprises at least one of the one or more compartments on the interior side and comprises at least one of the one or more compartments on the exterior side.

58. The strapvest of any one of embodiments 1-57, wherein the first main strap and/or the second main strap further comprises one or more compartments.

59. The strapvest of embodiment 58, wherein the one or more compartments of the first main strap and/or the second main strap comprise one or more detachable compartments.

60. The strapvest of embodiment 58 or embodiment 59, wherein the one or more compartments of the first main strap and/or the second main strap comprise one or more non-detachable compartments.

61. The strapvest of any one of embodiments 58-60, wherein the one or more compartments comprise one or more detachable compartments and one or more non-detachable compartments.

62. The strapvest of any one of embodiments 59-61, wherein the one or more detachable compartments is reversibly attached to the first main strap and/or the second main strap by a reversible attachment mechanism selected from the group consisting of a zipper, a magnet, a buckle, a hook and loop closure, a snap closure, slider clips, or two-part release clips, or a combination thereof.

63. The strapvest of any one of embodiments 58-62, wherein the one or more compartments of the first main strap and/or the second main strap comprise a pocket.

64. The strapvest of embodiment 63, wherein the pocket is a sealable pocket.

65. The strapvest of embodiment 64, wherein the sealable pocket is sealable by a zipper or a hook and loop closure.

66. The strapvest of embodiment 64 or embodiment 65, wherein the sealable pocket is sealable by a zipper.

67. The strapvest of embodiment 63, wherein the pocket is a protruding pocket.

68. The strapvest of embodiment 67, wherein the protruding pocket is comprised on the torso portion of the first main strap and/or the second main strap.

69. The strapvest of embodiment 67, wherein the protruding pocket is comprised on the right side portion of the first main strap and/or the left side portion of the second main strap.

70. The strapvest of any one of embodiments 67-69, wherein the protruding pocket is irreversibly or permanently connected to the first main strap and/or the second main strap, on one side of the protruding pocket, and is reversibly connected to the first main strap and/or the second main strap, on another side of the protruding pocket by a closing feature.

71. The strapvest of any one of embodiments 67-70, wherein the protruding pocket comprises a closing feature and is configured to protrude outward from the first main strap and/or the second main strap upon releasing the closing feature.

72. The strapvest of embodiment 71, wherein the protruding pocket is configured to protrude outward in a vertical direction.

73. The strapvest of embodiment 71, wherein the protruding pocket is configured to protrude outward in a horizontal direction.

74. The strapvest of any one of embodiments 70-73, wherein the closing feature is selected from the group consisting of a zipper, a magnet, a buckle, a hook and loop closure, a snap closure, a rotatable pin, a retractable pin, a spring-loaded pin, slider clips, or two-part release clips, or a combination thereof.

75. The strapvest of any one of embodiments 70-74, wherein the closing feature is a hook and loop closure.

76. The strapvest of any one of embodiments 63-75, wherein the pocket is irreversibly or permanently connected to the first main strap and/or the second main strap.

77. The strapvest of any one of embodiments 59-76, wherein the one or more detachable compartments comprise a detachable pocket.

78. The strapvest of any one of embodiments 60-77, wherein the one or more non-detachable compartments comprise a non-detachable pocket.

79. The strapvest of embodiment 65, wherein the non-detachable pocket is a protruding pocket.

80. The strapvest of any one of embodiments 67-79, wherein the protruding pocket is reversibly connected to the interior face of the first main strap and/or the second main strap.

81. The strapvest of any one of embodiments 58-80, wherein the one or more compartments of the first main strap and/or the second main strap comprises at least one compartment on the torso portion of the first main strap and/or the second main strap.

82. The strapvest of any one of embodiments 58-81, wherein the one or more compartments of the first main strap and/or the second main strap comprises at least one compartment on the left side portion of the second main strap and/or the right side portion of the first main strap.

83. The strapvest of any one of embodiments 58-82, wherein the one or more compartments of the first main strap and/or the second main strap comprises at least one compartment on the shoulder portion of the first main strap and/or the second main strap.

84. The strapvest of any one of embodiments 58-83, wherein the one or more compartments of the first main strap and/or the second main strap comprises at least one compartment on the torso portion, at least one compartment on the left side portion, at least one compartment on the right side portion.

85. The strapvest of any one of embodiments 24-84, wherein the one or more compartments of the rotatable portion comprises at least one compartment on an exterior side of one or more of the torso portion, the right side portion, the shoulder portion, and/or the back portion of the first main strap; and at least one compartment on an interior side of one or more of the torso portion, the left side portion, the shoulder portion, and/or the back portion of the second main strap.

86. The strapvest of any one of embodiments 24-85, wherein the one or more compartments of the rotatable portion and/or the one or more further compartments of the first main strap and/or the second main strap comprises a compartment comprising an interior.

87. The strapvest of any one of embodiments 24-86, wherein the one or more compartments of the rotatable portion and/or the one or more further compartments of the first main strap and/or the second main strap comprises a compartment comprising a compressible foam material within the interior of the compartment.

88. The strapvest of embodiment 87, wherein the compressible foam material is located on one or more of an upper portion, a lower portion, an internal portion, or a side portion within the interior of the compartment.

89. The strapvest of embodiment 87 or embodiment 88, wherein the compressible foam material fills at least 25%, at least 50%, or at least 75% of the volume of the interior of the compartment, optionally wherein the compressible foam material is located on the upper portion, the side portion, and the lower portion of the interior of the compartment.

90. The strapvest of any one of embodiments 87-89, wherein the compressible foam material is a compressible foam insert shaped to fill at least a portion of the interior of the compartment.

91. The strapvest of embodiment 90, wherein the compressible foam insert fills at least 25%, at least 50%, or at least 75% of the volume of the interior of the compartment.

92. The strapvest of any one of embodiments 24-91, wherein the first main strap and/or the second main strap comprises a first fabric layer, and at least one of the one or more compartments comprises a second fabric layer that is connected to the first fabric layer, wherein the interior of the compartment is situated between the first fabric layer and the second fabric layer.

93. The strapvest of embodiment 92, wherein at least one of the first fabric layer or the second fabric layer comprises a compressible foam material adapted to secure items within the at least one compartment comprising the second fabric layer.

94. The strapvest of any of embodiments 24-93, wherein at least one of the one or more compartments of the rotatable portion is accessible from an upper opening and/or a side opening.

95. The strapvest of any of embodiments 58-94, wherein at least one of the one or more compartments of the first main strap and/or the second main strap is accessible from an upper opening and/or a side opening.

96. The strapvest of any of embodiments 1-95, further comprising one or more detachable compartments removably attached to the first main strap and/or the second main strap.

97. The strapvest of embodiment 96, wherein the one or more detachable compartments comprises at least one detachable compartment on the torso portion of the first main strap and/or the second main strap.

98. The strapvest of embodiment 96 or embodiment 97, wherein the one or more detachable compartments comprises at least one detachable compartment on the left side portion of the second main strap and/or the right side portion of the first main strap.

99. The strapvest of any one of embodiments 96-98, wherein the one or more detachable compartments comprises at least one detachable compartment on the shoulder portion of the first main strap and/or the second main strap.

100. The strapvest of any one of embodiments 96-99, wherein the one or more detachable compartments is removably attached by at least one of a zipper, a magnet, a buckle, a hook and loop closure, a snap closure, a rotatable pin, a retractable pin, a spring-loaded pin, slider clips, or two-part release clips, or a combination thereof.

101. The strapvest of any one of embodiments 96-100, wherein the first main strap and/or the second main strap comprises an upper release mechanism removably attached to an upper portion of the detachable compartment and a lower release mechanism removably attachable to a lower portion of the detachable compartment, and wherein the one or more detachable compartments are removably attachable to the first main strap and/or the second main strap by the upper release mechanism and the lower release mechanism.

102. The strapvest of any one of embodiments 96-101, wherein the first main strap and/or the second main strap comprises an upper release mechanism removably attachable to an upper portion of the detachable compartment and/or a lower release mechanism removably attachable to a lower portion of the detachable compartment, and wherein the one or more detachable compartments are removably attachable to the first main strap and/or the second main strap by the upper release mechanism and/or the lower release mechanism.

103. The strapvest of any one of embodiments 96-102, wherein the first main strap and/or the second main strap comprises one or more strap-side attachment mechanisms, and the one or more detachable compartments comprise one or more compartment-side attachment mechanisms.

104. The strapvest of embodiment 103, wherein each of the one or more strap-side attachment mechanisms is adapted to reversibly attach to one or more of the compartment-side attachment mechanisms.

105. The strapvest of embodiment 103 or embodiments 104, wherein:

(i) the one or more strap-side attachment mechanisms is a hook-compatible loop closure, and the one or more compartment-side attachment mechanisms is a loop-compatible hook closure; or (ii) the one or more strap-side attachment mechanisms is a loop-compatible hook closure, and the one or more compartment-side attachment mechanisms is a hook-compatible loop closure; or (iii) the one or more strap-side attachment mechanisms is a stud-compatible socket, and the one or more compartment-side attachment mechanisms is a socket-compatible stud; or (iv) the one or more strap-side attachment mechanisms is a buckle, and the one or more compartment-side attachment mechanisms is a buckle-compatible strap; or (v) the one or more strap-side attachment mechanisms is a buckle-compatible strap, and the one or more compartment-side attachment mechanisms is a buckle; or (iv) the one or more strap-side attachment mechanisms is a buckle comprising a male end, and the one or more compartment-side attachment mechanisms is a buckle comprising a female end; or (v) the one or more strap-side attachment mechanisms is a buckle comprising a female end, and the one or more compartment-side attachment mechanisms is a buckle comprising a male end.

106. The strapvest of any of embodiments 96-105, wherein the one or more detachable compartments are removably attached to the torso portion of the first main strap and/or the second main strap.

107. The strapvest of any of embodiments 96-106, wherein one or more of the detachable compartments are removably attached to the right side portion of the first main strap; and/or one or more of the detachable compartments are removably attached to the left side portion of the second main strap.

108. The strapvest of any one of embodiments 96-107, wherein the one or more detachable compartments comprises a sliding compartment.

109. The strapvest of embodiment 108, wherein the sliding compartment comprises a pair of rail inserts that are parallel to one another.

110. The strapvest of embodiment 108 or embodiment 109, wherein the first main strap and/or the second main strap comprises a pair of rail tracks that are parallel to one another and adapted to receive the pair of rail inserts of the sliding compartment.

111. The strapvest of any of embodiments 1-110, wherein the first main strap and the second main strap are releasably connected by a closure.

112. The strapvest of embodiment 111, wherein the closure is or comprises a zipper.

113. The strapvest of embodiment 112, wherein the closure is a single-point closure.

114. The strapvest of embodiment 113, wherein the single-point closure comprises a button, a buckle, a hook and loop closure, a snap, or a stud-type closure on the first main strap, and a complementary connecting feature on the second main strap.

115. The strapvest of embodiment 113 or embodiment 114, wherein the single-point closure releasably connects the first main strap to the second main strap at a single point.

116. The strapvest of any one of embodiments 113-115, wherein the single-point closure comprises: (i) a hook-compatible loop closure on the first main strap, and a loop-compatible hook closure on the second main strap; or (ii) a loop-compatible hook closure on the first main strap, and a hook-compatible loop closure on the second main strap; or (iii) a stud-compatible socket on the first main strap, and a socket-compatible stud on the second main strap; or (iv) a socket-compatible stud on the first main strap, and a stud-compatible socket on the second main strap; or (v) a buckle on the first main strap, and a buckle-compatible strap on the second main strap; or (vi) a buckle-compatible strap on the first main strap, and a buckle on the second main strap; or (vii) a buckle comprising a male end on the first main strap, and a buckle comprising a female end on the second main strap; or (viii) a buckle comprising a female end on the first main strap, and a buckle comprising a male end on the second main strap.

117. The strapvest of any one of embodiments 113-116, wherein the single-point closure comprises a first connector on the first main strap and a second connector on the second main strap, wherein the first connector and the second connector are adapted to releasably connect with one another.

118. The strapvest of embodiment 117, wherein the first connector is connected to the torso portion of the first main strap, and the second connector is connected to the torso portion of the second main strap.

119. The strapvest of any of embodiments 113-118, wherein the single-point closure is positioned over a sternum of the wearer or within 1 inch, two inches, three inches, four inches, five inches, or six inches below the bottom of a sternum of a wearer when the strapvest is worn by the wearer.

120. The strapvest of any of embodiments 113-118, wherein the single-point closure is positioned over the abdomen of a wearer when the strapvest is worn by the wearer.

121. The strapvest of embodiment 117, wherein the first connector is connected to the right side portion of the first main strap, and the second connector is connected to the left side portion of the second main strap.

122. The strapvest of any one of embodiments 113-121, wherein the single-point closure is connected to the first main strap and/or the second main strap by a stabilizing belt.

123. The strapvest of embodiment 122, wherein the stabilizing belt is extendible and/or adjustable.

124. The strapvest of any one of embodiments 1-123, wherein the first main strap and the second main strap are releasably connected by a closure comprising a zipper.

125. The strapvest of embodiment 124, wherein the closure comprising a zipper releasably connects the first main strap and the second main strap across at least a portion of the torso portion of the first main strap and the second main strap.

126. The strapvest of any of embodiments 1-125, further comprising one or more holster bands connected to the first main strap and/or the second main strap at a first end and a second end of each of the one or more holster bands.

127. The strapvest of embodiment 126, wherein:

a holster band of the one or more holster bands is connected to the first main strap at a first end of the holster band and at a second end of the holster band, wherein the first end and the second end of the holster band are located on opposite ends of the holster band; and/or a holster band of the one or more holster bands is connected to the second main strap at a first end of the holster band and at a second end of the holster band, wherein the first end and the second end of the holster band are located on opposite ends of the holster band.

128. The strapvest of embodiment 126 or embodiment 127, wherein at least one of the one or more holster bands is adapted to secure a tool to the strapvest.

129. The strapvest of any one of embodiments 126-128, wherein at least one of the one or more holster bands is connected to the right side portion; and/or at least one of the one or more holster bands is connected to the left side portion.

130. The strapvest of any one of embodiments 1-129, further comprising a stabilizing belt comprising a first end and a second end, wherein the first end of the stabilizing belt is connected to the back portion of the first main strap and/or the second end of the stabilizing belt is connected to the back portion of the second main strap.

131. The strapvest of embodiment 130, wherein the first end of the stabilizing belt is reversibly connected to the back portion of the first main strap and/or the second end of the stabilizing belt is reversibly connected to the back portion of the second main strap.

132. The strapvest of embodiment 130, wherein:

(i) the first end of the stabilizing belt is irreversibly connected to the back portion of the first main strap and the second end of the stabilizing belt is reversibly connected to the back portion of the second main strap; or (ii) the first end of the stabilizing belt is reversibly connected to the back portion of the first main strap and the second end of the stabilizing belt is irreversibly connected to the back portion of the second main strap; or (iii) the first end of the stabilizing belt is irreversibly connected to the back portion of the first main strap and the second end of the stabilizing belt is irreversibly connected to the back portion of the second main strap.

133. The strapvest of any one of embodiments 130-132, wherein:

the first end of the stabilizing belt is connected to the back portion of the first main strap at a position that is less than or less than about 10, 9, 8, 7, 6, 5, 4, 3, 2, or 1 inch from the top of the shoulder portion of the first main strap; and/or the second end of the stabilizing belt is connected to the back portion of the second main strap at a position that is less than or less than about 10, 9, 8, 7, 6, 5, 4, 3, 2, or 1 inch from the top of the shoulder portion of the second main strap.

134. The strapvest of any one of embodiments 130-133, wherein:

the first end of the stabilizing belt is connected to the back portion of the first main strap at a position that is between or between about 2 and 6 inches from the top of the shoulder portion of the first main strap; and/or the second end of the stabilizing belt is connected to the back portion of the second main strap at a position that is between or between about 2 and 6 inches from the top of the shoulder portion of the second main strap.

135. The strapvest of any one of embodiments 130-134, wherein the length of the stabilizing belt from the first end to the second end is adjustable and/or extendible.

136. The strapvest of any one of embodiments 1-135, wherein the torso portion and the right side portion of the first main strap forms a J-shape or a semi-J shape, and the torso portion and the left side portion of the second main strap forms a reverse J-shape, a semi-reverse J-shape, an L-shape, or a semi-L shape.

137. The strapvest of any one of embodiments 2-136, wherein the first main strap comprises a right side portion adapted to run around a right side body of the wearer, and a back portion adapted to run up a back of the wearer; and the second main strap comprises a left side portion adapted to run around a left side body of the wearer, and a back portion adapted to run up the back of the wearer.

What is claimed is:

1. A strapvest comprising:

a first main strap comprising an exterior face adapted to face outward from a wearer and an interior face opposite the exterior face, wherein the first main strap comprises a shoulder portion adapted to run up over a shoulder of the wearer, and a torso portion adapted to run down a front torso of the wearer; and a second main strap comprising an exterior face adapted to face outward from the wearer and an interior face opposite the exterior face, wherein the second main strap comprises a shoulder portion adapted to run up over another shoulder of the wearer, and a torso portion adapted to run down the front torso of the wearer;

wherein:

(i) the shoulder portion of the first main strap and the shoulder portion of the second main strap are connected by a strap;

(ii) the torso portion of the first main strap comprises a rotatable portion that is connected to the first main strap at a first juncture at a first end of the rotatable portion and at a second juncture at a second end of the rotatable portion opposite the first end; and/or the torso portion of the second main strap comprises a rotatable portion that is connected to the second main strap at a first juncture at a first end of the rotatable portion and at a second juncture at a second end of the rotatable portion opposite the first end; and (iii) the rotatable portion comprises one or more compartments.

2. The strapvest of claim 1, further comprising an adjustable support strap connected to the first main strap and the second main strap.

3. The strapvest of claim 1, wherein:

the rotatable portion is reversibly detachable from the first main strap and/or the second main strap;

the rotatable portion comprises a first connecting feature at the first juncture and a second connecting feature at the second juncture; and the first connecting feature and/or the second connecting feature is selected from the group consisting of a rotatable pin, a retractable pin, a spring-loaded pin, a zipper, a magnet, a buckle, a hook and loop closure, a snap closure, slider clips, two-part release clips, and a ball and socket attachment.

4. The strapvest of claim 1, wherein:

the rotatable portion comprises an interior side facing inward and an exterior side facing outward;

the interior side of the rotatable portion comprises one or more compartments and the exterior side of the rotatable portion comprises one or more compartments; and the rotatable portion is rotatably connected to the first main strap and/or the second main strap such that the exterior side can be rotated to face inward and the interior side can be rotated to face outward.

5. The strapvest of claim 1, wherein the one or more compartments comprise a pocket that is a sealable pocket or a protruding pocket.

6. The strapvest of claim 5, wherein the pocket is a protruding pocket and:

the protruding pocket is irreversibly or permanently connected to the rotatable portion, on one side of the protruding pocket, and is reversibly connected to the rotatable portion, on another side of the protruding pocket by a closing feature; or the protruding pocket comprises a closing feature and is configured to protrude outward from the rotatable portion upon releasing the closing feature.

7. The strapvest of claim 1, wherein the first main strap and/or the second main strap comprises one or more compartments.

8. The strapvest of claim 7, wherein the one or more compartments of the first main strap and/or the second main strap comprise a pocket.

9. The strapvest of claim 8, wherein the pocket is a sealable pocket or a protruding pocket.

10. The strapvest of claim 8, wherein the pocket is a protruding pocket and the protruding pocket comprises a closing feature and is configured to protrude outward from the first main strap and/or the second main strap upon releasing the closing feature.

11. The strapvest of claim 7, wherein the one or more compartments of the first main strap and/or the second main strap comprises a compartment comprising a compressible foam material within the interior of the compartment.

12. The strapvest of claim 1, further comprising one or more detachable compartments removably attached to the first main strap and/or the second main strap.

13. The strapvest of claim 1, wherein the first main strap and the second main strap are releasably connected by a closure.

14. The strapvest of claim 1, wherein the first main strap comprises a right side portion adapted to run around a right side body of the wearer, and a back portion adapted to run up a back of the wearer; and the second main strap comprises a left side portion adapted to run around a left side body of the wearer, and a back portion adapted to run up the back of the wearer.

15. A strapvest comprising:

a first main strap comprising an exterior face adapted to face outward from a wearer and an interior face opposite the exterior face, wherein the first main strap comprises a shoulder portion adapted to run up over a shoulder of the wearer, and a torso portion adapted to run down a front torso of the wearer; and a second main strap comprising an exterior face adapted to face outward from the wearer and an interior face opposite the exterior face, wherein the second main strap comprises a shoulder portion adapted to run up over another shoulder of the wearer, and a torso portion adapted to run down the front torso of the wearer;

wherein:

(i) the shoulder portion of the first main strap and the shoulder portion of the second main strap are connected by a strap;

(ii) the first main strap and/or the second main strap comprises one or more compartments; and (iii) the first main strap and/or the second main strap comprises a first fabric layer, and at least one of the one or more compartments comprises a second fabric layer that is connected to the first fabric layer, wherein the interior of the compartment is situated between the first fabric layer and the second fabric layer.

16. A strapvest comprising:

a first main strap comprising an exterior face adapted to face outward from a wearer and an interior face opposite the exterior face, wherein the first main strap comprises a shoulder portion adapted to run up over a shoulder of the wearer, and a torso portion adapted to run down a front torso of the wearer;

a second main strap comprising an exterior face adapted to face outward from the wearer and an interior face opposite the exterior face, wherein the second main strap comprises a shoulder portion adapted to run up over another shoulder of the wearer, and a torso portion adapted to run down the front torso of the wearer; and one or more detachable compartments removably attached to the first main strap and/or the second main strap;

wherein:

(i) the shoulder portion of the first main strap and the shoulder portion of the second main strap are connected by a strap; and (ii) the one or more detachable compartments comprises a sliding compartment.

17. The strapvest of claim 16, wherein:

the sliding compartment comprises a pair of rail inserts that are parallel to one another; and the first main strap and/or the second main strap comprises a pair of rail tracks that are parallel to one another and adapted to receive the pair of rail inserts of the sliding compartment.

18. A strapvest comprising:

a first main strap comprising an exterior face adapted to face outward from a wearer and an interior face opposite the exterior face, wherein the first main strap comprises a shoulder portion adapted to run up over a shoulder of the wearer, and a torso portion adapted to run down a front torso of the wearer;

a second main strap comprising an exterior face adapted to face outward from the wearer and an interior face opposite the exterior face, wherein the second main strap comprises a shoulder portion adapted to run up over another shoulder of the wearer, and a torso portion adapted to run down the front torso of the wearer; and a stabilizing belt comprising a first end and a second end, wherein the first end of the stabilizing belt is connected to the back portion of the first main strap and the second end of the stabilizing belt is connected to the back portion of the second main strap;

wherein the shoulder portion of the first main strap and the shoulder portion of the second main strap are connected by a strap.

* * * * *